US011400499B2

(12) United States Patent
Ishii et al.

(10) Patent No.: US 11,400,499 B2
(45) Date of Patent: Aug. 2, 2022

(54) METHOD FOR SETTING ROLLING MILL, AND ROLLING MILL

(71) Applicant: NIPPON STEEL CORPORATION, Tokyo (JP)

(72) Inventors: Atsushi Ishii, Tokyo (JP); Kazuma Yamaguchi, Tokyo (JP); Daisuke Nikkuni, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/977,035

(22) PCT Filed: Mar. 4, 2019

(86) PCT No.: PCT/JP2019/008384
§ 371 (c)(1),
(2) Date: Aug. 31, 2020

(87) PCT Pub. No.: WO2019/172182
PCT Pub. Date: Sep. 12, 2019

(65) Prior Publication Data

US 2021/0039148 A1 Feb. 11, 2021

(30) Foreign Application Priority Data

Mar. 8, 2018 (JP) ..... JP2018-041918

(51) Int. Cl.
*B21B 31/02* (2006.01)
*B21B 37/46* (2006.01)
(Continued)

(52) U.S. Cl.
CPC ..... *B21B 31/02* (2013.01); *B21B 37/46* (2013.01); *B21B 38/08* (2013.01); *B21C 51/00* (2013.01)

(58) Field of Classification Search
CPC ..... B21B 38/08; B21B 38/105; B21B 37/00; B21B 37/58; B21B 37/62; B21B 37/68;
(Continued)

(56) References Cited

U.S. PATENT DOCUMENTS

2002/0023473 A1* 2/2002 Harako ..... B21B 31/02 72/245
2017/0008055 A1* 1/2017 Norikura ..... B21B 13/14

FOREIGN PATENT DOCUMENTS

JP 57193210 A * 11/1982 ..... B21B 13/023
JP 8-294713 A 11/1996
(Continued)

*Primary Examiner* — Adam J Eiseman
*Assistant Examiner* — P Derek Pressley
(74) *Attorney, Agent, or Firm* — Birch, Stewart, Kolasch & Birch, LLP

(57) ABSTRACT

A method for setting a rolling mill, the method being executed before reduction position zero point adjustment or before the start of rolling, and including: a first process of setting rolls in an open state, and with respect to each of the upper roll assembly and the lower roll assembly, adjusting positions of roll chocks in a rolling direction based on a torque acting on the work roll or a vertical roll load difference; and a second process of, after the first process, setting rolls in a kiss roll state, measuring a vertical roll load in two rotational states on a work side and a drive side, and moving roll chocks of a roll assembly on the opposite side to a reference roll simultaneously and in a same direction so that the vertical roll load difference falls within an allowable range to thereby adjust the positions of the roll chocks.

9 Claims, 29 Drawing Sheets

(51) Int. Cl.
*B21B 38/08* (2006.01)
*B21C 51/00* (2006.01)

(58) Field of Classification Search
CPC ..... B21B 31/02; B21B 31/16; B21B 31/18; B21B 31/20; B21B 2271/02; B21B 2035/149
See application file for complete search history.

(56) References Cited

FOREIGN PATENT DOCUMENTS

| | | | | |
|---|---|---|---|---|
| JP | H10-52703 | A | * | 2/1998 |
| JP | 2003290806 | A | * | 10/2003 |
| JP | 3499107 | B2 | | 2/2004 |
| JP | 4962334 | B2 | | 6/2012 |
| JP | 2014-4599 | A | | 1/2014 |

* cited by examiner

<SECOND ADJUSTMENT> or

<FIRST ADJUSTMENT (UPPER ROLL ASSEMBLY)> or

ROTATION (NORMAL ROTATION OR REVERSE ROTATION)

<SECOND ADJUSTMENT (UPPER ROLL ASSEMBLY)> or

ROTATION (NORMAL ROTATION OR REVERSE ROTATION)

METHOD FOR SETTING ROLLING MILL, AND ROLLING MILL

TECHNICAL FIELD

The present invention relates to a rolling mill that rolls a workpiece, and a method for setting the rolling mill.

BACKGROUND ART

In a hot rolling process, for example, zigzagging of a steel plate occurs as a phenomenon that is the cause of rolling trouble. A thrust force that is generated at a minute cross (also referred to as "roll skew") between rolls of a rolling apparatus is one cause of zigzagging of a steel plate, and it is difficult to directly measure such a thrust force. Therefore, in the past it has been proposed to measure a thrust counterforce that is detected as a counterforce that is the total value of thrust forces generated between rolls or a roll skew angle, and identify the thrust force generated between rolls based on the thrust counterforce or the roll skew angle and perform zigzagging control of the steel plate.

For example, Patent Document 1 discloses a plate rolling method which measures a thrust counterforce in the axial direction of a roll and a load in a vertical direction, determines either one of, or both of, a reduction position zero point and deformation properties of the rolling mill, and sets the reduction position at the time of rolling execution and controls rolling. Further, Patent Document 2 discloses a zigzagging control method that calculates a thrust force generated at a roll based on an inter-roll minute cross angle (skew angle) that is measured using a distance sensor provided inside a rolling mill and, based on the thrust force, calculates a differential load component that is a cause of zigzagging based on a load measurement value in the vertical direction and performs reduction leveling control. In addition, Patent Document 3 discloses a cross-point correcting device which corrects a deviation in a point (cross point) at which the central axes of upper and lower rolls cross in the horizontal direction in a pair cross rolling mill. The apparatus includes an actuator that absorbs play that arises between a crosshead and roll chocks, and a detector that detects roll chock positions, and corrects a deviation in the cross point based on the roll chock positions.

Further, Patent Document 4 discloses a method for controlling a rolling mill that detects a load difference between the drive side and the work side, and by estimating a differential load caused by thrust during rolling when controlling zigzagging of a rolled material by independently controlling reduction positions on the drive side and on the work side based on the detected load difference, separates a differential load during rolling into a load that is attributable to zigzagging of the rolled material and a load that is attributable to thrust, and controls reduction positions on the drive side and the work side based on these separated differential loads.

LIST OF PRIOR ART DOCUMENTS

Patent Document

Patent Document 1: JP3499107B
Patent Document 2: JP2014-4599A
Patent Document 3: JP8-294713A
Patent Document 4: JP4962334B

SUMMARY OF INVENTION

Technical Problem

However, according to the technique disclosed in Patent Document 1, although it is necessary to perform measurement of the thrust counterforce of rolls other than a backup roll at a time of reduction position zero point adjustment and during rolling, in the case of measuring thrust counterforces during rolling, in some cases characteristics such as the working point of the thrust counterforce change depending on changes in the rolling conditions such as the rolling load, and asymmetric deformation that accompanies the thrust force cannot be correctly identified. Therefore, there is the possibility that reduction leveling control cannot be accurately performed.

Further, according to the technique disclosed in Patent Document 2, a roll skew angle is determined based on a distance in the horizontal direction of a roll that is measured by a distance sensor such as a vortex sensor. However, because a roll vibrates in the horizontal direction depending on the degree of machining precision such as the eccentricity or cylindricity of a roll body length portion, and chock positions in the horizontal direction fluctuate due to impact at the time of biting at the start of rolling and the like, it is difficult to accurately measure the horizontal displacement of a roll which is a factor that causes the generation of a thrust force. Furthermore, the coefficient of friction of a roll is constantly changing because the degree of roughness of a roll changes with time as the number of rolled workpieces increases. Therefore, calculation of a thrust force without identification of the coefficient of friction cannot be performed accurately based on only a roll skew angle measurement.

In addition, according to the technique disclosed in Patent Document 3, an inter-roll cross angle arises due to relative crossing of rolls, and since there is also looseness in roll bearings and the like, even if position control of each roll chock position is individually performed in the rolling direction, deviations in the relative positional relation between the rolls themselves are not eliminated. Consequently, thrust forces that are generated due to inter-roll cross angles cannot be eliminated.

Further, according to the technique disclosed in Patent Document 4, prior to rolling, in a state in which upper and lower rolls do not contact each other, a bending force is imparted while driving the rolls, and a differential load that is caused by thrust is estimated based on a thrust factor or a skew amount that is determined based on a load difference between the drive side and the work side that arises at such time. According to Patent Document 4, the thrust factor or skew amount is identified based on only measurement values in one rotational state of the upper and lower rolls. Therefore, in a case where there is a deviation in a zero point at a load detection apparatus or in a case where the influence of frictional resistance between the housing and roll chocks differs between left and right, there is a possibility that a left-right asymmetry error may arise between a measurement value on the drive side and a measurement value on the work side. In particular, in a case where the load level is small, such as in the case of a bending force load, the error in question can become a critical error with respect to identification of the thrust factor or the skew amount. Further, according to the technique disclosed in Patent Document 4, a thrust factor or a skew amount cannot be identified unless a coefficient of friction between rolls is applied.

In addition, according to Patent Document 4, it is assumed that a thrust counterforce of a backup roll acts along the axial center position of the roll, and a change in the position of the working point of the thrust counterforce is not taken into consideration. Usually, because the chocks of a backup roll are supported by a pressing-down device or the like, the position of the working point of a thrust counterforce is not always located along the axial center of the roll. Consequently, an error arises in an inter-roll thrust force that is determined based on a load difference between a vertical roll load on the drive side and a vertical roll load on the work side, and an error also arises in a thrust factor or a skew amount that is calculated based on the inter-roll thrust force.

The present invention has been made in view of the problems described above, and an objective of the present invention is to provide a novel and improved method for setting a rolling mill, and a rolling mill which are capable of reducing thrust forces generated between rolls and suppressing the occurrence of zigzagging and camber of a workpiece.

Solution to Problem

To solve the problems described above, according to one aspect of the present invention there is provided a method for setting a rolling mill, the rolling mill being a rolling mill of four-high or more that includes a plurality of rolls including at least a pair of work rolls and a pair of backup rolls supporting the work rolls, with a plurality of rolls provided on an upper side in a vertical direction with respect to a workpiece being taken as an upper roll assembly, a plurality of rolls provided on a lower side in the vertical direction with respect to the workpiece being taken as a lower roll assembly, and any one roll among the respective rolls that are arranged in the vertical direction being adopted as a reference roll, wherein the rolling mill includes: a torque measurement apparatus which measures a torque acting on the work rolls that is generated by driving of a motor that drives the work rolls; a vertical roll load measurement apparatus which is provided on a work side and a drive side on at least a lower side or an upper side of the rolling mill and which measures a vertical roll load in the vertical direction; a pressing apparatus which, with respect to at least roll chocks of the rolls other than the reference roll, is provided on either one of an entrance side and an exit side in a rolling direction, and which presses the roll chocks in a rolling direction of a workpiece; and a roll chock driving apparatus which, with respect to at least roll chocks of the rolls other than the reference roll, is provided so as to face the pressing apparatus in the rolling direction, and which moves the roll chocks in a rolling direction of a workpiece; the method for setting a rolling mill being executed before reduction position zero point adjustment or before starting rolling, and including a first process of: setting a roll gap between the work rolls in an open state, and with respect to each of the upper roll assembly and the lower roll assembly, in a roll assembly on a side on which the vertical roll load measurement apparatus is installed, measuring a torque acting on the work roll by means of the torque measurement apparatus, or measuring a vertical roll load in two different rotational states of the pair of work rolls on the work side and the drive side, respectively, by means of the vertical roll load measurement apparatus; in a roll assembly on a side on which the vertical roll load measurement apparatus is not installed, measuring a torque acting on the work roll by means of the torque measurement apparatus; and fixing a rolling direction position of roll chocks of the reference roll as a reference position, and moving roll chocks of the rolls other than the reference roll by means of the roll chock driving apparatus based on the torque or a vertical roll load difference that is a difference between a vertical roll load on the work side and a vertical roll load on the drive side, to thereby adjust positions of the roll chocks; and a second process of, after performing the first process, setting the work rolls in a kiss roll state, and measuring a vertical roll load in two different rotational states of the pair of work rolls on the work side and the drive side, respectively, by means of the vertical roll load measurement apparatus; and fixing a rolling direction position of roll chocks of the reference roll as a reference position, and moving the roll chocks of each roll of a roll assembly on an opposite side to the reference roll by means of the roll chock driving apparatus simultaneously and in a same direction while maintaining relative positions between the roll chocks so that the vertical roll load difference is within a predetermined allowable range, to thereby adjust positions of the roll chocks.

In this case, a roll located at a lowermost part or an uppermost part in the vertical direction among the plurality of rolls may be adopted as the reference roll.

Further, in the rolling mill of four-high, when the work rolls are independently driven by different motors, respectively, a configuration may be adopted in which: in the first process, positions of roll chocks of the upper roll assembly and positions of roll chocks of the lower roll assembly are simultaneously adjusted or are each independently adjusted; in a roll assembly on a side on which the vertical roll load measurement apparatus is installed, positions of the roll chocks of the rolls other than the reference roll are adjusted so that the vertical roll load difference is within a predetermined allowable range or so that a value of the torque is minimal; and in a roll assembly on a side on which the vertical roll load measurement apparatus is not installed, positions of the roll chocks of the rolls other than the reference roll are adjusted so that a value of the torque is minimal.

Further, in the rolling mill of four-high, when the pair of work rolls are simultaneously driven by one motor, a configuration may be adopted in which: in the first process, positions of roll chocks of the upper roll assembly and positions of roll chocks of the lower roll assembly are each independently adjusted; in a roll assembly on a side on which the vertical roll load measurement apparatus is installed, positions of the roll chocks of the rolls other than the reference roll are adjusted so that the vertical roll load difference is within a predetermined allowable range or so that a value of the torque is minimal; and in a roll assembly on a side on which the vertical roll load measurement apparatus is not installed, positions of the roll chocks of the rolls other than the reference roll are adjusted so that a value of the torque is minimal.

In addition, when the rolling mill is a six-high rolling mill that includes an intermediate roll between the work roll and the backup roll in the upper roll assembly and the lower roll assembly, respectively, and the work rolls are independently driven by different motors, respectively, a configuration may be adopted in which: in the first process, with respect to each of the upper roll assembly and the lower roll assembly, there are performed a first adjustment that adjusts positions of the roll chocks of the intermediate roll and the roll chocks of the backup roll, and a second adjustment that, after the first adjustment is performed, adjusts positions of the roll chocks of the intermediate roll and the roll chocks of the work roll; wherein, in the first adjustment: with respect to a roll assembly on a side on which the vertical roll load measurement apparatus is installed, positions of roll chocks of the work roll and roll chocks of the intermediate roll are adjusted simultaneously and in a same direction while maintaining relative positions between the roll chocks so that a value of the torque becomes minimal or so that the vertical roll load difference is within a predetermined allowable range, or a position of roll chocks of the backup roll that is not the reference roll is adjusted, and with respect to a roll assembly on a side on which the vertical roll load measurement apparatus is not installed, positions of roll chocks of the work roll and roll chocks of the intermediate roll are adjusted simultaneously and in a same direction while maintaining relative positions between the roll chocks so that a value of the torque becomes minimal, or a position of roll chocks of the backup roll that is not the reference roll is adjusted; and in the second adjustment: with respect to a roll assembly on a side on which the vertical roll load measurement apparatus is installed, a position of roll chocks of the work roll is adjusted so that a value of the torque becomes minimal or so that the vertical roll load difference is within a predetermined allowable range, or positions of roll chocks of the backup roll that is not the reference roll and roll chocks of the intermediate roll are adjusted simultaneously and in a same direction while maintaining relative positions between the roll chocks, and with respect to a roll assembly on a side on which the vertical roll load measurement apparatus is not installed, a position of roll chocks of the work roll is adjusted so that a value of the torque becomes minimal, or positions of roll chocks of the backup roll that is not the reference roll and roll chocks of the intermediate roll are adjusted simultaneously and in a same direction while maintaining relative positions between the roll chocks.

Further, when the rolling mill is a six-high rolling mill that includes an intermediate roll between the work roll and the backup roll in the upper roll assembly and the lower roll assembly, respectively, and the pair of work rolls are simultaneously driven by one motor, a configuration may be adopted in which: in the first process, separately for each of the upper roll assembly and the lower roll assembly, there are performed a first adjustment that adjusts positions of the roll chocks of the intermediate roll and the roll chocks of the backup roll, and a second adjustment that, after the first adjustment is performed, adjusts positions of the roll chocks of the intermediate roll and the roll chocks of the work roll; wherein, in the first adjustment: with respect to a roll assembly on a side on which the vertical roll load measurement apparatus is installed, positions of roll chocks of the work roll and roll chocks of the intermediate roll are adjusted simultaneously and in a same direction while maintaining relative positions between the roll chocks so that a value of the torque becomes minimal or so that the vertical roll load difference is within a predetermined allowable range, or a position of roll chocks of the backup roll that is not the reference roll is adjusted, and with respect to a roll assembly on a side on which the vertical roll load measurement apparatus is not installed, positions of roll chocks of the work roll and roll chocks of the intermediate roll are adjusted simultaneously and in a same direction while maintaining relative positions between the roll chocks so that a value of the torque becomes minimal, or a position of roll chocks of the backup roll that is not the reference roll is adjusted; and in the second adjustment: with respect to a roll assembly on a side on which the vertical roll load measurement apparatus is installed, a position of roll chocks of the work roll is adjusted so that a value of the torque becomes minimal or so that the vertical roll load difference is within a predetermined allowable range, or positions of roll chocks of the backup roll that is not the reference roll and roll chocks of the intermediate roll are adjusted simultaneously and in a same direction while maintaining relative positions between the roll chocks, and with respect to a roll assembly on a side on which the vertical roll load measurement apparatus is not installed, a position of roll chocks of the work roll is adjusted so that a value of the torque becomes minimal, or positions of roll chocks of the backup roll that is not the reference roll and roll chocks of the intermediate roll are adjusted simultaneously and in a same direction while maintaining relative positions between the roll chocks.

Further, to solve the problems described above, according to a different aspect of the present invention there is provided a rolling mill of four-high or more that includes a plurality of rolls including at least a pair of work rolls and a pair of backup rolls supporting the work rolls, with any one roll among the respective rolls that are arranged in a vertical direction being adopted as a reference roll, the rolling mill including: a torque measurement apparatus which measures a torque acting on the work rolls that is generated by driving of a motor that drives the work rolls; a vertical roll load measurement apparatus which is provided on a work side and a drive side on at least a lower side or an upper side of the rolling mill and which measures a vertical roll load in the vertical direction; a pressing apparatus which, with respect to at least roll chocks of the rolls other than the reference roll, is provided on either one of an entrance side and an exit side in a rolling direction, and which presses the roll chocks in a rolling direction of a workpiece; a roll chock driving apparatus which, with respect to at least roll chocks of the rolls other than the reference roll, is provided so as to face the pressing apparatus in the rolling direction, and which moves the roll chocks in a rolling direction of a workpiece; and a roll chock position control unit that fixes a rolling direction position of roll chocks of the reference roll as a reference position, and controls the roll chock driving apparatus based on the torque and a vertical roll load difference that is a difference between the vertical roll load on the work side and the vertical roll load on the drive side to adjust positions in a rolling direction of the roll chocks of the rolls other than the reference roll.

The upper work roll and the lower work roll may be independently driven vertically by different motors, respectively.

Alternatively, the upper work roll and the lower work roll may be simultaneously driven vertically by one motor.

Advantageous Effects of Invention

As described above, according to the present invention, thrust forces generated between rolls can be reduced and the occurrence of zigzagging and camber of a workpiece can be suppressed.

BRIEF DESCRIPTION OF DRAWINGS

FIG. 4B is applied to a six-high rolling mill, that illustrates a first adjustment.

FIG. 4B is applied to a six-high rolling mill, that illustrates a second adjustment.

FIG. 4B is applied to a six-high rolling mill, that illustrates a third adjustment.

DESCRIPTION OF EMBODIMENTS

Figure 1A:
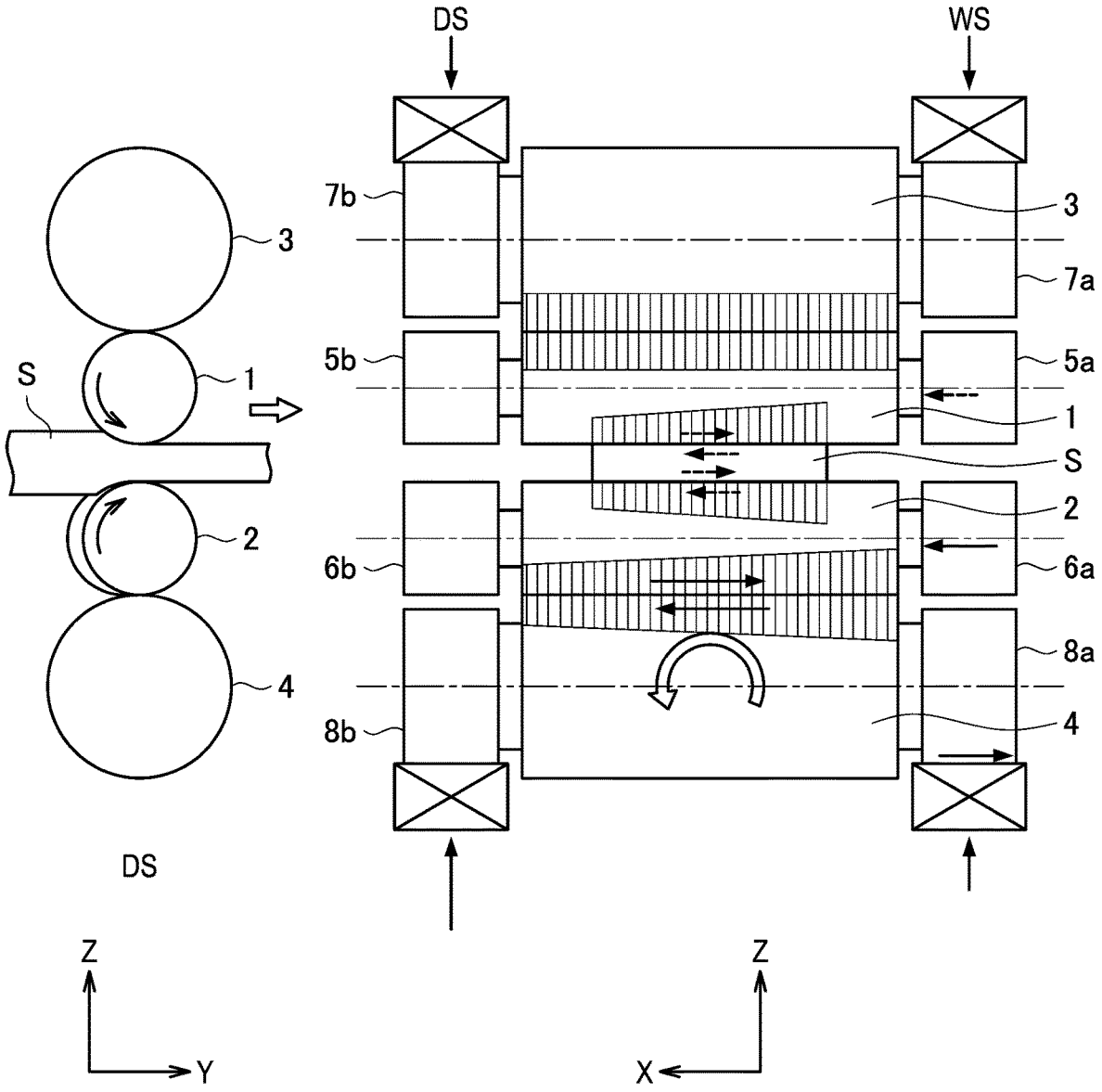
FIG. 1A is a multiview drawing including a schematic side view and a schematic front view of a rolling mill for describing a thrust force and a thrust counterforce generated between rolls of a rolling mill during rolling.

Hereunder, preferred embodiments of the present invention are described in detail while referring to the accompanying drawings. Note that, in the present specification and the accompanying drawings, constituent elements having substantially the same functional configuration are denoted by the same reference characters and a duplicate description thereof is omitted.

1. Objective

An objective of a rolling mill as well as a method for setting the rolling mill according to the embodiments of the present invention is to eliminate thrust forces generated between rolls, and enable the stable production of products without zigzagging and camber or with extremely little zigzagging and camber. In FIG. 1A, a schematic side view and a schematic front view of a rolling mill are illustrated for describing a thrust force and a thrust counterforce which are generated between rolls of a rolling mill during rolling of a workpiece S. Hereunder, as illustrated in FIG. 1A, the work side in the axial direction of rolls is represented by "WS", and the drive side is represented by "DS".

The rolling mill illustrated in FIG. 1A has a pair of work rolls consisting of an upper work roll 1 and a lower work roll 2, and a pair of backup rolls consisting of an upper backup roll 3 that supports the upper work roll 1 in the vertical direction (Z direction) and a lower backup roll 4 that supports the lower work roll 2 in the vertical direction. The work side of the upper work roll 1 is supported by an upper work roll chock 5*a*, and the drive side of the upper work roll 1 is supported by an upper work roll chock 5*b*. The work side of the lower work roll 2 is supported by a lower work roll chock 6*a*, and the drive side of the lower work roll 2 is supported by a lower work roll chock 6*b*. Similarly, the work side of the upper backup roll 3 is supported by an upper backup roll chock 7*a*, and the drive side of the upper backup roll 3 is supported by an upper backup roll chock 7*b*. The work side of the lower backup roll 4 is supported by a lower backup roll chock 8*a*, and the drive side of the lower backup roll 4 is supported by a lower backup roll chock 8*b*.

The upper work roll 1, the lower work roll 2, the upper backup roll 3 and the lower backup roll 4 are arranged in a manner in which the axial directions of the respective rolls are parallel, so as to be orthogonal with the conveyance direction of the workpiece S. In this case, if a roll rotates slightly about an axis (Z-axis) that is parallel with the vertical direction and a deviation arises between the axial directions of the upper work roll 1 and the upper backup roll 3, or a deviation arises between the axial directions of the lower work roll 2 and the lower backup roll 4, a thrust force that acts in the axial direction of the rolls arises between the work roll and the backup roll. An inter-roll thrust force gives an extra moment to the rolls, and causes asymmetric roll deformation to occur due to the aforementioned moment. The asymmetric roll deformation is a factor that causes the rolling to enter an unstable state, and for example gives rise to zigzagging or camber. The inter-roll thrust force is generated as a result of an inter-roll cross angle arising due to the occurrence of a deviation between the axial directions of a work roll and a backup roll. For example, let us assume that an inter-roll cross angle arises between the lower work roll 2 and the lower backup roll 4. At such time, a thrust force is generated between the lower work roll 2 and the lower backup roll 4, and as a result, a moment occurs at the lower backup roll 4, and the load distribution between the rolls changes to balance with the moment, and thus an asymmetric roll deformation occurs. Zigzagging or camber or the like is caused by the asymmetric roll deformation, and the rolling becomes unstable.

According to the present invention, to eliminate an inter-roll thrust force that arises between rolls during rolling of a workpiece by a rolling mill, a method for setting a rolling mill that is described hereunder is executed before reduction position zero point adjustment or before the start of rolling to thereby adjust the roll chock positions of each roll. An objective of the present invention is, by this means, to enable stable production of products without zigzagging and camber or with extremely little zigzagging and camber.

Figure 1B:
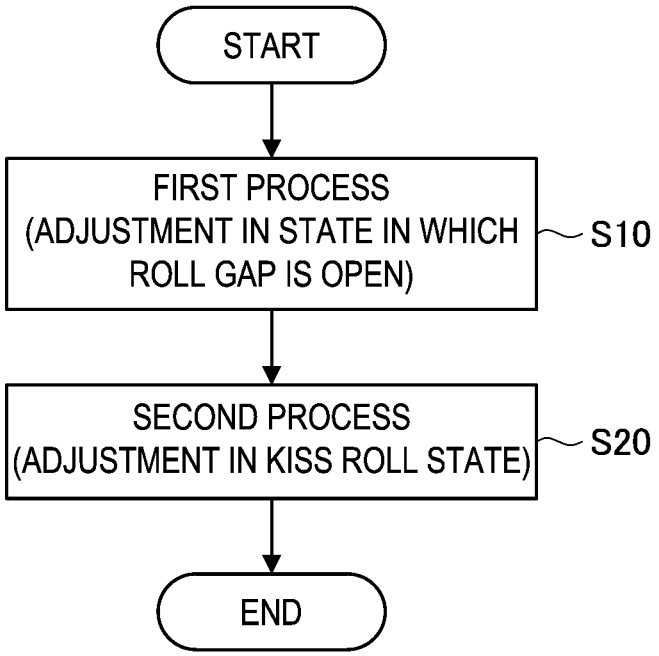
FIG. 1B is a flowchart that describes an outline of a method for setting a rolling mill according to respective embodiments of the present invention.

FIG. 1B is a flowchart that describes an outline of a method for setting a rolling mill according to respective embodiments of the present invention that are described later. In this case, in a rolling mill in which roll chock positions are to be adjusted, a plurality of rolls provided on the upper side in the vertical direction relative to a workpiece is taken as an upper roll assembly, and a plurality of rolls provided on the lower side in the vertical direction relative to the workpiece is taken as a lower roll assembly. Further, any one roll among the respective rolls arranged in the vertical direction is set as a reference roll.

As illustrated in FIG. 1B, with regard to setting of the rolling mill, first, as a first process, a roll gap between the work rolls is set in an open state, and in each of the upper roll assembly and the lower roll assembly, the roll chock positions of the respective rolls are adjusted so that an inter-roll thrust force which arises between rolls is eliminated (S10). At this time, roll chock positions such that an inter-roll cross angle does not arise are identified based on changes in a torque that acts on the work rolls which is generated by driving of a motor which drives the work rolls. Here, the "torque" that is measured in order to identify such roll chock positions may be a motor torque that is identified based on a motor current value, or may be a spindle torque that is measured by attaching a sensor such as a strain gauge to a spindle that is one component for transmitting rotation of a motor to a work roll. In the following description, when simply the term "torque" is used, the term refers to motor torque or spindle torque.

Note that, in a case where it is possible to measure a vertical roll load in the vertical direction by means of a vertical roll load measurement apparatus on the work side and the drive side of a rolling mill, roll chock positions such that an inter-roll cross angle does not arise can also be identified based on a vertical roll load difference that is a difference between a vertical roll load on the work side and a vertical roll load on the drive side. In the first process, in each of the upper roll assembly and the lower roll assembly, adjustment is performed that eliminates an inter-roll cross angle that arises between a plurality of rolls constituting the relevant roll assembly.

After the first process is performed, as a second process, the work rolls are set in a kiss roll state and an adjustment is performed that eliminates an inter-roll cross angle in the upper roll assembly and lower roll assembly overall (S20). In the second process, the rolling direction position of the roll chocks of the reference roll are fixed as a reference position, and the roll chock positions of the respective rolls of the roll assembly on the opposite side to the reference roll are adjusted so that a vertical roll load difference between the pair of work rolls in two different rotational states is within a predetermined allowable range. At such time, the roll chocks of the roll assembly to be adjusted are moved simultaneously and in the same direction by a roll chock driving apparatus while maintaining the relative positions between the relevant roll chocks. By this means, the roll chock positions as a whole can be adjusted without disturbing the positional relationship between the roll chocks that were adjusted in the first process.

Hereunder, the configurations of rolling mills according to each embodiment of the present invention as well as a method for setting the respective rolling mills are described in detail.

2. First Embodiment

The configuration of a rolling mill and an apparatus for controlling the rolling mill, as well as a method for setting the rolling mill according to a first embodiment of the present invention will be described based on FIG. 2 to FIG. 4. In the first embodiment, before reduction position zero point adjustment or before the start of rolling, the positions of roll chocks are adjusted so as to make an inter-roll cross angle between a backup roll serving as a reference and other rolls zero, and thus rolling in which a thrust force does not arise is realized.

[2-1. Configuration of Rolling Mill]

First, the rolling mill according to the present embodiment and an apparatus for controlling the rolling mill will be described based on FIG. 2. FIG. 2 is an explanatory drawing illustrating the configuration of the rolling mill according to the present embodiment and an apparatus for controlling the rolling mill. Note that, it is assumed that the rolling mill illustrated in FIG. 2 is shown in a state as seen from the work side in the axial direction of the rolls. Further, in FIG. 2, a configuration in a case where the lower backup roll is adopted as the reference roll is illustrated. Note that, the reference roll is preferably a roll for which the area of contact between the chocks and the housing is large, and which is located at the lowermost part or the uppermost part where the position is stable.

Figure 2:
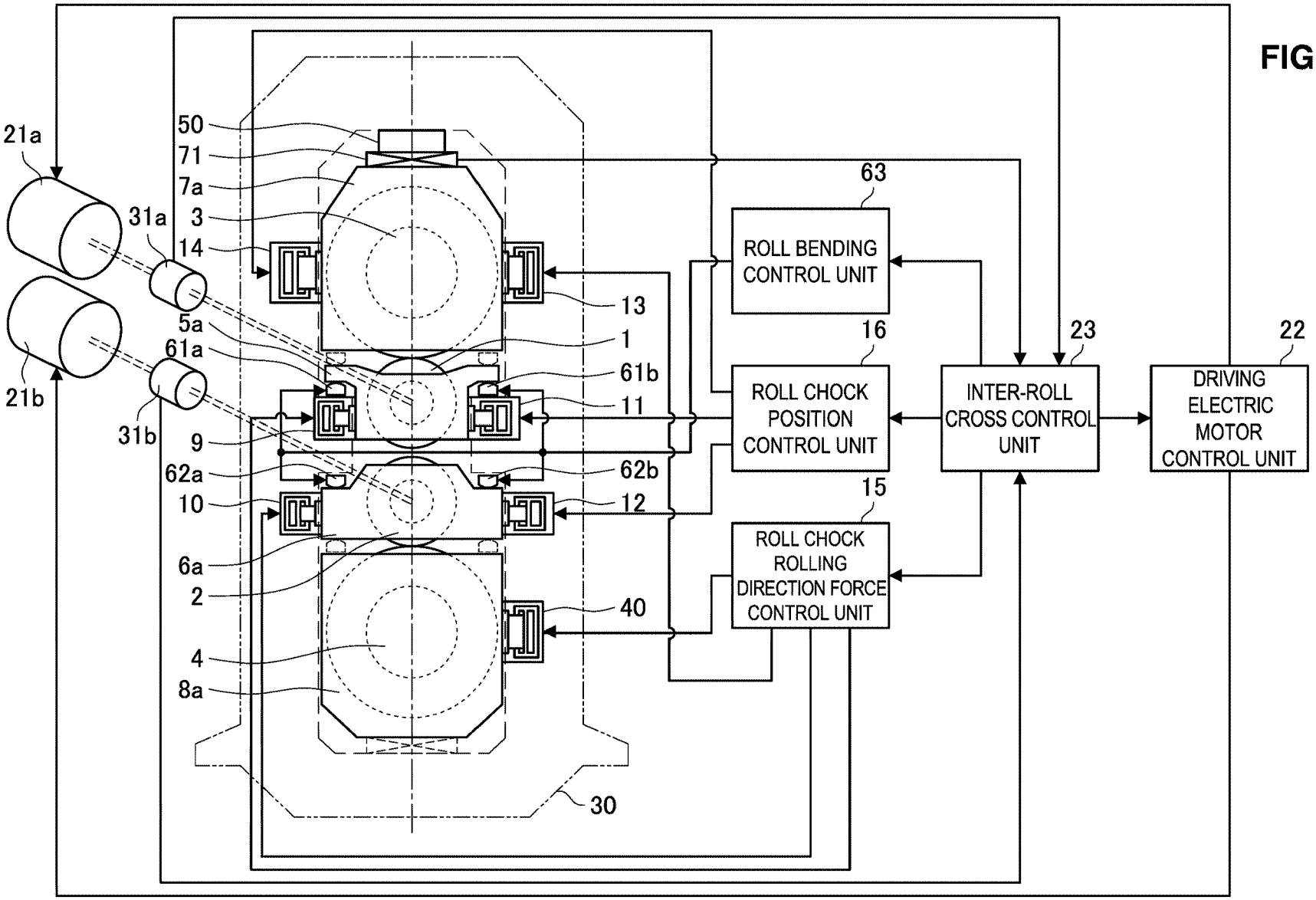
FIG. 2 is an explanatory drawing illustrating the configuration of a rolling mill according to a first embodiment of the present invention, and an apparatus for controlling the rolling mill.

The rolling mill illustrated in FIG. 2 is a rolling mill of four-high having a pair of work rolls 1 and 2 and a pair of backup rolls 3 and 4 that support the pair of work rolls 1 and 2. As illustrated in FIG. 1A, the upper work roll 1 is supported by the upper work roll chocks 5*a* and 5*b*, and the lower work roll 2 is supported by the lower work roll chocks 6*a* and 6*b*. Although only the upper work roll chock 5*a* and the lower work roll chock 6*a* on the work side are illustrated in FIG. 2, the upper work roll chock 5*b* and the lower work roll chock 6*b* are provided on the drive side that is on the side facing away from the viewer in FIG. 2, as illustrated in FIG. 1A.

The upper work roll 1 is rotationally driven by an upper driving electric motor 21*a*, and the lower work roll 2 is rotationally driven by a lower driving electric motor 21*b*. That is, the upper work roll 1 and the lower work roll 2 are configured to be independently rotatable. The upper driving electric motor 21*a* and the lower driving electric motor 21*b* are, for example, motors in which spindle torque measurement apparatuses 31*a* and 31*b* that measure the spindle torque of each motor are provided on the respective spindles thereof. The spindle torque measurement apparatuses 31*a* and 31*b* are, for example, load cells. An upper spindle torque measurement apparatus 31*a* that is provided on the upper driving electric motor 21*a* measures the spindle torque of the upper driving electric motor 21*a*, and outputs the measurement value to an inter-roll cross control unit 23 that is described later. Similarly, a lower spindle torque measurement apparatus 31*b* that is provided on the lower driving electric motor 21*b* measures the spindle torque of the lower driving electric motor 21*b*, and outputs the measurement value to the inter-roll cross control unit 23 that is described later.

The upper backup roll 3 is supported by the upper backup roll chocks 7*a* and 7*b*, and the lower backup roll 4 is supported by the lower backup roll chocks 8*a* and 8*b*. As illustrated in FIG. 1A, the upper backup roll chocks 7*a* and 7*b* and the lower backup roll chocks 8*a* and 8*b* are similarly provided on the side facing away from the viewer (drive side) in FIG. 2, and support the upper backup roll 3 and the lower backup roll 4, respectively. The upper work roll chocks 5*a* and 5*b*, the lower work roll chocks 6*a* and 6*b*, the upper backup roll chocks 7*a* and 7*b*, and the lower backup roll chocks 8*a* and 8*b* are retained by a housing 30.

The upper work roll chocks 5*a* and 5*b* are provided with an upper work roll chock pressing apparatus 9 which is provided on the entrance side in the rolling direction and which presses the upper work roll chocks 5*a* and 5*b* in the rolling direction, and an upper work roll chock driving apparatus 11 which is provided on the exit side in the rolling direction and which detects the position in the rolling direction and drives the upper work roll chocks 5*a* and 5*b* in the rolling direction. The upper work roll chock driving apparatus 11 is equipped with a position detecting apparatus that detects the position of the upper work roll chocks. Similarly, the lower work roll chocks 6*a* and 6*b* are provided with a lower work roll chock pressing apparatus 10 which is provided on the entrance side in the rolling direction and which presses the lower work roll chocks 6*a* and 6*b* in the rolling direction, and a lower work roll chock driving apparatus 12 which is provided on the exit side in the rolling direction and which detects the position in the rolling direction and drives the lower work roll chocks 6*a* and 6*b*. The lower work roll chock driving apparatus 12 is equipped with a position detecting apparatus that detects the position of the lower work roll chocks.

For example, a hydraulic cylinder is used as the upper work roll chock driving apparatus 11, the lower work roll chock driving apparatus 12, a drive mechanism of the upper work roll chock pressing apparatus 9 and a drive mechanism of the lower work roll chock pressing apparatus 10. Note that although the upper and lower work roll chock driving apparatuses 11 and 12 and the upper and lower work roll chock pressing apparatuses 9 and 10 are shown only on the work side in FIG. 2, these apparatuses are also similarly provided on the side facing away from the viewer (drive side) in FIG. 2.

The upper backup roll chocks 7*a* and 7*b* are provided with an upper backup roll chock pressing apparatus 13 which is provided on the exit side in the rolling direction and which presses the upper backup roll chocks 7*a* and 7*b* in the rolling direction, and an upper backup roll chock driving apparatus 14 which is provided on the entrance side in the rolling direction and which detects the position in the rolling direction and drives the upper backup roll chocks 7*a* and 7*b* in the rolling direction. The upper backup roll chock driving apparatus 14 is equipped with a position detecting apparatus that detects the position of the upper backup roll chocks. For example, a hydraulic cylinder is used as the upper backup roll chock driving apparatus 14 and the drive mechanism of the upper backup roll chock pressing apparatus 13. Note that although the upper backup roll chock driving apparatus 14 and the upper backup roll chock pressing apparatus 13 are shown only on the work side in FIG. 2, these apparatuses are also similarly provided on the side facing away from the viewer (drive side) in FIG. 2.

On the other hand, with respect to the lower backup roll chocks 8*a* and 8*b*, since the lower backup roll 4 is adopted as the reference roll in the present embodiment, the lower backup roll chocks 8*a* and 8*b* serve as reference backup roll chocks. Accordingly, since the lower backup roll chocks 8*a* and 8*b* are not driven to perform position adjustment, the lower backup roll chocks 8*a* and 8*b* do not necessarily need to be equipped with a driving apparatus and a position detecting apparatus as in the case of the upper backup roll chocks 7*a* and 7*b*. However, a configuration may be adopted in which, for example, a lower backup roll chock pressing apparatus 40 or the like is provided on the entrance side or the exit side in the rolling direction to suppress the occurrence of looseness of the lower backup roll chocks 8*a* and 8*b* so that the position of the reference backup roll chocks that serve as the reference for position adjustment does not change. Note that although the lower backup roll chock pressing apparatus 40 is shown only on the work side in FIG. 2, this apparatus is also similarly provided on the side facing away from the viewer (drive side) in FIG. 2.

A pressing-down device 50 is provided between the housing 30 and the upper backup roll chocks 7*a* and 7*b*, and adjusts the roll positions in the vertical direction. An upper vertical roll load measurement apparatus 71 that measures a vertical roll load applied to the upper backup roll chocks 7*a* and 7*b* is provided between the pressing-down device 50 and the upper backup roll chocks 7*a* and 7*b*. Note that although the pressing-down device 50 and the upper vertical roll load measurement apparatus 71 are shown only on the work side in FIG. 2, these are also similarly provided on the side facing away from the viewer (drive side) in FIG. 2. Further, although in the present embodiment a configuration is adopted in which a vertical roll load is measured by the upper vertical roll load measurement apparatus 71 that is installed on the upper side of the rolling mill, the present invention is not limited to this example, and a configuration may be adopted in which a vertical roll load is measured by a vertical roll load measurement apparatus installed on the lower side (that is, between the housing 30 and the lower backup roll chocks 8*a* and 8*b*) of the rolling mill.

The rolling mill according to the present embodiment includes an entrance-side upper increase bending apparatus 61*a* and an exit-side upper increase bending apparatus 61*b* on a project block between the upper work roll chocks 5*a* and 5*b* and the housing 30, and includes an entrance-side lower increase bending apparatus 62*a* and an exit-side lower increase bending apparatus 62*b* on a project block between the lower work roll chocks 6*a* and 6*b* and the housing 30. Further, although not illustrated in the drawing, on the side facing away from the viewer (drive side) in FIG. 2, an entrance-side upper increase bending apparatus 61*c*, an exit-side upper increase bending apparatus 61*d*, an entrance-side lower increase bending apparatus 62*c*, and an exit-side lower increase bending apparatus 62*d* for the drive side are similarly provided. The respective increase bending apparatuses impart an increase bending force to the work roll chocks to apply a load to the upper work roll 1 and the upper backup roll 3, and the lower work roll 2 and the lower backup roll 4. An apparatus that is used for bending the upper and lower work rolls to adjust the roll crown may generally be used as these increase bending apparatuses.

As apparatuses for controlling the rolling mill, for example, as illustrated in FIG. 2, the configuration includes a roll chock rolling direction force control unit 15, a roll chock position control unit 16, a driving electric motor control unit 22, the inter-roll cross control unit 23, and a roll bending control unit 63.

The roll chock rolling direction force control unit 15 controls a pressing force in the rolling direction of the upper work roll chock pressing apparatus 9, the lower work roll chock pressing apparatus 10, the upper backup roll chock pressing apparatus 13 and the lower backup roll chock pressing apparatus 40. Based on a control instruction of the inter-roll cross control unit 23 that is described later, the roll chock rolling direction force control unit 15 drives the upper work roll chock pressing apparatus 9, the lower work roll chock pressing apparatus 10, and the upper backup roll chock pressing apparatus 13, to produce a state in which it is possible to control the roll chock positions by applying a predetermined pressing force which corresponds to the roll chocks that are the control objects.

The roll chock position control unit 16 performs drive control of the upper work roll chock driving apparatus 11, the lower work roll chock driving apparatus 12, and the upper backup roll chock driving apparatus 14. Based on a control instruction of the inter-roll cross control unit 23, the roll chock position control unit 16 drives the upper work roll chock driving apparatus 11, the lower work roll chock driving apparatus 12 and the upper backup roll chock driving apparatus 14 so that a vertical roll load difference is within a predetermined range or so that the torque becomes minimal. The respective roll chock driving apparatuses 11, 12 and 14 are disposed on both the work side and the drive side, and with respect to the positions in the rolling direction on the work side and the drive side, by controlling the roll chock driving apparatuses 11, 12 and 14 so that the positions change by the same amount in opposite directions on the work side and the drive side, only a roll cross angle can be changed, without changing the average rolling direction position of the work side and drive side.

The driving electric motor control unit 22 controls the upper driving electric motor 21*a* that rotationally drives the upper work roll 1, and the lower driving electric motor 21*b* that rotationally drives the lower work roll 2. Based on an instruction from the inter-roll cross control unit 23, the driving electric motor control unit 22 according to the present embodiment drives the upper driving electric motor 21*a* and the lower driving electric motor 21*b* to control driving of the upper work roll 1 or the lower work roll 2.

The inter-roll cross control unit 23 controls the position of each of the upper work roll 1, the lower work roll 2, the upper backup roll 3 and the lower backup roll 4 constituting the rolling mill by adjusting the positions of the roll chocks, so that an inter-roll cross angle is zero. In the rolling mill according to the present embodiment, the positions of the roll chocks are adjusted based on the spindle torque of the upper driving electric motor 21*a* measured by the upper spindle torque measurement apparatus 31*a*, the spindle torque of the lower driving electric motor 21*b* measured by the lower spindle torque measurement apparatus 31*b*, and a difference between the vertical roll load on the work side and the vertical roll load of the drive side (hereunder, also referred to as "vertical roll load difference") measured by the upper vertical roll load measurement apparatus 71. Based on these measurement values, the inter-roll cross control unit 23 issues control instructions to the roll chock rolling direction force control unit 15, the roll chock position control unit 16 and the driving electric motor control unit 22 so that crossing that has occurred between rolls is eliminated. Note that the details of the method for setting the rolling mill are described later.

The roll bending control unit 63 is an apparatus that controls each of the increase bending apparatuses 61*a* to 61*d*, and 62*a* to 62*d*. The roll bending control unit 63 according to the present embodiment controls the increase bending apparatuses so as to impart an increase bending force to the work roll chocks, based on an instruction from the inter-roll cross control unit 23. Note that, the roll bending control unit 63 may also be used in a case other than a case of performing adjustment of inter-roll cross according to the present embodiment, for example, when performing crown control or shape control of a workpiece.

The configuration of the rolling mill according to the present embodiment has been described above. Note that, although in FIG. 2 an example has been described in which, with respect to the work roll chocks 5*a*, 5*b*, 6*a* and 6*b*, the roll chock driving apparatuses 11 and 12 are arranged on the exit side and the pressing apparatuses 9 and 10 are arranged on the entrance side of the rolling mill, and with respect to the backup roll chocks 7*a*, 7*b*, 8*a* and 8*b*, the roll chock driving apparatus 14 is arranged on the entrance side and the pressing apparatus 13 is arranged on the exit side of the rolling mill, the present invention is not limited to this example. For example, the arrangement of these apparatuses with respect to the entrance side and exit side of the rolling mill may be the reverse of the arrangement in the above example, or these apparatuses may be installed in the same direction with respect to the work rolls and the backup rolls. In addition, with regard to the roll chock driving apparatuses 11, 12 and 14, although an example has been described in which these apparatuses are provided on both the work side and the drive side and the respective apparatuses perform position control, the present invention is not limited to this example. These apparatuses may be provided on only one side among the work side and the drive side, or it is possible to adopt a configuration so that only the apparatuses provided on one side are actuated and to control a roll cross angle by performing position control by taking the opposite side thereto as the support point of rotation, and it is needless to say that the same effect of reducing inter-roll cross is obtained.

Furthermore, although an example has been described above in which a roll chock driving apparatus is provided on the work side and the drive side for all of the rolls except the reference roll, the present invention is not limited to this example. For example, all of the rolls may be provided with a roll chock driving apparatus, and the reference roll may be changed according to the situation, and control performed based on the changed reference roll. Alternatively, the roll chock driving apparatus may be provided on either one side among the work side and the drive side, with the opposite side being taken as a pivot, and the inter-roll cross angle may be similarly controlled by controlling only the roll chock positions on one side.

[2-2. Method for Setting Rolling Mill]

Figure 3A:
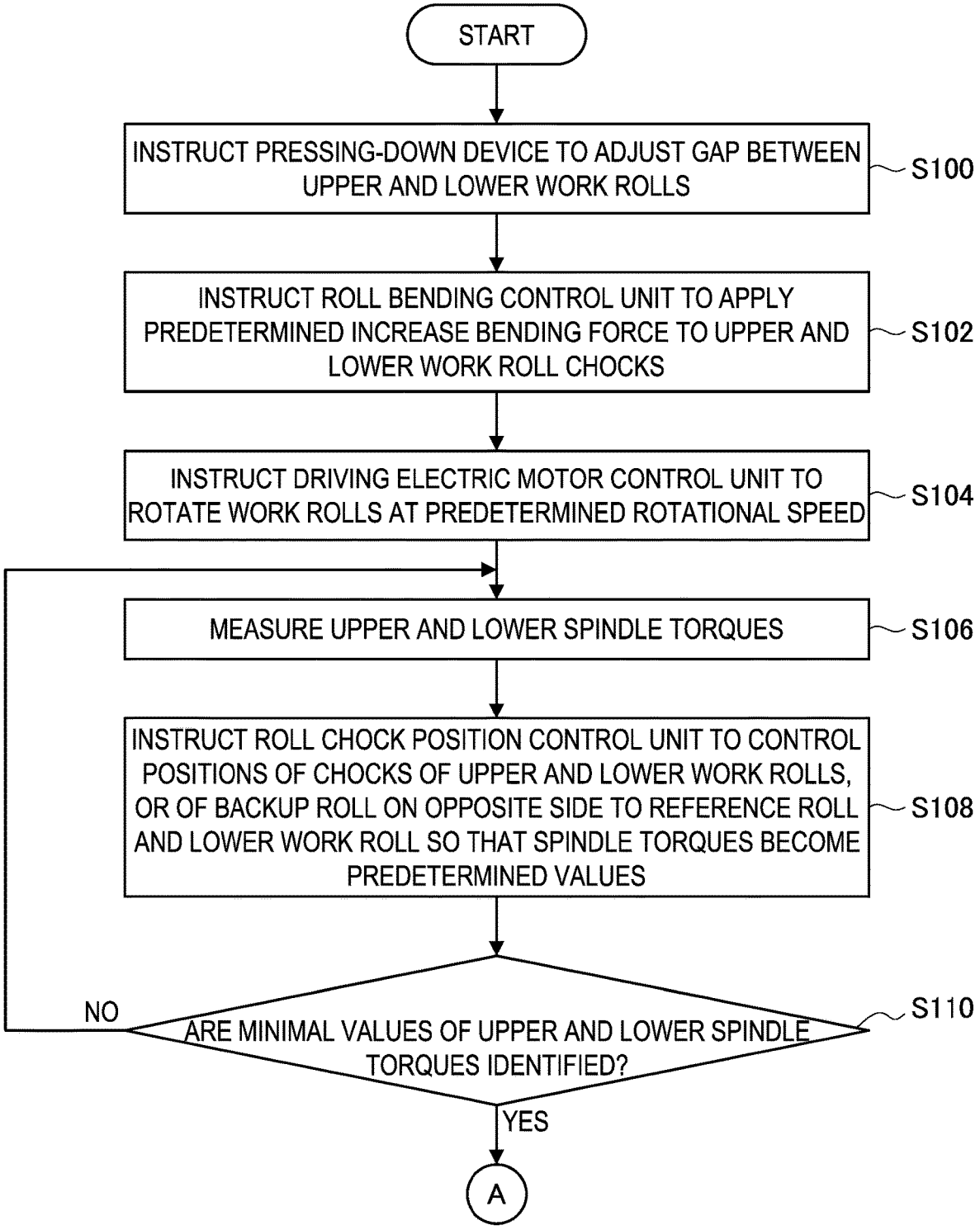
FIG. 3A is a flowchart that describes a method for setting a rolling mill according to the first embodiment.
Figure 3B:
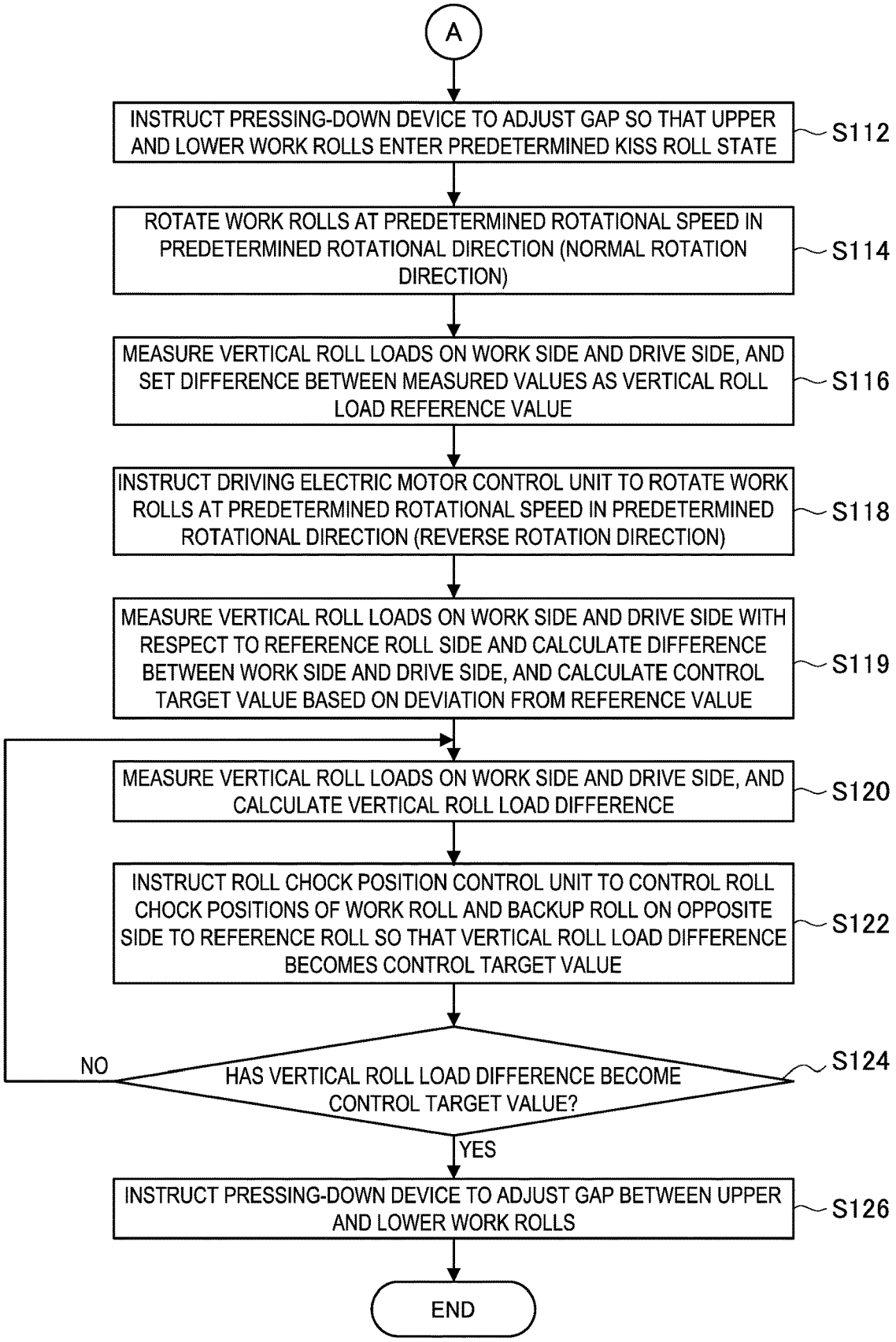
FIG. 3B is a flowchart that describes the method for setting a rolling mill according to the first embodiment.
Figure 4A:
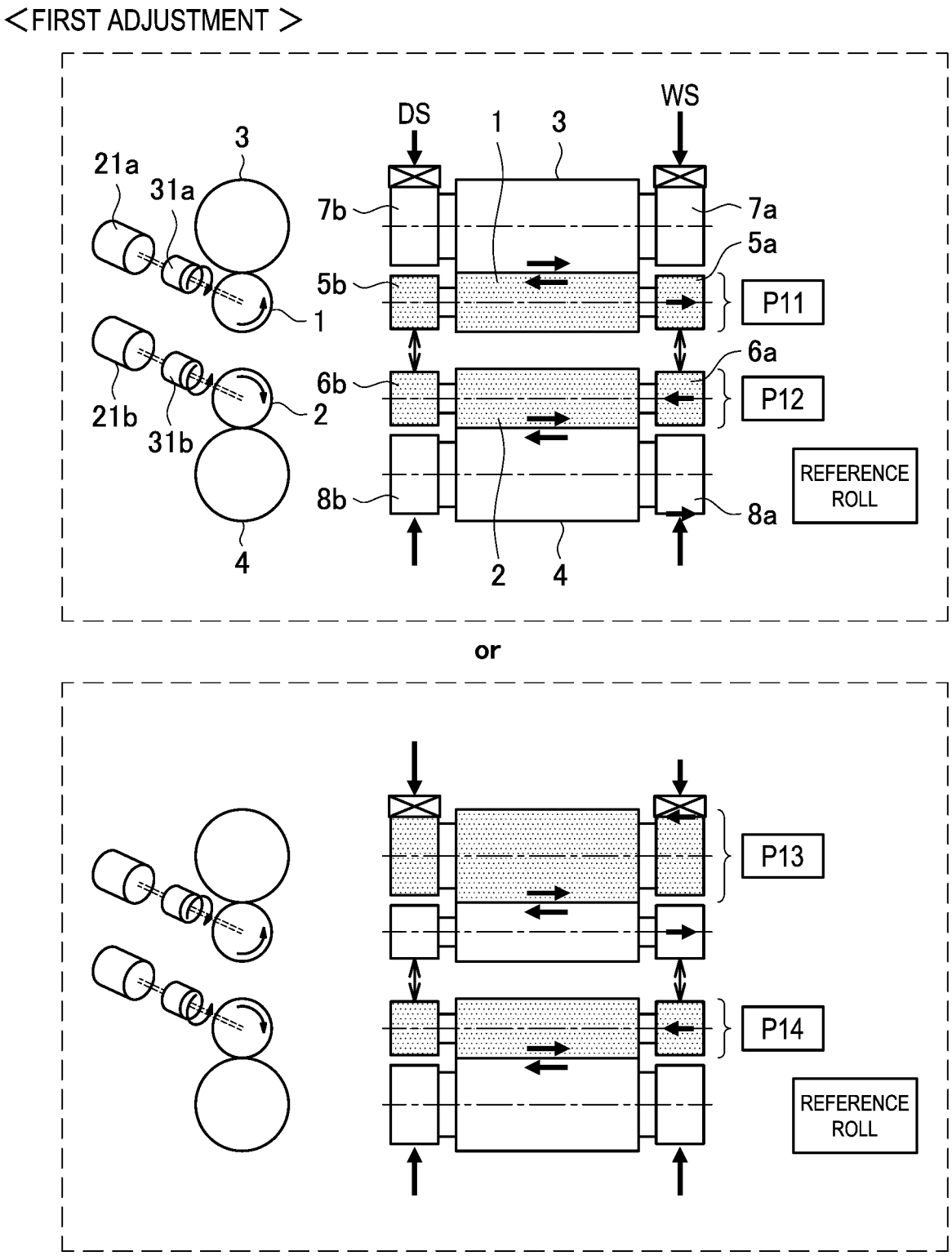
FIG. 4A is an explanatory drawing showing procedures for roll position adjustment in the method for setting a rolling mill illustrated in FIG. 3A and FIG. 3B, that shows a first adjustment.
Figure 4B:
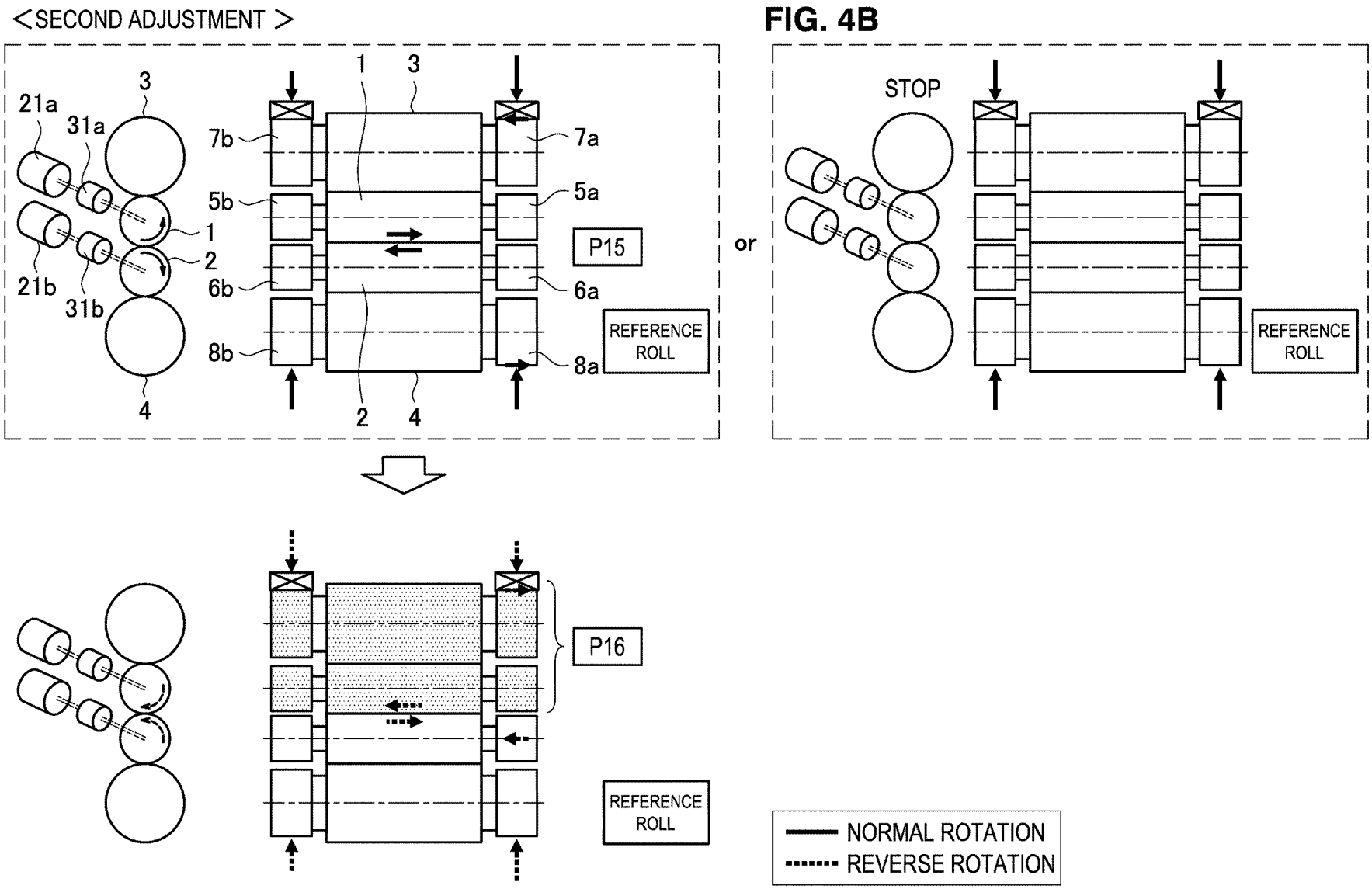
FIG. 4B is an explanatory drawing showing procedures for roll position adjustment in the method for setting a rolling mill illustrated in FIG. 3A and FIG. 3B, that shows a second adjustment.

The method for setting a rolling mill according to the present embodiment will now be described based on FIG. 3A to FIG. 4B. FIG. 3A and FIG. 3B are flowcharts for describing the method for setting a rolling mill according to the present embodiment. FIG. 4A and FIG. 4B are explanatory drawings showing procedures for roll position adjustment in the method for setting a rolling mill according to the present embodiment. Note that, a description of the distribution of a load that acts between rolls is omitted from FIG. 4A and FIG. 4B.

Although in the present example the lower backup roll 4 is described as the reference roll, there are also cases where the upper backup roll 3 serves as the reference roll. Note that, it suffices to set any one roll constituting the rolling mill as the reference roll, and it is preferable to adopt either the roll at the uppermost part or the roll at the lowermost part in the vertical direction as the reference roll. For example, in a case where the upper backup roll 3 is adopted as the reference roll, by similar procedures as described hereunder, it suffices to perform position adjustment of rolls in order from the roll assembly on the opposite side to the reference roll in a manner such that, first, position adjustment is performed between the roll (lower backup roll 4) that is furthest from the reference roll (upper backup roll 3) and the roll (lower work roll 2) that is second furthest from the reference roll, followed by position adjustment between the aforementioned two rolls and the roll (upper work roll 1) that is third furthest from the reference roll, and finally position adjustment between the aforementioned three rolls and the reference roll. Note that, in the present invention, the term "roll assembly" means a roll group that includes a plurality of rolls.

(First Adjustment: S100 to S110)

A first adjustment according to the present embodiment corresponds to the first process shown in FIG. 1B. In the first adjustment, as illustrated in FIG. 3A, first, the inter-roll cross control unit 23 causes the pressing-down device 50 to adjust the roll positions in the vertical direction so that the roll gap between the upper work roll 1 and the lower work roll 2 becomes an open state having a predetermined gap (S100). Based on the relevant instruction, the pressing-down device 50 sets the increase bending forces in a balanced state, and sets the roll gap between the work rolls 1 and 2 in an open state. Note that, as used herein, the term "balanced state" refers to a state in which a bending force of a degree that lifts up the self-weight of the work roll and roll chocks or the like is applied, and means that a load acting between the work roll and the backup roll is approximately zero.

Further, the inter-roll cross control unit 23 instructs the roll bending control unit 63 so as to apply a predetermined increase bending force from the balanced state to the work roll chocks 5*a*, 5*b* and 6 by means of the increase bending apparatuses 61*a* to 61*d* and 62*a* to 62*d* (S102). The roll bending control unit 63 controls the respective increase bending apparatuses 61*a* to 61*d* and 62*a* to 62*d* based on the instruction, to thereby apply a predetermined increase bending force to the work roll chocks 5*a*, 5*b* and 6. By this means, the roll gap between the work rolls is placed in an open state. Note that, either step among the step S100 and step S102 may be executed first.

Next, the inter-roll cross control unit 23 causes the driving electric motor control unit 22 to drive the upper driving electric motor 21*a* and the lower driving electric motor 21*b*. By the driving of the upper driving electric motor 21*a* and the lower driving electric motor 21*b*, the work rolls 1 and 2 rotate at a predetermined rotational speed (S104).

Next, position adjustment of the respective rolls is performed in a stepwise manner. At such time, the rolling direction position of the roll chocks of the reference roll is fixed as a reference position, and the positions in the rolling direction of the roll chocks of the rolls other than the reference roll are moved to thereby adjust the positions of the roll chocks.

Specifically, with respect to each of the upper roll assembly that is composed of the upper work roll 1 and the upper backup roll 3, and the lower roll assembly that is composed of the lower work roll 2 and the lower backup roll 4, the positions of roll chocks are adjusted so that the spindle torques measured by the spindle torque measurement apparatuses 31*a* and 31*b* become minimal values. This is based on the finding that, when the work rolls are in an open state, a cross angle between the work roll and the backup roll is zero and the spindle torque is a minimal value. Therefore, in the first adjustment, measurement of the spindle torques by the spindle torque measurement apparatuses 31*a* and 31*b* (S106) and driving of roll chock positions (S108) are repeatedly performed, and roll chock positions at which the spindle torque is minimal are identified for each of the upper roll assembly and the lower roll assembly (S110).

The roll chocks of rolls other than the reference roll are the object of the driving of roll chock positions in step S108. That is, with regard to the upper roll assembly, as illustrated on the upper side in FIG. 4A, the positions of the upper work roll chocks 5*a* and 5*b* may be changed and the spindle torque is measured (P11), and as illustrated on the lower side in FIG. 4A, the positions of the upper backup roll chocks may be changed and the spindle torque is measured (P13). On the other hand, with regard to the lower roll assembly, since the lower backup roll 4 is the reference roll, the lower backup roll chocks 8*a* and 8*b* are not moved, and as illustrated on the upper side and lower side in FIG. 4A, the positions of the lower work roll chocks 6*a* and 6*b* may be changed and the spindle torque is measured (P12, P14). Upon identifying the roll chock positions at the time that the spindle torque becomes minimal by means of the results of measuring the spindle torque obtained by the spindle torque measurement apparatuses 31*a* and 31*b*, the inter-roll cross control unit 23 ends the first adjustment.

(Second Adjustment: S112 to S126)

Next, as illustrated in FIG. 3B and FIG. 4B, as a second adjustment, the inter-roll cross control unit 23 adjusts the inter-roll cross between the upper roll assembly and the lower roll assembly. The second adjustment according to the present embodiment corresponds to the second process shown in FIG. 1B. First, the inter-roll cross control unit 23 causes the pressing-down device 50 to adjust roll positions in the vertical direction so that the upper work roll 1 and the lower work roll 2 enter a predetermined kiss roll state (S112). The pressing-down device 50 applies a predetermined load to the rolls based on the relevant instruction to thereby cause the work rolls 1 and 2 to come in contact and enter a kiss roll state.

Next, the inter-roll cross control unit 23 drives the driving electric motors 21*a* and 21*b* by means of the driving electric motor control unit 22, to thereby cause the upper work roll 1 and the lower work roll 2 to rotate in a predetermined rotational direction at a predetermined rotational speed (S114; P15 in FIG. 4B). It will be assumed here that the rotation of the upper work roll 1 and the lower work roll 2 in step S114 is normal rotation. The vertical roll loads on the work side and the drive side during the normal rotation are then measured by the upper vertical roll load measurement apparatus 71 and are input to the inter-roll cross control unit 23, and the inter-roll cross control unit 23 calculates a difference between the vertical roll load on the work side and the vertical roll load on the drive side and sets the calculated difference as a reference value of the vertical roll load difference (S116).

Note that, the reference value of the vertical roll load difference that is set in step S116 need not be a value for a time that the work rolls rotate in the normal direction, and for example as illustrated on the upper right side in FIG. 4B, may be set based on vertical roll loads on the work side and the drive side that are measured in a state in which the upper work roll 1 and the lower work roll 2 are stopped. In this case, the processing in step S114 is omitted, and the processing in step S116 is executed in a state in which the upper work roll 1 and the lower work roll 2 are stopped.

Upon the reference value of the vertical roll load difference being set in step S116, the inter-roll cross control unit 23 controls driving of the driving electric motors 21*a* and 21*b* by the driving electric motor control unit 22 to cause the upper work roll 1 and the lower work roll 2 to rotate in the opposite rotational direction to the rotational direction in step S114 at a predetermined rotational speed (S118; P16 in FIG. 4B). It will be assumed here that the rotation of the upper work roll 1 and the lower work roll 2 in step S118 is reverse rotation.

Upon the vertical roll loads on the work side and the drive side during reverse rotation that were measured by the upper vertical roll load measurement apparatus 71 being input to the inter-roll cross control unit 23, the inter-roll cross control unit 23 calculates a vertical roll load difference by calculating the difference between the vertical roll load on the work side and the vertical roll load on the drive side. The inter-roll cross control unit 23 then calculates a control target value based on a deviation between the calculated vertical roll load difference and the reference value that was calculated in step S116 (S119). The control target value may also be, for example, a value that is one-half of the deviation from the reference value, by utilizing the characteristic that absolute values of vertical roll load differences caused by inter-roll thrust forces during normal rotation and during reverse rotation are approximately the same.

Further, upon the vertical roll load difference during reverse rotation of the work rolls being calculated by the inter-roll cross control unit 23 (S120), the inter-roll cross control unit 23 controls the positions of the roll chocks of the work roll and the backup roll on the opposite side to the reference roll so that the vertical roll load difference becomes the control target value that was set in step S116 (S122). In the example illustrated in FIG. 4B, since the lower backup roll 4 is the reference roll, the positions of the upper work roll chocks 5*a* and 5*b* and the upper backup roll chocks 7*a* and 7*b* are controlled. At such time, because adjustment of the cross angle of the upper roll assembly has already been completed, the positions of the upper work roll chocks 5*a* and 5*b* and the upper backup roll chocks 7*a* and 7*b* are adjusted in a manner so that the upper work roll 1 and the upper backup roll 3 move simultaneously and in the same direction while maintaining the relative positions between the upper work roll chocks 5*a* and 5*b* and the upper backup roll chocks 7*a* and 7*b*.

The processing in steps S120 to S124 is repeatedly executed until it is determined in step S124 that the vertical roll load difference has become the control target value. Note that, the vertical roll load difference need not perfectly match the control target value, and the inter-roll cross control unit 23 may be configured to determine that the vertical roll load difference has become the control target value as long as the difference between these values is within an allowable range. When it is determined that the vertical roll load difference has become the control target value, the inter-roll cross control unit 23 causes the pressing-down device 50 to adjust the roll positions so that the roll gap between the upper work roll 1 and the lower work roll 2 becomes a predetermined size (S126). Thereafter, rolling of a workpiece by the rolling mill is started.

A rolling apparatus and a method for setting a rolling mill according to the first embodiment of the present invention are described above. According to the present embodiment, utilizing the characteristic that the spindle torque changes accompanying a change in a cross angle, in the first adjustment the cross angles between the work rolls and backup rolls of the upper roll assembly and the lower roll assembly are adjusted based on the spindle torque of the upper work roll and the lower work roll. In the second adjustment, the work rolls are set in a kiss roll state, and the cross angle between the upper work roll and the lower work roll is adjusted based on a vertical roll load difference. In the kiss roll state, because a tangential force that depends on the roll profiles exerts an influence between the upper work roll and the lower work roll, the vertical roll load difference is used, and not the spindle torque. By setting the rolling mill in this way, a thrust force generated between rolls due to the inter-roll cross angle can be reduced, and the occurrence of zigzagging and camber of a workpiece during rolling can be suppressed.

Note that, although it is described in the above that, in the first adjustment, roll chock positions are adjusted based on the spindle torque of the upper work roll and the lower work roll, the present invention is not limited to this example, and for example the rolling mill can also be similarly set using the motor torque of the driving electric motors 21*a* and 21*b*. The motor torque is proportional to the electric current values of the driving electric motors 21*a* and 21*b*, and therefore the roll chock positions can be adjusted based on the electric current values of the driving electric motors 21*a* and 21*b* as values of the motor torque.

Further, in the foregoing example, although in the first adjustment the roll chock positions of the upper work roll and the lower work roll are adjusted based on the torque, it suffices to adjust roll chock positions based on the torque with respect to at least the roll assembly on the side on which the vertical roll load measurement apparatus is not installed. With regard to the roll assembly on the side on which the vertical roll load measurement apparatus is installed, the positions of the roll chocks may be adjusted so that the vertical roll load difference is within a predetermined allowable range. In this case, the predetermined allowable range may be, for example, a range that is less than or equal to a control target value of a vertical roll load difference that is calculated based on a reference value determined in a rotational state of the rolls that is opposite to a state when adjusting the positions of the roll chocks or in a state in which the rolls are stopped. Note that, the predetermined allowable range need not perfectly match a range determined in this manner, and there may be a certain amount of difference therebetween.

3. Second Embodiment

Next, the configuration of a rolling mill and an apparatus for controlling the rolling mill, as well as a method for setting the rolling mill according to a second embodiment of the present invention will be described based on FIG. 5 to FIG. 7C. The rolling mill according to the second embodiment is a so-called "single drive mill" in which the upper work roll 1 and the lower work roll 2 are driven by one driving electric motor 21 through a pinion stand (not illustrated in the drawings) or the like. Therefore, in the case of adjusting roll chock positions based on the motor torque, only one roll assembly among the upper roll assembly and the lower roll assembly can be adjusted. Hereunder, the configuration of the rolling mill as well as a method for setting the rolling mill according to the present embodiment are described in detail.

[3-1. Configuration of Rolling Mill]

Figure 5:
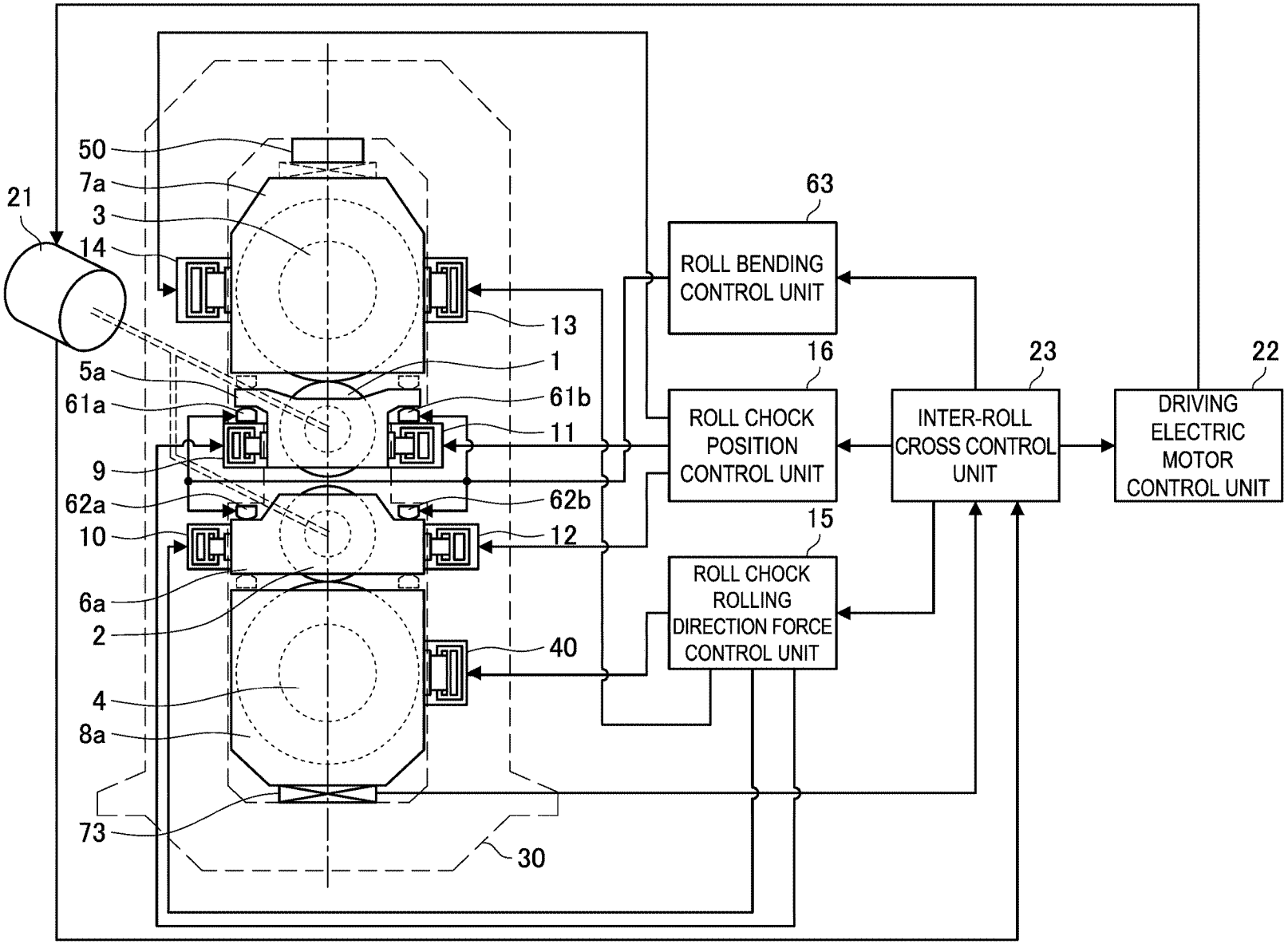
FIG. 5 is an explanatory drawing illustrating the configuration of a rolling mill according to a second embodiment of the present invention, and an apparatus for controlling the rolling mill.

First, the rolling mill according to the present embodiment and an apparatus for controlling the rolling mill will be described based on FIG. 5. FIG. 5 is an explanatory drawing illustrating the configuration of the rolling mill according to the present embodiment and an apparatus for controlling the rolling mill. The rolling mill illustrated in FIG. 5 is shown in a state as seen from the work side in the axial direction of the rolls, and in FIG. 5 a configuration in a case where the lower backup roll is adopted as the reference roll is illustrated.

The rolling mill according to the present embodiment illustrated in FIG. 5 is a four-high rolling mill having a pair of work rolls 1 and 2 and a pair of backup rolls 3 and 4 which support the pair of work rolls 1 and 2. The configuration of the rolling mill according to the present embodiment differs from the configuration of the rolling mill of the first embodiment illustrated in FIG. 2 in the following points: the upper work roll 1 and the lower work roll 2 are driven by one driving electric motor 21 through a pinion stand or the like; the rolling mill is not equipped with a spindle torque measurement apparatus; and a lower vertical roll load measurement apparatus 73 is installed on the lower side of the rolling mill instead of the upper vertical roll load measurement apparatus 71. The remaining configuration is the same as the configuration of the rolling mill of the first embodiment illustrated in FIG. 2, and therefore a description thereof is omitted in the present embodiment.

The driving electric motor 21 is a driving apparatus that simultaneously rotates the upper work roll 1 and the lower work roll 2. The driving electric motor 21 is, for example, a motor. In the present embodiment, the motor torque of the driving electric motor 21 is used as a detection terminal. Specifically, the electric current value of the driving electric motor 21 that is in a proportional relationship with the motor torque may be output as the motor torque to the inter-roll cross control unit 23.

The lower vertical roll load measurement apparatus 73 is provided on the lower side of the rolling mill (that is, between the housing 30 and the lower backup roll chocks 8*a* and 8*b*), and measures a vertical roll load applied to the lower backup roll chocks 8*a* and 8*b*. A vertical roll load that is measured by the lower vertical roll load measurement apparatus 73 is output to the inter-roll cross control unit 23. Note that, although the lower vertical roll load measurement apparatus 73 is only shown on the work side in FIG. 5, the lower vertical roll load measurement apparatus 73 is also similarly provided on the side facing away from the viewer (drive side) in FIG. 5. Further, although in the present embodiment a configuration is adopted in which a vertical roll load is measured by the lower vertical roll load measurement apparatus 73 that is installed on the lower side of the rolling mill, the present invention is not limited to this example, and similarly to the first embodiment, a configuration may be adopted in which a vertical roll load is measured by a vertical roll load measurement apparatus installed on the upper side (that is, between the pressing-down device 50 and the upper backup roll chocks 7*a* and 7*b*) of the rolling mill.

[3-2. Method for Setting Rolling Mill]

Figure 6A:
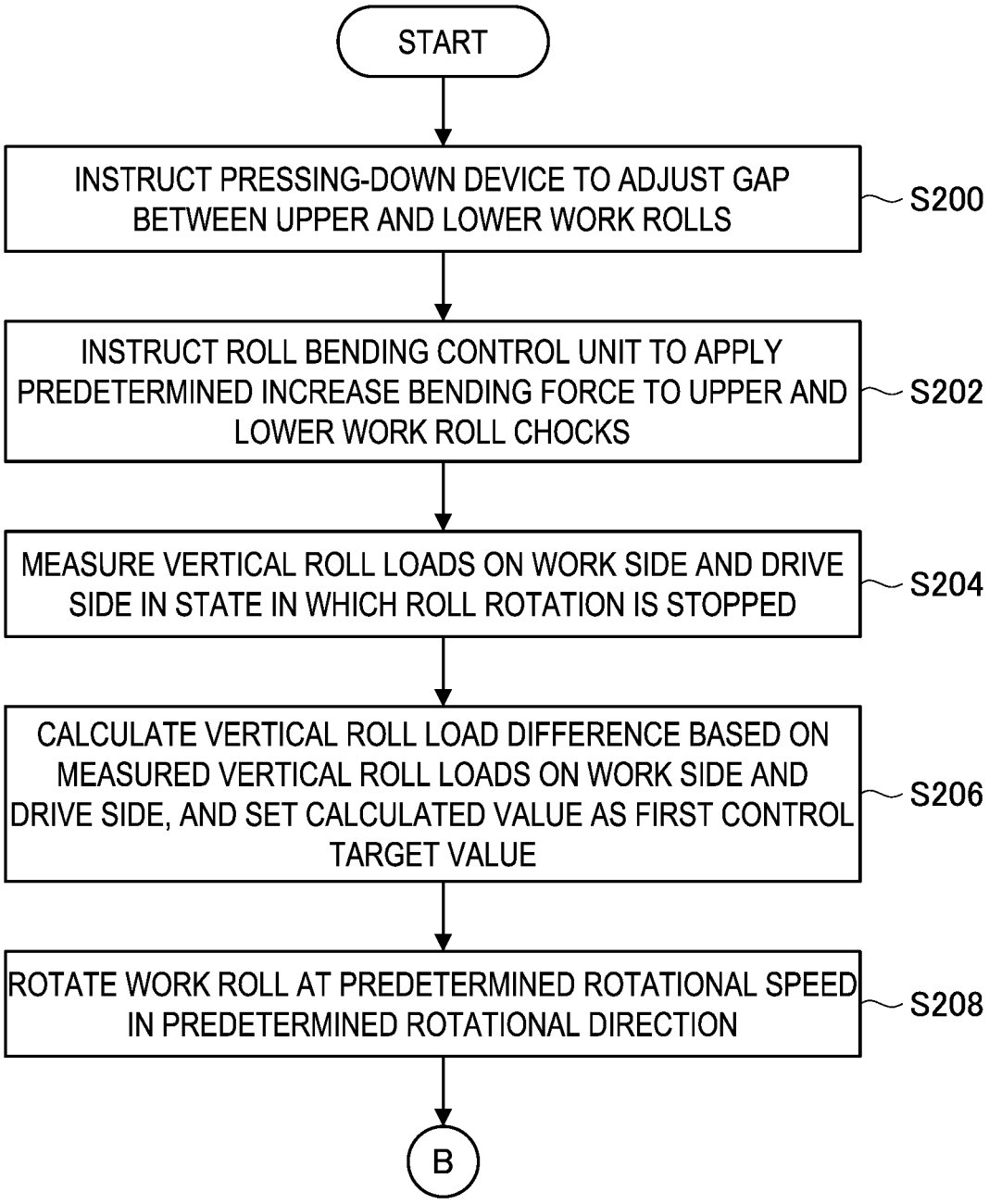
FIG. 6A is a flowchart that describes a method for setting a rolling mill according to the second embodiment.
Figure 6B:
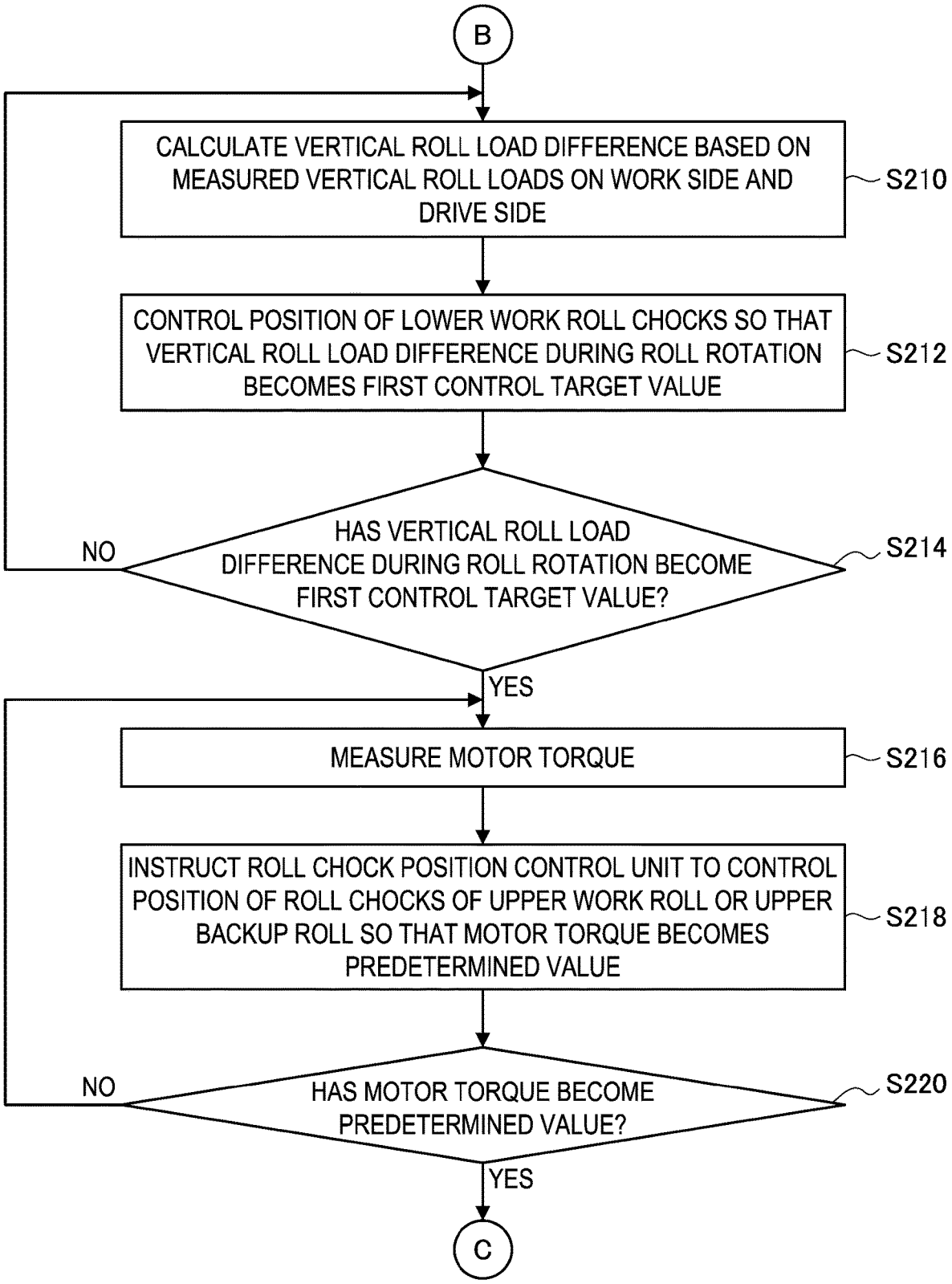
FIG. 6B is a flowchart that describes the method for setting a rolling mill according to the second embodiment.
Figure 6C:
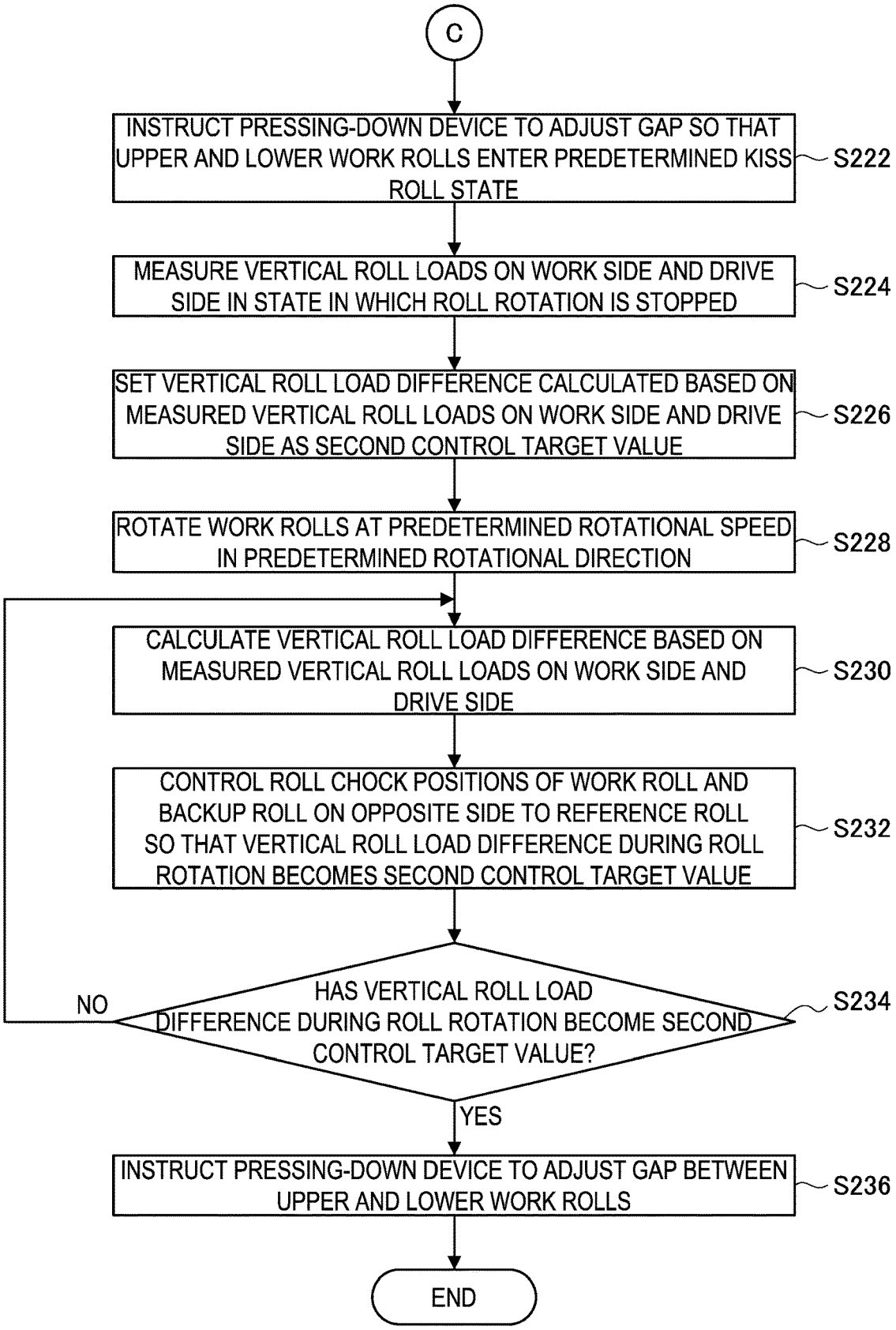
FIG. 6C is a flowchart that describes the method for setting a rolling mill according to the second embodiment.
Figure 7A:
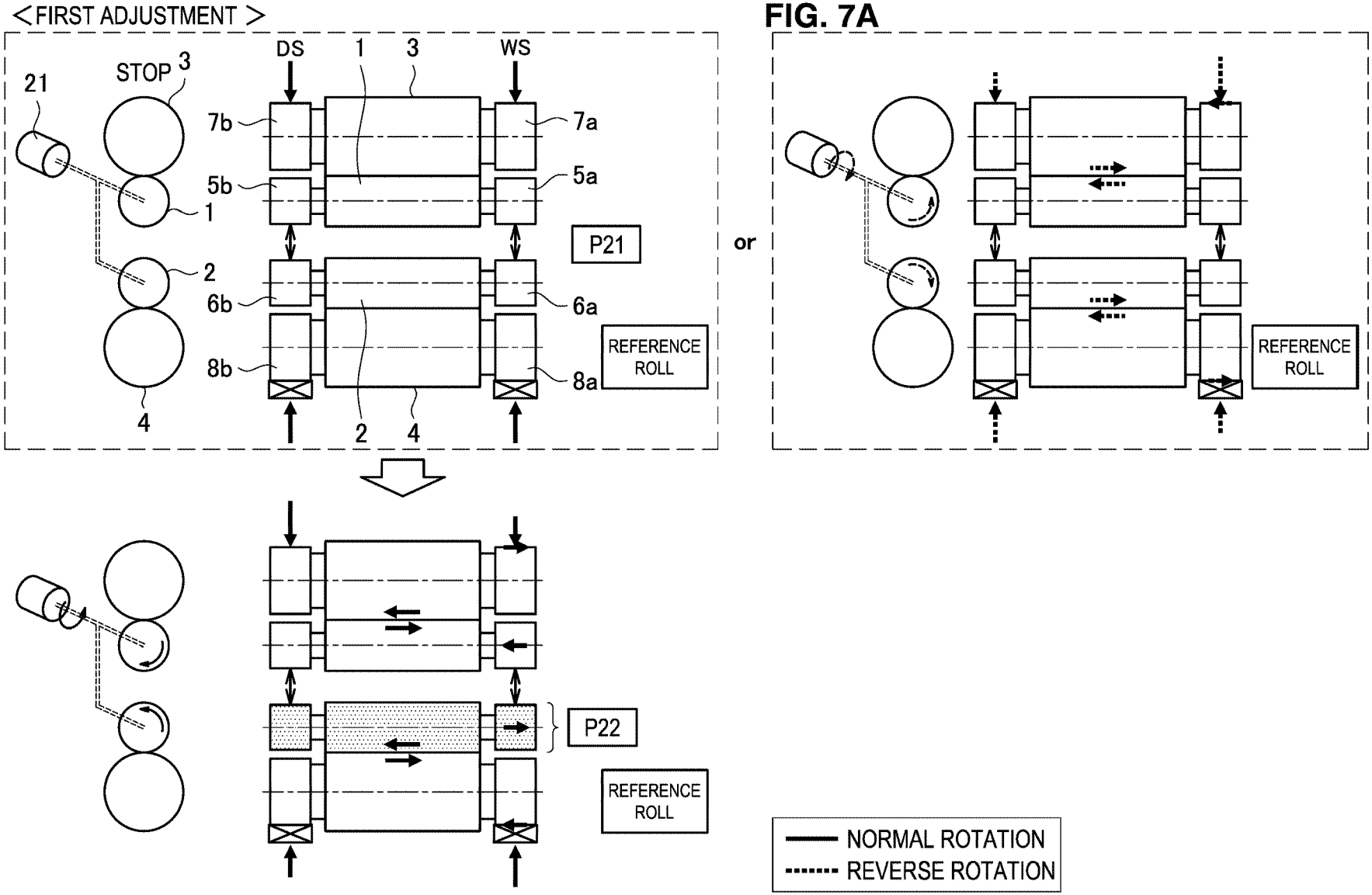
FIG. 7A is an explanatory drawing showing procedures for roll position adjustment in the method for setting a rolling mill illustrated in FIG. 6A to FIG. 6C, that shows a first adjustment.
Figure 7B:
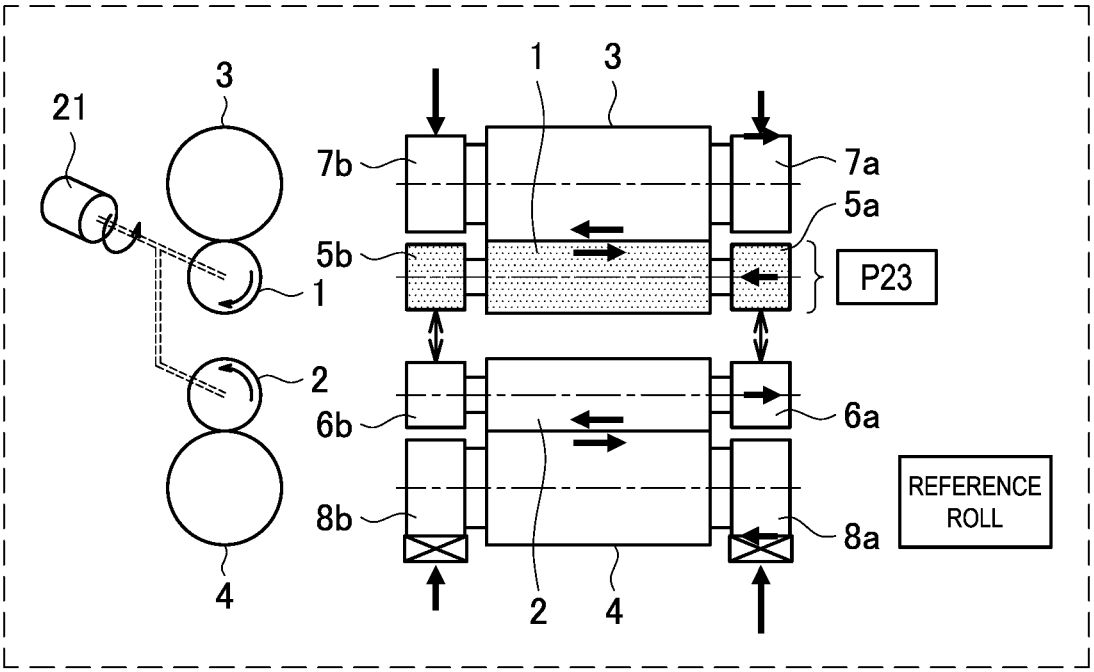
FIG. 7B is an explanatory drawing showing procedures for roll position adjustment in the method for setting a rolling mill illustrated in FIG. 6A to FIG. 6C, that shows a second adjustment.
Figure 7B:
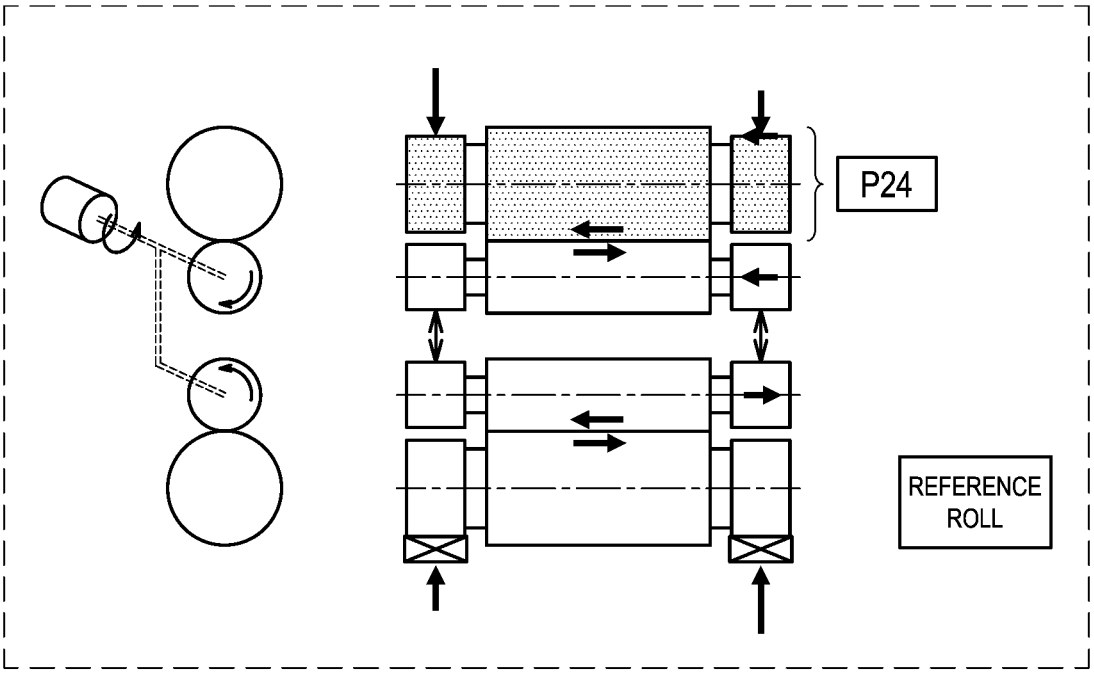
Figure 7C:
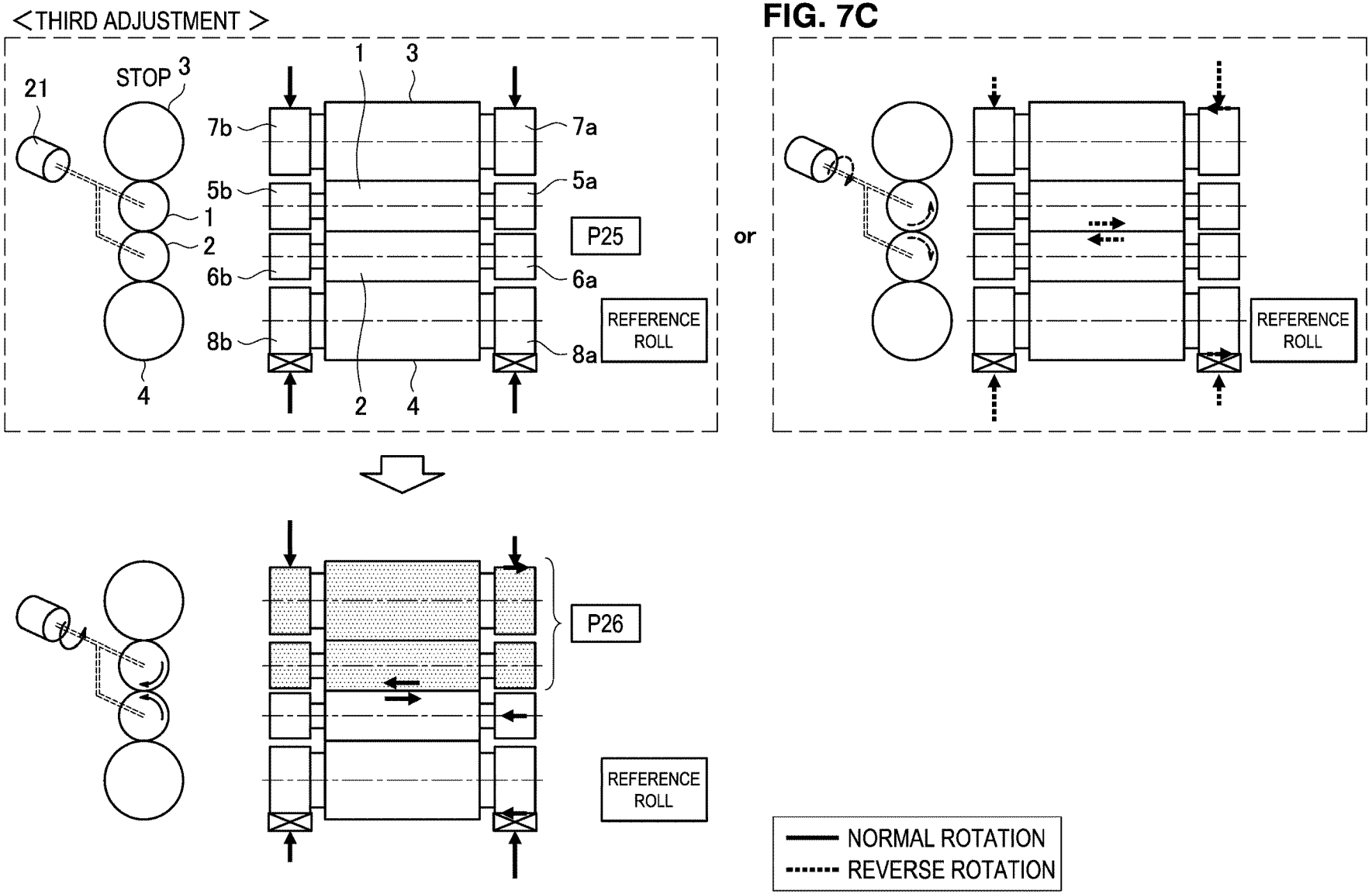
FIG. 7C is an explanatory drawing showing procedures for roll position adjustment in the method for setting a rolling mill illustrated in FIG. 6A to FIG. 6C, that shows a third adjustment.

Next, a method for setting a rolling mill according to the present embodiment will be described based on FIG. 6A to FIG. 7C. FIG. 6A to FIG. 6C are flowcharts illustrating the method for setting a rolling mill according to the present embodiment. FIG. 7A to FIG. 7C are explanatory drawings showing procedures for roll position adjustment in the method for setting a rolling mill illustrated in FIG. 6A to FIG. 6C. Note that, a description of the distribution of a load that acts between rolls is omitted from FIG. 7A to FIG. 7C. Further, although the lower backup roll 4 is described as the reference roll in the following description, it suffices that the reference roll is the roll located at either the uppermost part or the lowermost part in the vertical direction, and there are also cases where the upper backup roll 3 serves as the reference roll. In such a case also, position adjustment of rolls can be performed by the same procedures as described hereunder.

In the present embodiment, a first adjustment of steps S200 to S214 and a second adjustment of steps S216 to S220 are performed as a first process that is performed when the roll gap illustrated in FIG. 1B has been set in an open state. Further, a third adjustment of steps S222 to S236 is performed as a second process that is performed when the rolls are set in the kiss roll state illustrated in FIG. 1B.

(First Adjustment: S200 to S214)

First, in the first adjustment, adjustment of roll chock positions of the lower roll assembly in which the lower vertical roll load measurement apparatus 73 is provided is performed. As illustrated in FIG. 6A and FIG. 7A, first, the inter-roll cross control unit 23 causes the pressing-down device 50 to adjust the roll positions in the vertical direction so that the roll gap between the upper work roll 1 and the lower work roll 2 enters an open state having a predetermined gap (S200). Based on the relevant instruction, the pressing-down device 50 sets the increase bending forces in a balanced state, and sets the roll gap between the work rolls 1 and 2 in an open state.

Further, the inter-roll cross control unit 23 instructs the roll bending control unit 63 so as to apply a predetermined increase bending force from the balanced state to the work roll chocks 5*a*, 5*b* and 6 by means of the increase bending apparatuses 61*a* to 61*d* and 62*a* to 62*d* (S202). The roll bending control unit 63 controls the respective increase bending apparatuses 61*a* to 61*d* and 62*a* to 62*d* based on the instruction, to thereby apply a predetermined increase bending force to the work roll chocks 5*a*, 5*b* and 6. By this means, the roll gap between the work rolls is placed in an open state. Note that, either step among the step S200 and step S202 may be executed first.

Next, in a state in which the upper work roll 1 and the lower work roll 2 are stopped, the vertical roll load on the work side and the vertical roll load on the drive side are measured by the lower vertical roll load measurement apparatus 73 (S204). The inter-roll cross control unit 23 then calculates the difference between the vertical roll load on the work side and the vertical roll load on the drive side that were measured in step S204, and sets the calculated difference as a first control target value (S206; P21 in FIG. 7A). Upon the first control target value being set in step S206, the inter-roll cross control unit 23 controls driving of the driving electric motor 21 by the driving electric motor control unit 22 to cause the lower work roll 2 to rotate in a predetermined rotational direction at a predetermined rotational speed (S208). It will be assumed here that the rotation of the lower work roll 2 in step S208 is normal rotation. Next, as shown in FIG. 6B, the vertical roll loads on the work side and the drive side during rotation of the lower work roll are measured by the lower vertical roll load measurement apparatus 73, and the measured values are input to the inter-roll cross control unit 23, whereupon the inter-roll cross control unit 23 calculates the difference between the vertical roll load on the work side and the vertical roll load on the drive side to thereby calculate a vertical roll load difference (S210).

Upon the vertical roll load difference during rotation of the lower work roll being calculated in step S210, the inter-roll cross control unit 23 controls the position of the roll chocks of the lower work roll 2 so that the vertical roll load difference becomes the first control target value that was set in step S206 (S212; P22 in FIG. 7A). In the example illustrated in FIG. 7A, because the lower backup roll 4 is the reference roll, the positions of the lower backup roll chocks 8*a* and 8*b* are fixed. Therefore, the inter-roll cross control unit 23 controls the positions of the lower work roll chocks 6*a* and 6*b* to adjust the positions so that the vertical roll load difference during rotation of the lower work roll becomes the first control target value (S214). The processing in steps S210 to S214 is repeatedly executed until it is determined in step S214 that the vertical roll load difference has become the first control target value. Note that, the vertical roll load difference need not perfectly match the first control target value, and the inter-roll cross control unit 23 may be configured to determine that the vertical roll load difference has become the first control target value as long as a difference between these values is within an allowable range.

The first control target value that is set in step S206 need not be a value obtained at a time when the work rolls are in a stopped state, and as illustrated on the upper right side in FIG. 7A, for example, the first control target value may be set based on vertical roll loads on the work side and the drive side that are measured in a state in which the lower work roll 2 is rotating in the reverse direction to the rotational direction in step S208.

(Second Adjustment: S216 to S220)

Next, in the second adjustment, adjustment of roll chock positions of the upper roll assembly in which a vertical roll load measurement apparatus is not provided is performed. As illustrated in FIG. 6B and FIG. 7B, in the second adjustment, measurement of the motor torque of the driving electric motor 21 (S216), and driving of roll chock positions (S218) is repeatedly executed, and roll chock positions at which the motor torque is minimal are identified (S220).

Since it suffices that the driving of roll chock positions in step S218 is performed with respect to the roll chocks of rolls other than the reference roll, with regard to the upper roll assembly, as illustrated on the upper side in FIG. 7B, the positions of the upper work roll chocks 5*a* and 5*b* may be changed and the motor torque is measured (P23), or as illustrated on the lower side in FIG. 7B, the positions of the upper backup roll chocks may be changed and the motor torque is measured (P24). Upon identifying the roll chock positions at the time that the motor torque becomes minimal by means of the results of measuring the motor torque, the inter-roll cross control unit 23 ends the second adjustment.

(Third Adjustment: S222 to S236)

Next, as illustrated in FIG. 6C and FIG. 7C, as a third adjustment, the inter-roll cross control unit 23 adjusts an inter-roll cross between the upper roll assembly and the lower roll assembly. First, the inter-roll cross control unit 23 causes the pressing-down device 50 to adjust roll positions in the vertical direction so that the upper work roll 1 and the lower work roll 2 enter a predetermined kiss roll state (S222). The pressing-down device 50 applies a predetermined load to the rolls based on the relevant instruction to thereby cause the work rolls 1 and 2 to come in contact and enter a kiss roll state.

Next, in a state in which the upper work roll 1 and the lower work roll 2 are stopped, the inter-roll cross control unit 23 measures the vertical roll load on the work side and the vertical roll load on the drive side by means of the lower vertical roll load measurement apparatus 73 (S224). The inter-roll cross control unit 23 then calculates the difference between the vertical roll load on the work side and the vertical roll load on the drive side that were measured in step S224, and sets the calculated difference as a second control target value (S226; P25 in FIG. 7C). Upon the second control target value being set in step S226, the inter-roll cross control unit 23 controls driving of the driving electric motor 21 by the driving electric motor control unit 22 to cause the upper work roll 1 and the lower work roll 2 to rotate in a predetermined rotational direction at a predetermined rotational speed (S228). It will be assumed here that the rotation of the work rolls 1 and 2 in step S228 is normal rotation. Next, the vertical roll loads on the work side and the drive side during rotation of the work rolls are measured by the lower vertical roll load measurement apparatus 73, and the measured values are input to the inter-roll cross control unit 23, whereupon the inter-roll cross control unit 23 calculates the difference between the vertical roll load on the work side and the vertical roll load on the drive side to thereby calculate a vertical roll load difference (S230).

Upon the vertical roll load difference during rotation of the work rolls being calculated in step S230, the inter-roll cross control unit 23 controls the positions of the roll chocks of the work roll and the backup roll on the opposite side to the reference roll so that the vertical roll load difference becomes the second control target value that was set in step S226 (S232; P26 in FIG. 7C). In the example illustrated in FIG. 7C, since the lower backup roll 4 is the reference roll, the positions of the upper work roll chocks 5*a* and 5*b* and the upper backup roll chocks 7*a* and 7*b* are controlled. At such time, because adjustment of the cross angle of the upper roll assembly has already been completed by the second adjustment, the positions of the upper work roll chocks 5*a* and 5*b* and the upper backup roll chocks 7*a* and 7*b* are adjusted in a manner so that the upper work roll 1 and the upper backup roll 3 move simultaneously and in the same direction while maintaining the relative positions between the upper work roll chocks 5*a* and 5*b* and the upper backup roll chocks 7*a* and 7*b*.

The processing in steps S230 to S234 is repeatedly executed until it is determined in step S234 that the vertical roll load difference has become the second control target value. Note that, the vertical roll load difference need not perfectly match the second control target value, and the inter-roll cross control unit 23 may be configured to determine that the vertical roll load difference has become the second control target value as long as a difference between these values is within an allowable range. When it is determined that the vertical roll load difference has become the second control target value, the inter-roll cross control unit 23 causes the pressing-down device 50 to adjust the roll positions so that the roll gap between the upper work roll 1 and the lower work roll 2 becomes a predetermined size (S236). Thereafter, rolling of a workpiece by the rolling mill is started.

The second control target value that is set in step S226 need not be a value obtained at a time when the work rolls are in a stopped state, and as illustrated on the upper right side in FIG. 7C, for example, the second control target value may be set based on vertical roll loads on the work side and the drive side that are measured in a state in which the lower work roll 2 is rotating in the reverse direction to the rotational direction in step S228.

A rolling apparatus and a method for setting the rolling mill according to the second embodiment of the present invention have been described above. According to the present embodiment, in a case where the rolling mill is a single drive mill, with respect to the roll assembly on the side on which the vertical roll load measurement apparatus is provided, the inter-roll cross angle is adjusted based on a vertical roll load difference, while with respect to the roll assembly on the side on which the vertical roll load measurement apparatus is not provided, the inter-roll cross angle is adjusted based on the motor torque of the driving electric motor by utilizing the characteristic that the motor torque changes accompanying a change in the cross angle. Further, upon completing adjustment of the inter-roll cross angle with respect to the upper and lower roll assemblies, the work rolls are set in a kiss roll state, and the cross angle between the upper work roll and the lower work roll is adjusted based on the vertical roll load difference. By setting the rolling mill in this way, a thrust force generated between rolls due to the inter-roll cross angle can be reduced, and the occurrence of zigzagging and camber of a workpiece during rolling can be suppressed.

Note that, although it is described above that, in the second adjustment, roll chock positions are adjusted based on the motor torque of the driving electric motor, the present invention is not limited to this example, and similarly to the first embodiment, the rolling mill can also be similarly set using the spindle torque of the driving electric motor. At such time, a spindle torque measurement apparatus for measuring the spindle torque of the driving electric motor is provided in the rolling mill, and if two spindle torque measurement apparatuses that are to be used for the upper work roll and the lower work roll, respectively, are provided, it will be possible to adjust the roll chock positions based on the spindle torque in each of the upper and lower roll assemblies without using vertical roll load differences.

Furthermore, although it is described above that, in the first adjustment, with respect to the roll assembly on the side on which the vertical roll load measurement apparatus is installed, the positions of roll chocks are adjusted so that the vertical roll load difference falls within a predetermined allowable range, the present invention is not limited to this example, and similarly to the second adjustment, the roll chock positions may be adjusted based on the torque.

4. Relations Between Inter-Roll Cross Angle and Various Values

In the method for setting a rolling mill according to the first and second embodiment described above, in order to eliminate an inter-roll cross, control of the positions of roll chocks is performed so that a vertical roll load difference becomes zero or becomes a value within an allowable range, or so that the torque becomes minimal. This is based on the finding that correlations which are described below exist between the inter-roll cross angle and the vertical roll load difference, the motor torque, and the spindle torque. The relations between the inter-roll cross angle and the various values are described hereunder based on FIG. 8 to FIG. 16.

[4-1. Method for Calculating Behavior of Vertical Roll Load Difference Between Time of Normal Roll Rotation and Time of Reverse Roll Rotation, and Control Target Value]

In the foregoing first and second embodiments, to perform adjustment based on a vertical roll load difference, with respect to the vertical roll load difference that is a difference between a vertical roll load on the work side and a vertical roll load on the drive side, the relation between vertical roll load differences during normal rotation of rolls and during reverse rotation of rolls was studied. In the study, for example, as illustrated in FIG. 8, in a rolling mill having a pair of work rolls 1 and 2 and a pair of backup rolls 3 and 4 supporting the pair of work rolls 1 and 2, the upper work roll 1 and the lower work roll 2 were separated from each other to set a roll gap between the work rolls 1 and 2 in an open state.

Note that, the work side of the upper work roll 1 is supported by the upper work roll chock 5*a*, and the drive side of the upper work roll 1 is supported by the upper work roll chock 5*b*. The work side of the lower work roll 2 is supported by the lower work roll chock 6*a*, and the drive side of the lower work roll 2 is supported by the lower work roll chock 6*b*. The work side of the upper backup roll 3 is supported by the upper backup roll chock 7*a*, and the drive side of the upper backup roll 3 is supported by the upper backup roll chock 7*b*. Further, the work side of the lower backup roll 4 is supported by the lower backup roll chock 8*a*, and the drive side of the lower backup roll 4 is supported by the lower backup roll chock 8*b*. In a state in which the work rolls 1 and 2 are separated from each other, an increase bending force is applied by increase bending apparatuses (not illustrated) to the upper work roll chocks 5*a* and 5*b* and the lower work roll chocks 6*a* and 6*b*.

Figure 8:
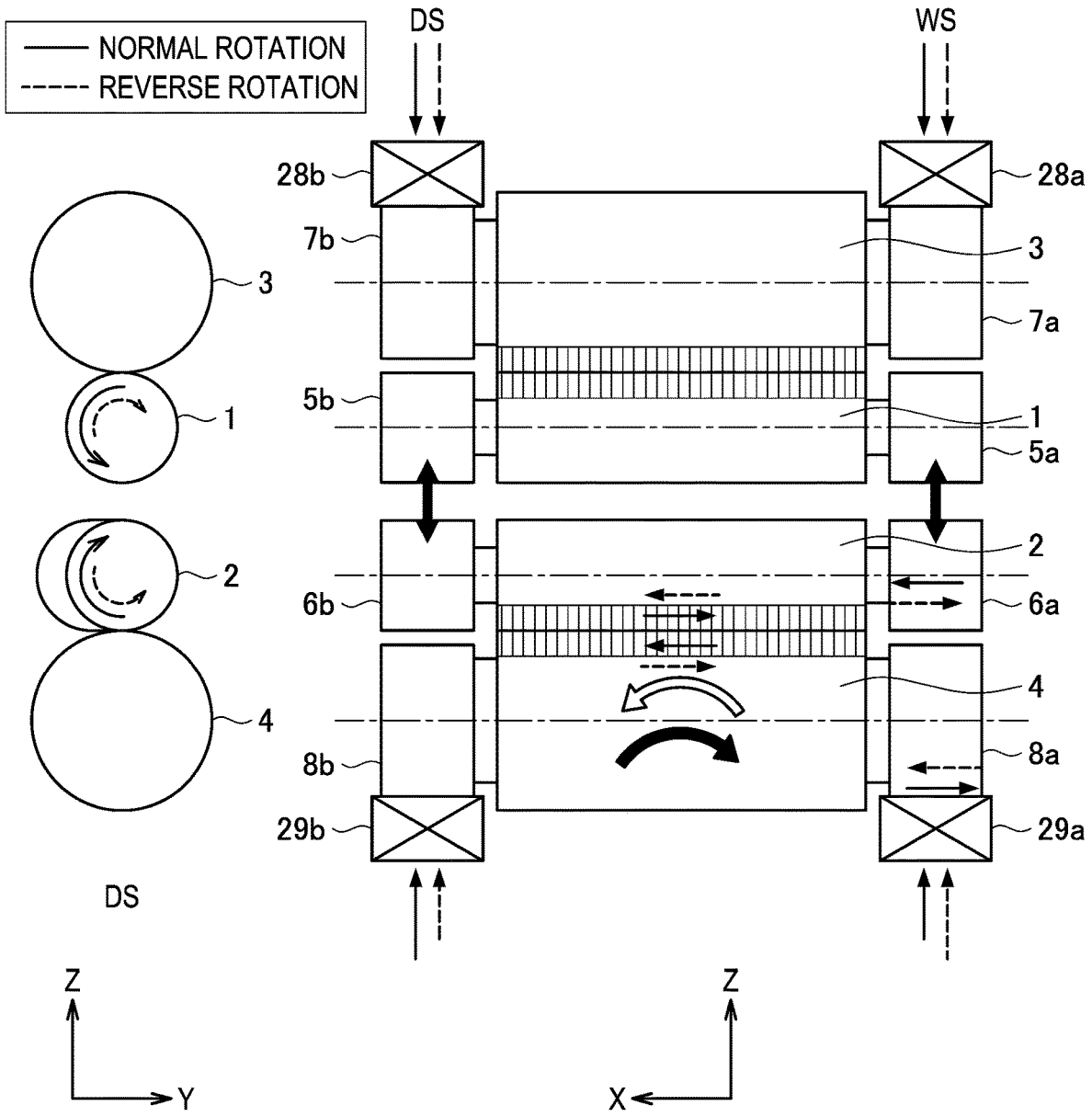
FIG. 8 is a multiview drawing including a schematic side view and a schematic front view illustrating one example of a state in which an inter-roll thrust force arises in a rolling mill when an inter-roll cross angle changes.
Figure 9:
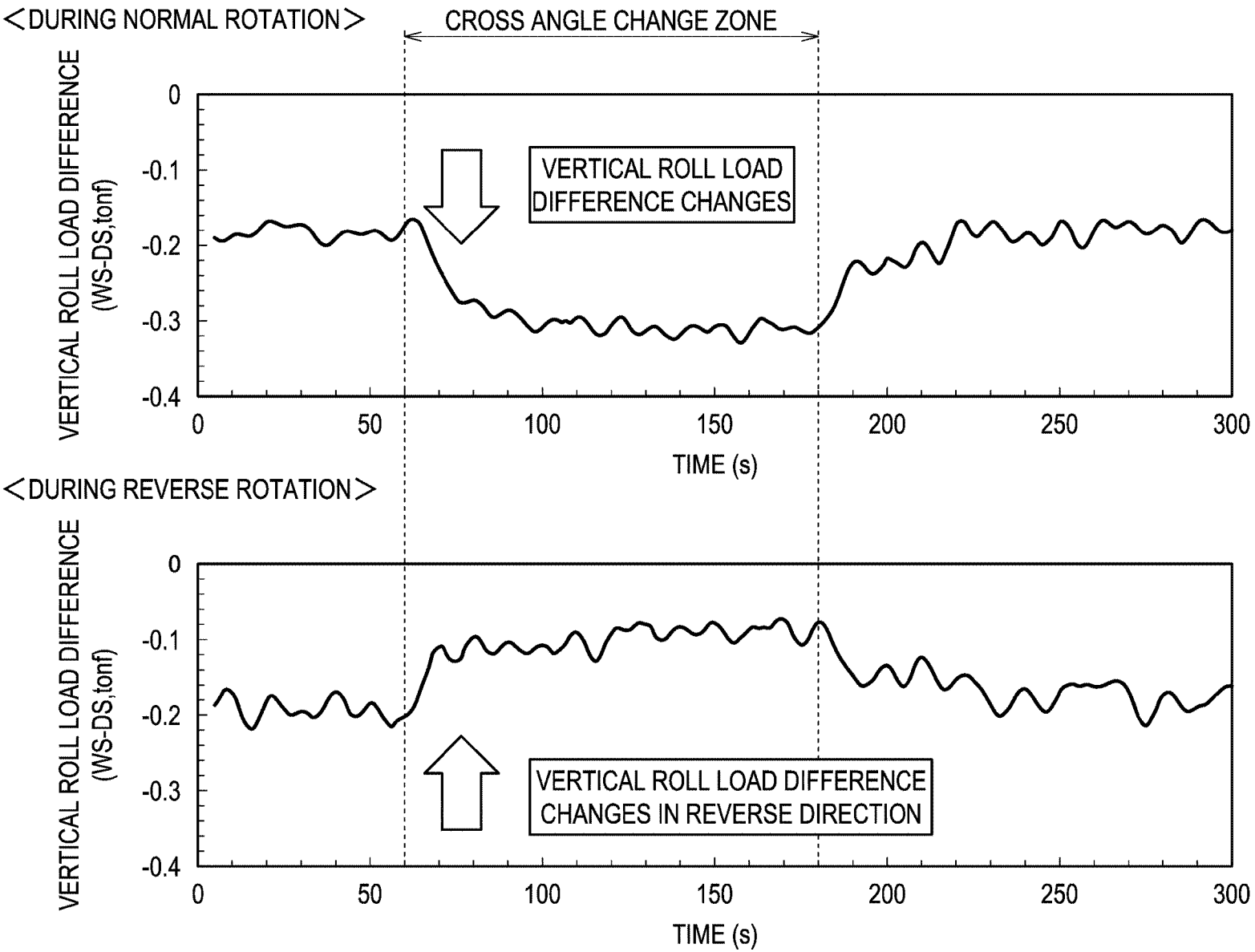
FIG. 9 is an explanatory drawing illustrating a difference in vertical roll loads that are acquired in a case where a roll on the lower side is rotated in the normal direction and a case where the roll is rotated in the reverse direction in the rolling mill in the state shown in FIG. 8.

As illustrated in FIG. 8, when the rolls are rotated in a state in which an inter-roll cross angle arises between the lower work roll 2 and the lower backup roll 4, a thrust force is generated between the lower work roll 2 and the lower backup roll 4, and a moment is generated at the lower backup roll 4. In this state, in the present study, vertical roll loads were detected in the case where rolls were subjected to normal rotation and the case where the rolls were rotated in reverse. For example, as illustrated in FIG. 9, during normal roll rotation and during reverse roll rotation, respectively, vertical roll loads were detected at a time when the lower work roll was rotated around an axis (Z-axis) parallel to the vertical direction to change an inter-roll cross angle only in a predetermined cross angle change zone. FIG. 9 shows measurement results obtained by detecting changes in a vertical roll load difference during normal roll rotation and during reverse roll rotation when an inter-roll cross angle of the lower work roll was changed by 0.1° so as to face the exit side on the drive side in a small rolling mill with a work roll diameter of 80 mm. The increase bending force applied to each work roll chock was set to 0.5 tonf/chock.

According to the detection results, a vertical roll load difference acquired during normal roll rotation increases in the negative direction in comparison to the value thereof before changing the inter-roll cross angle. On the other hand, a vertical roll load difference acquired during reverse roll rotation increases in the positive direction in comparison to the value thereof before changing the inter-roll cross angle. Thus, although the sizes of vertical roll load differences during normal roll rotation and during reverse roll rotation are approximately the same, the directions thereof are opposite to each other.

Therefore, based on the aforementioned relation, the state during normal roll rotation is taken as a reference, and one-half of a deviation from the reference in the state of reverse roll rotation is taken as a control target value for a vertical roll load difference at which a thrust force between the work roll and the backup roll on the upper side and the lower side, respectively, becomes zero. The control target values can be expressed by the following formula (1).

[Expression 1]

$$\left.\begin{aligned} P'^{T}_{dfT} &= \frac{P'^{T}_{df} - P^{T}_{df}}{2} \\ P'^{B}_{dfT} &= \frac{P'^{B}_{df} - P^{B}_{df}}{2} \end{aligned}\right\} \quad (1)$$

Here, $P'_{dfT}{}^{T}$ represents a control target value of the upper roll assembly, and $P'_{dfT}{}^{B}$ represents a control target value of the lower roll assembly. Further, $P_{df}{}^{T}$ and $P'_{df}{}^{T}$ represent differences between the work side and the drive side in vertical roll load measurement values for the upper roll assembly during normal roll rotation and a state of reverse roll rotation, and $P_{df}{}^{B}$ and $P'_{df}{}^{B}$ represent vertical roll load differences between the work side and the drive side in the vertical roll load measurement values for the lower roll assembly in the state of normal roll rotation and the state of reverse roll rotation. In this way, control target values for the upper roll assembly and the lower roll assembly can be calculated.

Therefore, based on the aforementioned relation, for example, the inter-roll thrust force can be made zero by calculating a control target value by taking a normal roll rotation state as a reference (that is, a reference value for the vertical roll load difference), and making a vertical roll load difference in a reverse roll rotation state match the control target value.

[4-2. Method for Calculating Behavior of Vertical Roll Load Difference Between Time when Rolls are Stopped and Time of Rotation, and Control Target Value]

Figure 10:
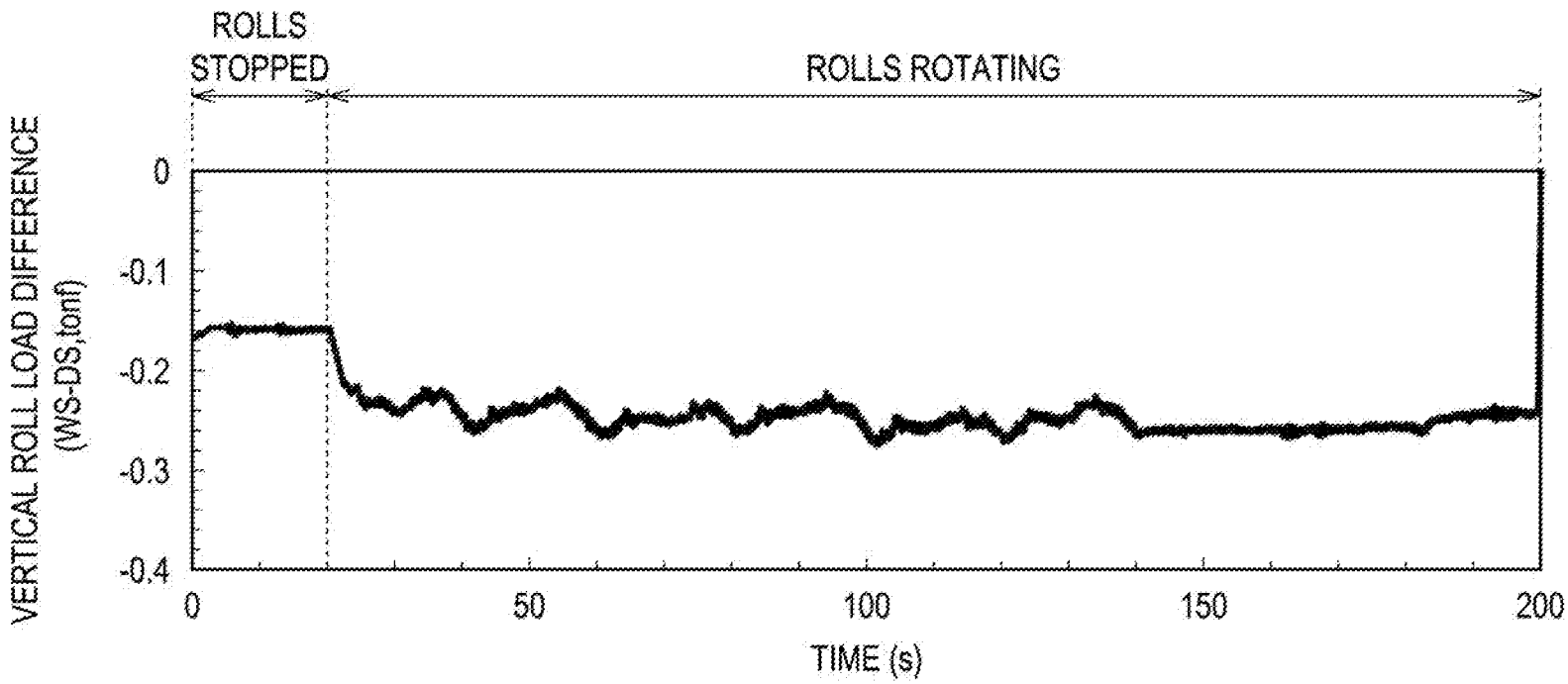
FIG. 10 is an explanatory drawing illustrating a difference between vertical roll loads that are acquired in a case where a roll on the lower side is stopped and a case where the roll is rotated in the rolling mill in the state shown in FIG. 8.

FIG. 10 illustrates changes in a vertical roll load difference that is a difference between the vertical roll load on the work side and the vertical roll load on the drive side, between a time when rolls are in a stopped state and a time of roll rotation. The vertical roll load difference illustrated in this case is a difference at a time when a predetermined inter-roll cross angle was provided between the lower work roll 2 and the lower backup roll 4, and vertical roll loads in a state in which the rolls were in a stopped state were detected, and thereafter the rolls were rotated and vertical roll loads were detected. Note that FIG. 10 shows measurement results obtained by detecting changes in the vertical roll load difference during normal roll rotation and during reverse roll rotation when an inter-roll cross angle of the lower work roll was changed by 0.1° so as to face the exit side on the drive side in a small rolling mill with a work roll diameter of 80 mm. The increase bending force applied to each work roll chock was set to 0.5 tonf/chock.

As illustrated in FIG. 10, the vertical roll load difference when the rolls are rotated increases in the negative direction in comparison to the vertical roll load difference when the rolls are in a stopped state. Thus, the vertical roll load difference differs between a time when the rolls are in a stopped state and a time when the rolls are rotating. It is considered that this is because a vertical roll load difference that arises in a state in which rolls are in a stopped state is caused by a factor other than a thrust force.

Thus, it is considered that a vertical roll load difference that arises in a state in which rolls are stopped is caused by a factor other than a thrust force. Therefore, thrust forces between upper and lower work rolls and backup rolls can be made zero by setting control target values that take a vertical roll load difference in a state in which the rolls are stopped as a reference and controlling the roll chock positions. That is, the control target values are expressed by the following formula (2).

[Expression 2]

$$\left.\begin{aligned} P^{r}_{dfT}{}^{T} &= P^{0}_{df}{}^{T} \\ P^{r}_{dfT}{}^{B} &= P^{0}_{df}{}^{B} \end{aligned}\right\} \quad (2)$$

Here, $P^{r}_{dfT}{}^{T}$ represents a control target value of the upper roll assembly, and $P^{r}_{dfT}{}^{B}$ represents a control target value of the lower roll assembly. Further, $P^{0}_{df}{}^{T}$ represents a vertical roll load difference between the work side and the drive side in vertical roll load measurement values of the upper roll assembly in a state in which roll rotation is stopped, and $P^{0}_{df}{}^{B}$ represents a vertical roll load difference between the work side and the drive side in vertical roll load measurement values of the lower roll assembly in a state in which roll rotation is stopped. Note that, in this case, the direction in a state of roll rotation is not particularly defined, and rotation of rolls may be either normal rotation or reverse rotation. In this way, control target values for the upper roll assembly and the lower roll assembly can be calculated.

Therefore, based on the aforementioned relation, a thrust force between rolls can be made zero by setting a vertical roll load difference when rolls are in a stopped state as a control target value, and controlling roll chock positions during roll rotation (for example, during reverse roll rotation) so as to make a vertical roll load difference in the state of reverse roll rotation match the control target value.

Note that, the experimental results and the methods for calculating control target values described above are for cases where the roll gap was set in an open state and the influence that a thrust force acting between a work roll and a backup roll exerted on a vertical roll load difference appeared. In a kiss roll state also, as long as the state is one in which an inter-roll cross angle between a work roll and a backup roll was adjusted, the influence that a thrust force acting between upper and lower work rolls exerts on the vertical roll load difference is the same as in a case where the roll gap is set in an open state, and the methods for calculating control target values can also be similarly applied.

[4-3. Relations when Roll Gap is in Open State]

Figure 11:
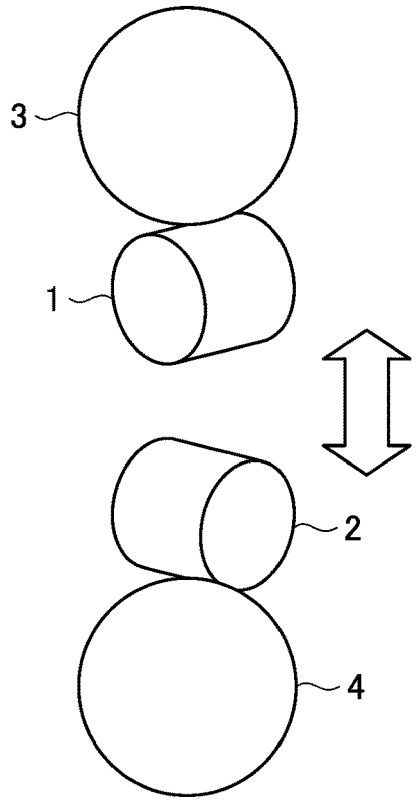
FIG. 11 is an explanatory drawing illustrating the arrangement of work rolls and backup rolls of a rolling mill in which a roll gap is in an open state.
Figure 12:
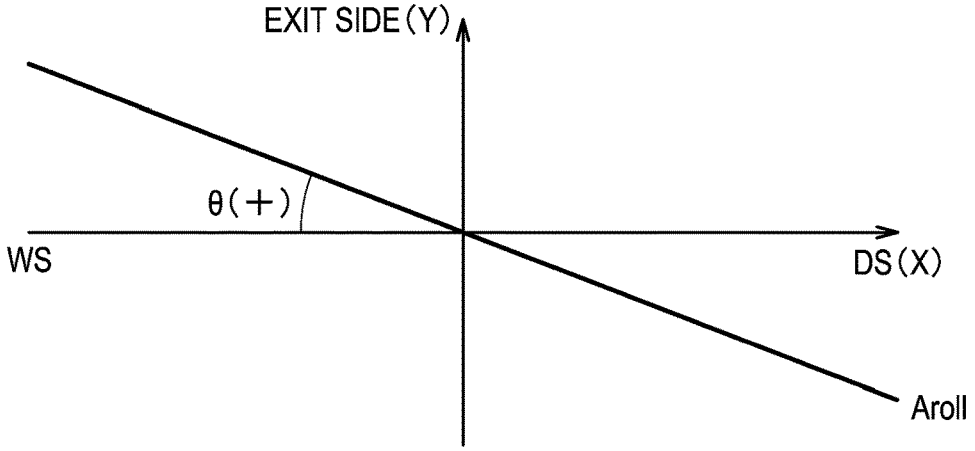
FIG. 12 is an explanatory drawing showing a definition of an inter-roll cross angle.
Figure 13:
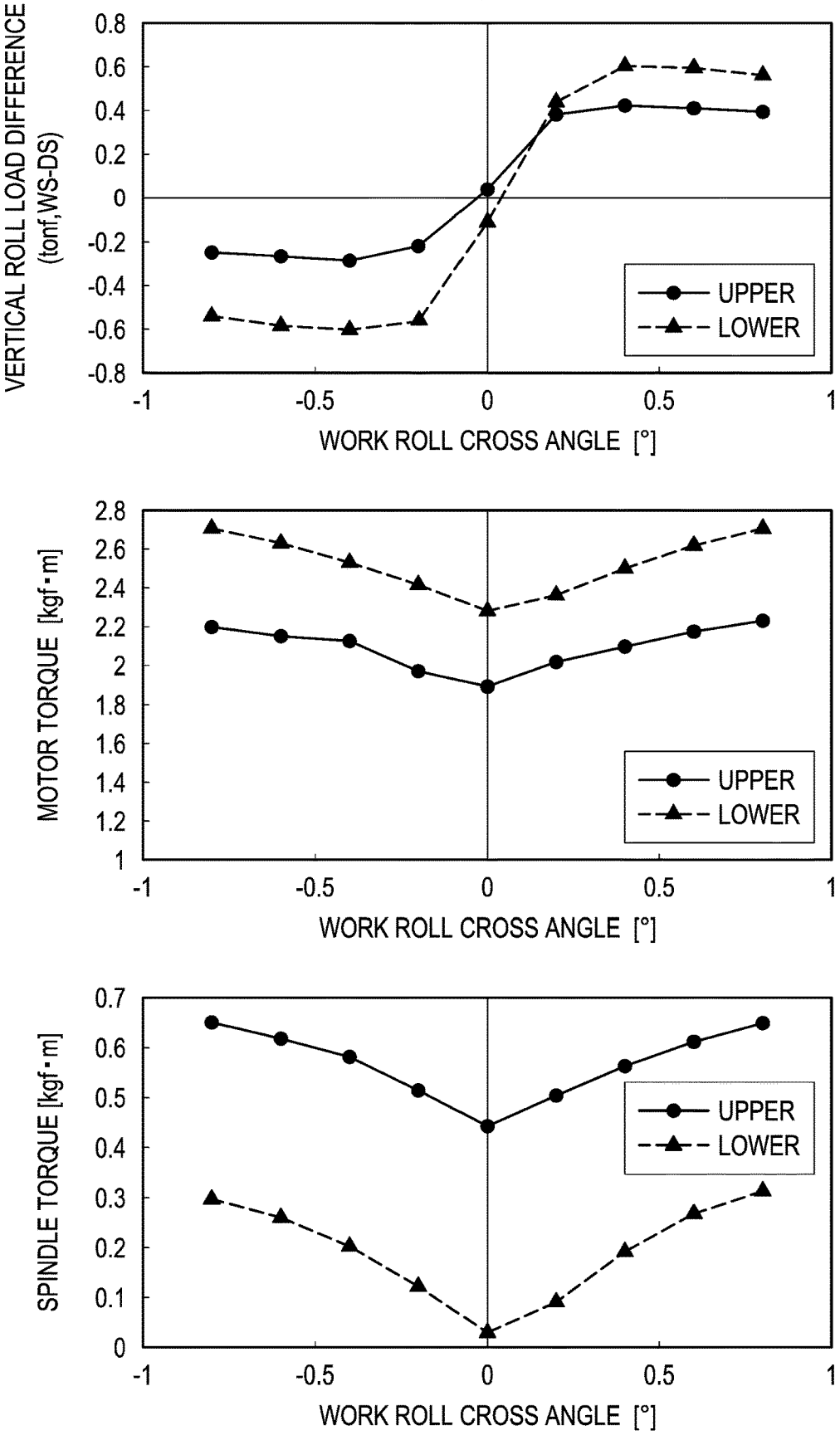
FIG. 13 is a multiview drawing showing graphs that illustrate a relation between a work roll cross angle and vertical roll load difference, a relation between a work roll cross angle and motor torque, and a relation between a work roll cross angle and spindle torque, in a state in which a roll gap is open.
Figure 14A:
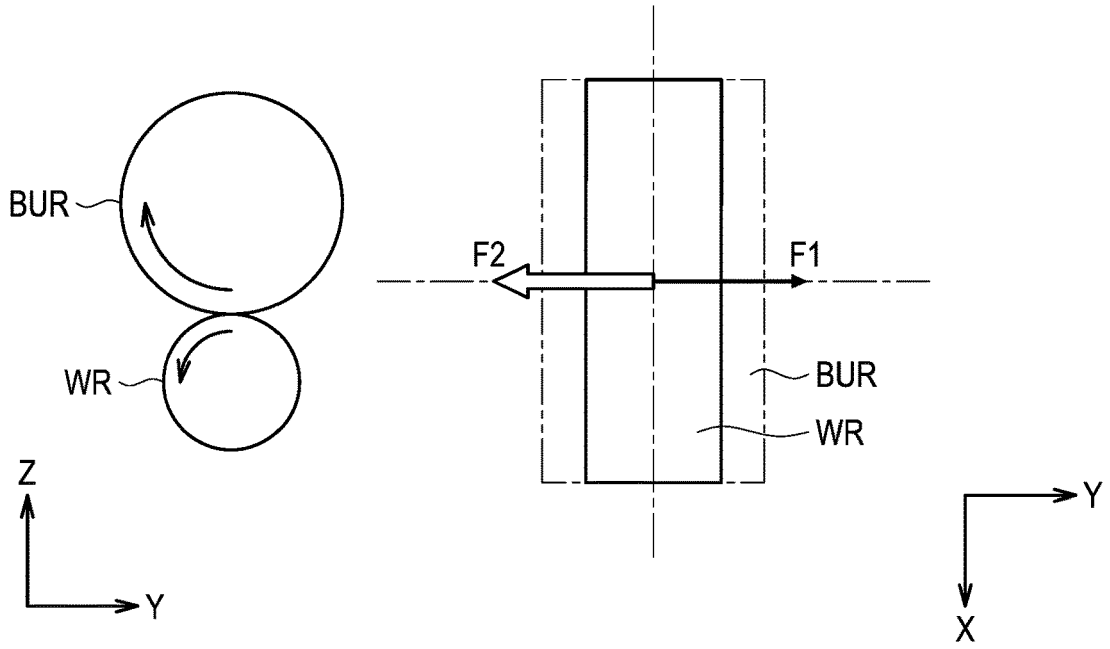
FIG. 14A is an explanatory drawing illustrating a mechanism through which relations between an inter-roll cross angle and various values shown in FIG. 13 arise, that illustrates a case where there is no inter-roll cross angle.
Figure 14B:
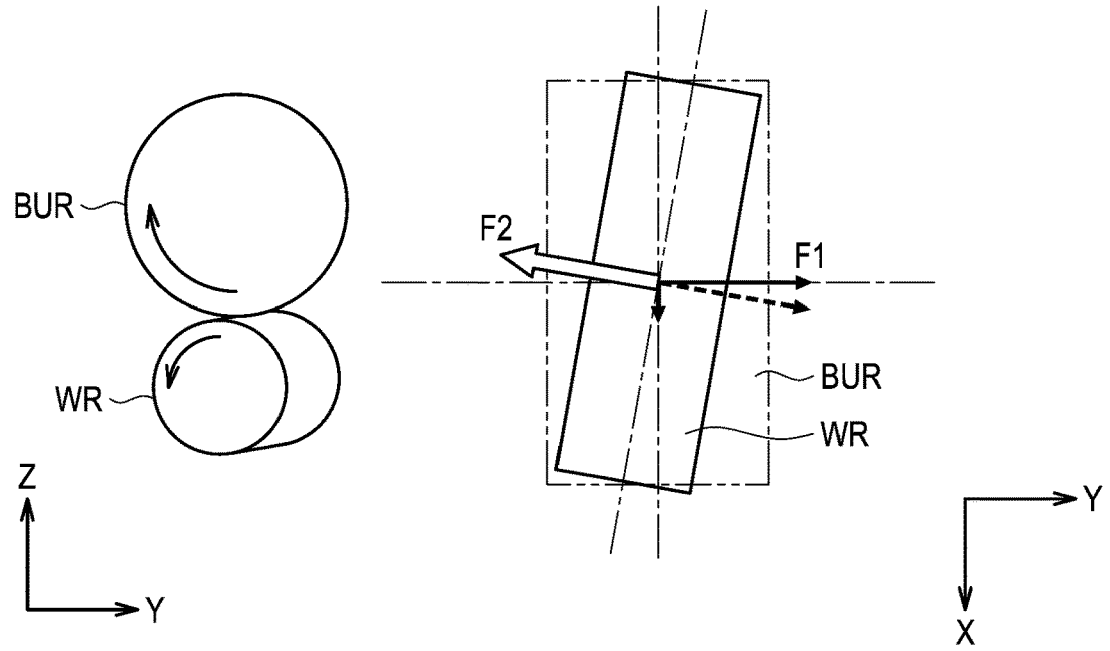
FIG. 14B is an explanatory drawing illustrating a mechanism through which relations between an inter-roll cross angle and various values shown in FIG. 13 arise, that illustrates a case where there is an inter-roll cross angle.

First, based on FIG. 11 to FIG. 14B, the relations between an inter-roll cross and various values in a case where the roll gap between the work rolls is in an open state will be described. FIG. 11 is an explanatory drawing illustrating the arrangement of the work rolls 1 and 2 and the backup rolls 3 and 4 of a rolling mill in which the roll gap is in an open state. FIG. 12 is an explanatory drawing showing the definition of an inter-roll cross angle. FIG. 13 is a multiview drawing showing graphs that illustrate a relation between the work roll cross angle and vertical roll load difference, a relation between the work roll cross angle and motor torque, and a relation between the work roll cross angle and spindle torque, in a state in which a roll gap is open, which relations obtained as the results of experiments performed using a small rolling mill with a work roll diameter of 80 mm. FIG. 14A is an explanatory drawing illustrating a mechanism through which the relations between the inter-roll cross angle and the various values shown in FIG. 13 arise, that illustrates a case where there is no inter-roll cross angle. FIG. 14B is an explanatory drawing illustrating a mechanism through which the relations between the inter-roll cross angle and the various values shown in FIG. 13 arise, that illustrates a case where there is an inter-roll cross angle. Note that, in FIG. 13, values are shown that were obtained by measuring a vertical roll load difference in both a case where the work roll cross angle was set in an increasing direction and a case where the work roll cross angle was set in a decreasing direction, respectively, and averaging the measurement values for the increasing direction and the measurement values for the decreasing direction.

As illustrated in FIG. 11, the roll gap between the upper work roll 1 and the lower work roll 2 was set in an open state, and a state was formed in which an increase bending force was applied by an increase bending apparatus to the work roll chocks. Then, changes in the backup roll thrust counterforce, the work roll thrust counterforce and the vertical roll load difference when the cross angles of the upper backup roll 3 and the lower backup roll 4 were changed, respectively, were investigated. As illustrated in FIG. 12, with respect to the cross angle of a backup roll, a direction in which the work side of a roll axis $A_{roll}$ extending in the axial direction of the roll extends from the width direction (X-direction) toward the exit side is represented as positive. Further, as the increase bending force, 0.5 tonf was applied per roll chock.

As a result it was found that, as illustrated in FIG. 13, there is a relation such that, as the cross angle between the upper work roll 1 and the lower work roll 2 gradually increases from a negative angle to an angle of zero to a positive angle, the value for the vertical roll load difference increases in a similar manner to the cross angle. Further, with respect to the motor torque and the spindle torque, it was confirmed that when the cross angle between the upper work roll 1 and the lower work roll 2 is gradually increased from a negative angle to an angle of zero to a positive angle, the motor torque and the spindle torque each take a minimal value when the cross angle between the work rolls is zero.

This is because, as illustrated in FIG. 14A, in a case where there is no inter-roll cross angle between a work roll WR and a backup roll BUR, the vector directions of a force F1 that acts on the work roll WR from the backup roll BUR and a force F2 that is required to cause the backup roll BUR to rotate match. On the other hand, as illustrated in FIG. 14B, in a case where there is an inter-roll cross angle between the work roll WR and the backup roll BUR, the vector directions of the force F1 acting on the work roll WR from the backup roll BUR and the force F2 required to cause the backup roll BUR to rotate are different. Therefore, in order to cause the backup roll BUR to rotate, a larger driving force is required than in a case where there is no inter-roll cross angle. Thus, it is considered that because the torque changes according to the inter-roll cross angle, the correlations as illustrated in FIG. 13 arise between the motor torque and spindle torque and the inter-roll cross angle.

[4-4. Relations in Kiss Roll State (with a Pair Cross)]

Figure 15:
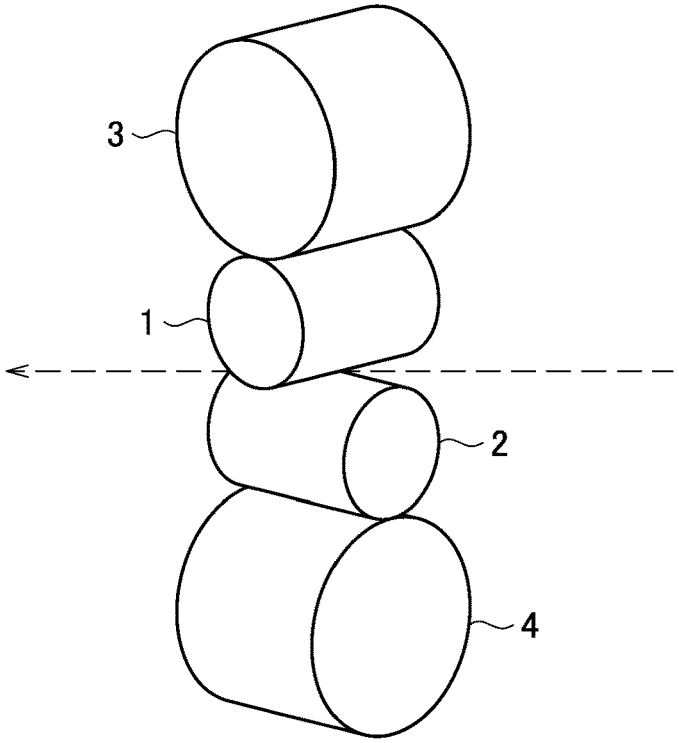
FIG. 15 is an explanatory drawing illustrating the arrangement of work rolls and backup rolls of a rolling mill set in a kiss roll state.
Figure 16:
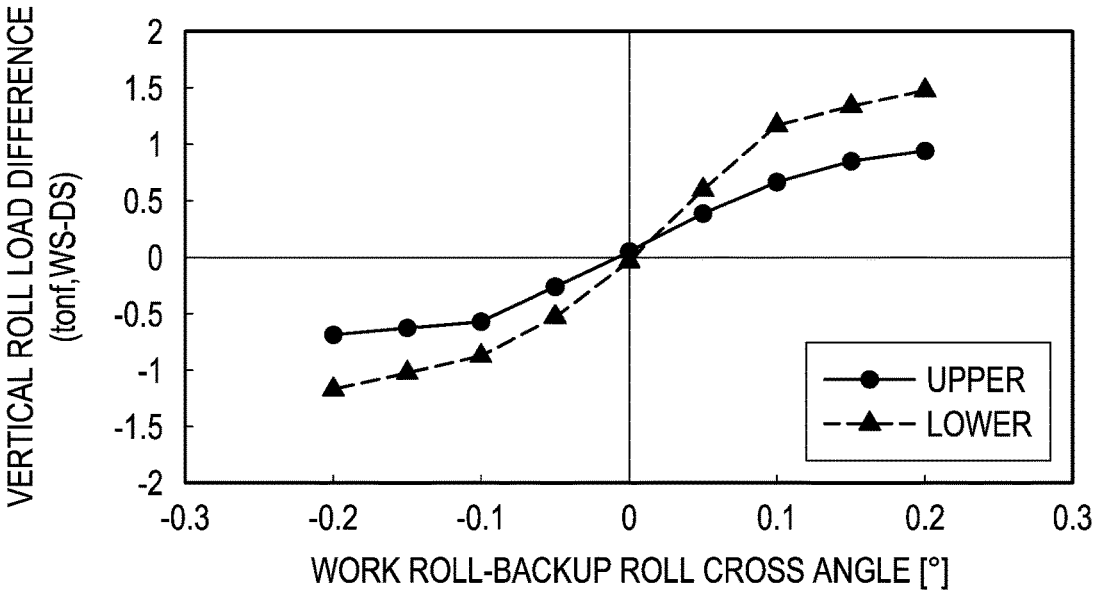
FIG. 16 is a graph illustrating a relation between a pair-cross angle between a work roll and a backup roll, and vertical roll load difference in a kiss roll state.

Next, the relations between an inter-roll cross and various values in a case where the work rolls are in a kiss roll state will be described based on FIG. 15 and FIG. 16. FIG. 15 is an explanatory drawing illustrating the arrangement of the work rolls 1 and 2 and the backup rolls 3 and 4 of the rolling mill that has been set in a kiss roll state. FIG. 16 is a graph illustrating a relation between a pair-cross angle between a work roll and a backup roll, and vertical roll load difference in a kiss roll state. Note that, in FIG. 16, values are shown for vertical roll load difference that were obtained by measuring a vertical roll load difference in a case where the pair-cross angle was set in an increasing direction and a case where the pair-cross angle was set in a decreasing direction, respectively, and averaging the measurement values for the increasing direction and the measurement values for the decreasing direction.

In this case, as illustrated in FIG. 15, changes in the vertical roll load difference when the upper work roll 1 and the lower work roll 2 were set in a kiss roll state and pair-cross angles between the work rolls and the backup rolls were changed, respectively, were investigated. At such time, a kiss roll tightening load was made 6.0 tonf (3.0 tonf per side).

As a result it was found that, as illustrated in FIG. 16, as the pair cross angle gradually increases from a negative angle to an angle of zero to a positive angle, the vertical roll load difference also increases by changing in correspondence with the changes in the pair-cross angle, and when the pair-cross angle is zero, the vertical roll load difference is also zero. By this means, in a state in which a kiss roll tightening load is applied, it is possible to detect the influence of a thrust force attributable to crossing between the upper and lower work rolls based on the vertical roll load difference. Further, it was confirmed that there is a possibility that an inter-roll thrust force between upper and lower work rolls can be reduced by controlling roll chock positions in a manner that takes work rolls and backup rolls on the top and bottom, respectively, as a single body so that the aforementioned values become zero.

EXAMPLES

Example 1

A conventional method and the method of the present invention were compared in relation to reduction leveling setting that takes into consideration the influence of a thrust force due to an inter-roll cross in a so-called "twin-drive hot rolled thick-gauge plate rolling mill" in which the upper work roll 1 and the lower work roll 2 are configured to be independently rotatable that is illustrated in FIG. 2.

First, in the conventional method, without using the functions of the inter-roll crossing control unit of the present invention, replacement of housing liners and chock liners was periodically performed, and equipment management was conducted so that an inter-roll cross would not occur.

On the other hand, in the method of the present invention, using the functions of the inter-roll cross control unit according to the first embodiment that is described above, adjustment of the positions of roll chocks was performed in accordance with the processing flow illustrated in FIG. 3A and FIG. 3B before rolling. That is, first, in a state in which the roll gap was set in an open state and an increase bending force was applied, spindle torque on the upper and lower sides were measured by the spindle torque measurement apparatuses, and the positions of the upper and lower work roll chocks were controlled. Next, the work rolls were set in a kiss roll state, the vertical roll loads on the work side and the drive side were measured and the vertical roll load difference was calculated, and the positions of the roll chocks of the upper and lower work rolls and backup rolls were controlled so that the vertical roll load difference became a control target value that was set in advance.

Table 1 shows actual measurement values for the occurrence of camber with regard to a representative number of rolled workpieces, with respect to the present invention and the conventional method. Among the actual measurement values for camber per 1 m of a front end portion of the workpieces, when the value for immediately before backup roll replacement and immediately before housing liner replacement are seen, it is found that in the case of the present invention the value is kept to a relatively small value of 0.13 mm/m. In contrast, in the case of the conventional method, in a period immediately before backup roll replacement and immediately before housing liner replacement, the actual measurement value for camber is large in comparison to the case of the present invention.

TABLE 1

| | Actual Measurement Values for Camber per 1 m at Front End Portion (mm/m) | | |
|---|---|---|---|
| | Immediately After Backup Roll Replacement | Immediately Before Backup Roll Replacement | Immediately Before Backup Roll Replacement and Immediately Before Housing Liner Replacement |
| Present Invention | 0.13 | 0.15 | 0.13 |
| Conventional Method | 0.17 | 0.44 | 0.71 |

Thus, in the method of the present invention, before rolling, the positions of the upper and lower work roll chocks are controlled based on values for the upper and lower spindle torque that were measured when the roll gap was set in an open state, and thereafter control of the chock positions of each roll of the roll assembly on the opposite side to the reference roll is performed so that the vertical roll load difference when the work rolls are set in a kiss roll state becomes a control target value that is set in advance, and by this means the inter-roll cross itself is eliminated, and left-right asymmetric deformation of a workpiece that occurs due to thrust forces caused by an inter-roll cross can be eliminated. Therefore, a metal plate material can be stably produced without zigzagging and camber or with extremely little zigzagging and camber.

Example 2

Next, for fifth to seventh stands of a hot finish rolling mill configured so that in each stand the upper work roll and the lower work roll are driven by a single driving electric motor through a pinion stand or the like as illustrated in FIG. 5, a conventional method and the method of the present invention were compared in regard to reduction leveling setting that takes into consideration the influence of an inter-roll thrust force that is generated due to an inter-roll cross.

First, in the conventional method, without using the functions of the inter-roll cross control unit of the present invention, replacement of housing liners and chock liners was periodically performed, and equipment management was conducted so that an inter-roll cross would not occur. As a result, in a period immediately before replacement of the housing liner, when a thin and wide material having an exit side plate thickness of 1.2 mm and a width of 1200 mm was rolled, zigzagging of 100 mm or more occurred at the sixth stand, and swaging occurred as a result.

On the other hand, in the method of the present invention, using the functions of the inter-roll cross control unit according to the second embodiment that is described above, in accordance with the processing flow illustrated in FIG. 6A to FIG. 6C, first, in a state in which the roll gap was in an open state and the upper work roll and the lower work roll were in a stopped state, the vertical roll load on the work side and the vertical roll load on the drive side were measured and a vertical roll load difference was calculated, and the position of the roll chocks of the lower work roll was adjusted so that the vertical roll load difference became a first control target value. Next, the roll chock positions of the upper roll assembly in which the vertical roll load measurement apparatus was not provided were adjusted so that the motor torque became minimal. Thereafter, the work rolls were set in a kiss roll state, the vertical roll loads on the work side and the drive side were measured and a vertical roll load difference was calculated, and the positions of the roll chocks of the upper work roll and upper backup roll were controlled so that the vertical roll load difference became a second control target value.

As a result, in a period immediately before replacement of the housing liner also, even in a case where a thin and wide material having an exit side plate thickness of 1.2 mm and a width of 1200 mm with respect to which swaging occurred in the conventional method was rolled, the occurrence of zigzagging stayed at 15 mm or less, and the workpiece could be passed through the rolling line without causing swaging of the workpiece.

As described above, in the method of the present invention, before rolling, the roll gap is set in an open state and the position of the roll chocks of the work roll on the side on which the vertical roll load measurement apparatus is provided is adjusted based on a vertical roll load difference, and furthermore, the roll chock positions of the roll assembly on the side on which the vertical roll load measurement apparatus is not provided are adjusted so that the motor torque becomes minimal, and thereafter by setting the work rolls in a kiss roll state and controlling the positions of the roll chocks of the roll assembly on the side on which the vertical roll load measurement apparatus is not provided based on the vertical roll load difference, the inter-roll cross itself is eliminated, and left-right asymmetric deformation of a workpiece that occurs due to thrust forces caused by an inter-roll cross can be eliminated. Therefore, a metal plate material can be stably produced without zigzagging and camber or with extremely little zigzagging and camber.

Whilst preferred embodiments of the present invention have been described in detail above with reference to the accompanying drawings, the present invention is not limited to the above examples. It is clear that a person having common knowledge in the field of the art to which the present invention pertains will be able to contrive various examples of changes and modifications within the category of the technical idea described in the appended claims, and it should be understood that they also naturally belong to the technical scope of the present invention.

5. Modifications

Whilst a four-high rolling mill having a pair of work rolls and a pair of backup rolls has been described in the above embodiments, the present invention is also applicable to a rolling mill of having more rolls than a four-high rolling mill. In such a case also, it suffices to set any one roll among the rolls constituting the rolling mill as the reference roll. For example, in the case of a six-high rolling mill, any roll among the work rolls, intermediate rolls and backup rolls can be set as the reference roll. At such time, similarly to the case of a four-high rolling mill, it is preferable that among the respective rolls arranged in the vertical direction, a roll located at the lowermost part or the uppermost part is adopted as the reference roll.

(1) Case of Vertical Independent Driving

Figure 17A:
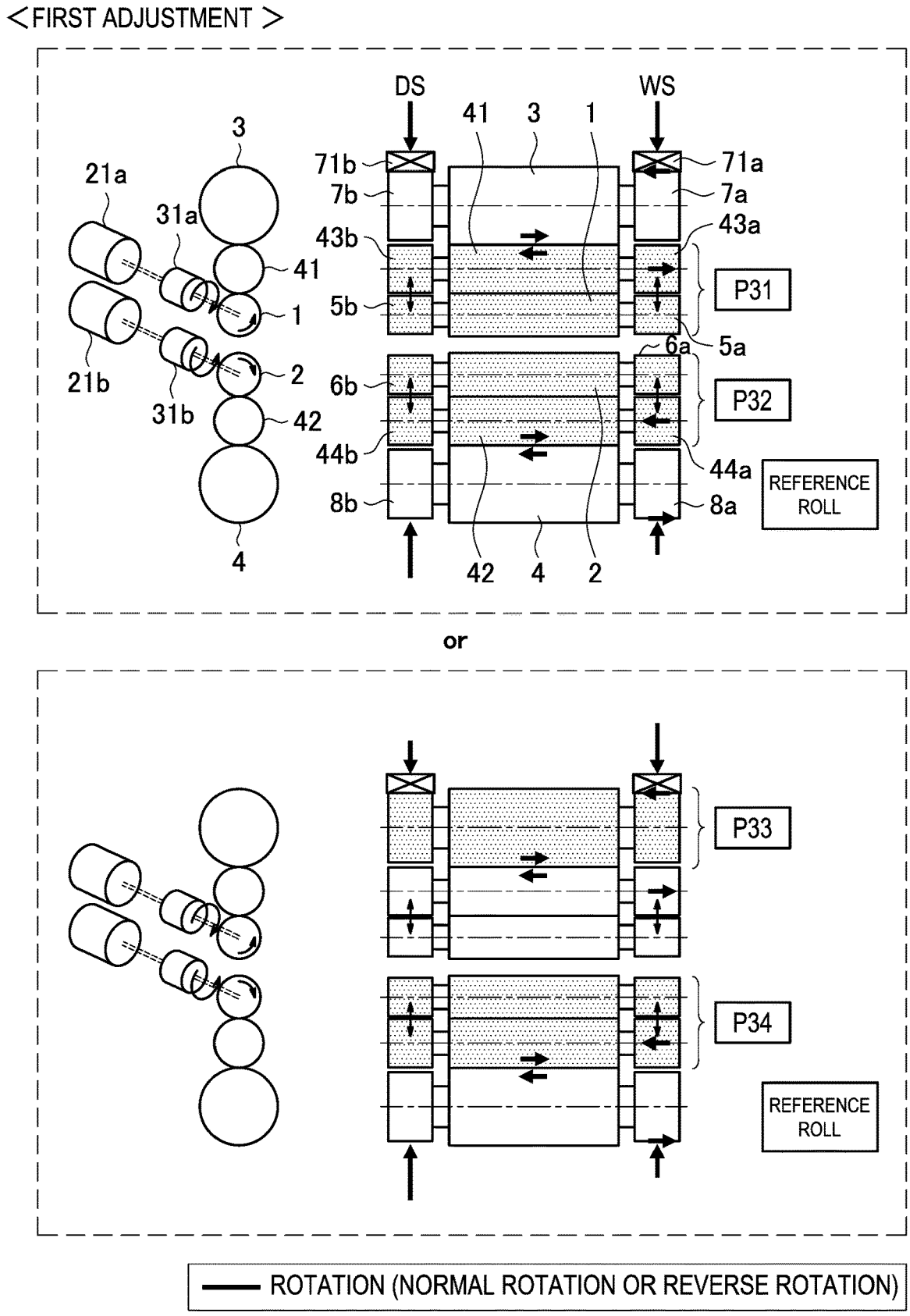
FIG. 17A is an explanatory drawing illustrating procedures for roll position adjustment in a case where the method for setting a rolling mill illustrated in FIG. 4A

For example, as illustrated in FIG. 17A, in a six-high rolling mill, intermediate rolls 41 and 42 are provided between work roll 1 and backup roll 3, and work roll 2 and backup roll 4, respectively. The upper intermediate roll 41 is supported by an upper intermediate roll chock 43*a* on the work side and an upper intermediate roll chock 43*b* on the drive side (the upper intermediate roll chocks 43*a* and 43*b* are also referred to together as "upper intermediate roll chocks 43"). The lower intermediate roll 42 is supported by a lower intermediate roll chock 44*a* on the work side and a lower intermediate roll chock 44*b* on the drive side (the lower intermediate roll chocks 44*a* and 44*b* are also referred to together as "lower intermediate roll chocks 44").

The upper work roll 1 is rotationally driven by an upper driving electric motor 21*a*, and the lower work roll 2 is rotationally driven by a lower driving electric motor 21*b*. That is, in the example illustrated in FIG. 17A, the upper work roll 1 and the lower work roll 2 are configured to be independently rotatable. The upper driving electric motor 21*a* and the lower driving electric motor 21*b* are, for example, motors in which spindle torque measurement apparatuses 31*a* and 31*b* that measure the spindle torque of each motor are provided on the respective spindles thereof.

In the upper work roll chocks 5*a* and 5*b*, as in the four-high rolling mill illustrated in FIG. 2, an upper work roll chock pressing apparatus (the upper work roll chock pressing apparatus 9 illustrated in FIG. 2) is provided on the work side and the drive side, respectively, on the entrance side in the rolling direction, and an upper work roll chock driving apparatus (the upper work roll chock driving apparatus 11 illustrated in FIG. 2) is provided on the work side and the drive side, respectively, on the exit side in the rolling direction. Similarly, in the lower work roll chocks 6*a* and 6*b*, a lower work roll chock pressing apparatus (the lower work roll chock pressing apparatus 10 illustrated in FIG. 2) is provided on the work side and the drive side, respectively, on the entrance side in the rolling direction, and a lower work roll chock driving apparatus (the lower work roll chock driving apparatus 12 illustrated in FIG. 2) is provided on the work side and the drive side, respectively, on the exit side in the rolling direction. The upper and lower work roll chock driving apparatuses are each equipped with a position detecting apparatus that detect the positions of the work roll chocks 5*a*, 5*b*, 6*a* and 6*b*.

Further, in the upper intermediate roll chocks 43*a* and 43*b*, an upper intermediate roll chock pressing apparatus (not illustrated) is provided on the work side and the drive side, respectively, on the exit side in the rolling direction, and an upper intermediate roll chock driving apparatus (not illustrated) is provided on the work side and the drive side, respectively, on the entrance side in the rolling direction. Similarly, in the lower intermediate roll chocks 44*a* and 44*b*, a lower intermediate roll chock pressing apparatus (not illustrated) is provided on the work side and the drive side, respectively, on the exit side in the rolling direction, and a lower intermediate roll chock driving apparatus (not illustrated) is provided on the work side and the drive side, respectively, on the entrance side in the rolling direction. The upper and lower intermediate roll chock driving apparatuses are each equipped with a position detecting apparatus that detect the positions of the intermediate roll chocks 43*a*, 43*b*, 44*a* and 44*b*.

In addition, as in the configuration of the four-high rolling mill illustrated in FIG. 2, in backup roll chocks 7*a* and 7*b*, an upper backup roll chock pressing apparatus (the upper backup roll chock pressing apparatus 13 illustrated in FIG. 2) is provided on the work side and the drive side, respectively, on the exit side in the rolling direction, and an upper backup roll chock driving apparatus (the upper backup roll chock driving apparatus 14 illustrated in FIG. 2) is provided on the work side and the drive side, respectively, on the entrance side in the rolling direction. The upper backup roll chock driving apparatus is equipped with a position detecting apparatus that detects the positions of the upper backup roll chocks 7*a* and 7*b*.

On the other hand, with respect to the lower backup roll chocks 8*a* and 8*b*, since the lower backup roll 4 is adopted as the reference roll in the present embodiment, the lower backup roll chocks 8*a* and 8*b* serve as reference backup roll chocks. Accordingly, since the lower backup roll chocks 8*a* and 8*b* are not driven to perform position adjustment, the lower backup roll chocks 8*a* and 8*b* do not necessarily need to be equipped with a roll chock driving apparatus and a position detecting apparatus as in the case of the upper backup roll chocks 7*a* and 7*b*. However, a configuration may be adopted in which, for example, as illustrated in FIG. 2, a lower backup roll chock pressing apparatus 40 or the like is provided on the entrance side or the exit side in the rolling direction to suppress the occurrence of looseness of the lower backup roll chocks 8*a* and 8*b* so that the position of the reference backup roll chocks that serve as the reference for position adjustment does not change.

In the six-high rolling mill also, setting of the rolling mill that is performed before reduction position zero point adjustment or before the start of rolling may be performed in a similar manner to the case of the four-high rolling mill illustrated in FIG. 4A and FIG. 4B. That is, the roll gap between the work rolls 1 and 2 is set in an open state, and firstly a first process is performed. The first process corresponds to the first process shown in FIG. 1B. The first process includes: a first adjustment of, for the upper roll assembly and the lower roll assembly, respectively, adjusting the positions of the intermediate roll chocks 43*a*, 43*b*, 44*a* and 44*b* of the intermediate rolls 41 and 42 and the backup roll chocks 7*a*, 7*b*, 8*a* and 8*b* of the backup rolls 3 and 4; and after the first adjustment is completed, a second adjustment of, for the upper roll assembly and the lower roll assembly, respectively, adjusting the positions of the intermediate roll chocks 43*a*, 43*b*, 44*a* and 44*b* of the intermediate rolls 41 and 42 and the work roll chocks 5*a*, 5*b*, 6*a* and 6*b* of the work rolls 1 and 2.

For example, in the first adjustment, as illustrated on the upper side in FIG. 17A, for the upper roll assembly and the lower roll assembly, respectively, the positions of the work roll chocks 5*a*, 5*b*, 6*a* and 6*b* of the work rolls 1 and 2 and the intermediate roll chocks 43*a*, 43*b*, 44*a* and 44*b* of the intermediate rolls 41 and 42 are adjusted simultaneously and in the same direction while maintaining the relative positions between the roll chocks so that the value of the torque becomes minimal (P31, P32). BY adjusting the positions of the work roll chocks 5*a*, 5*b*, 6*a* and 6*b* and the intermediate roll chocks 43*a*, 43*b*, 44*a* and 44*b* in this way, the positions of the intermediate rolls 41 and 42 with respect to the backup rolls 3 and 4 are adjusted.

Alternatively, in the first adjustment, as illustrated on the lower side in FIG. 17A, in the case of a roll assembly on the opposite side to the reference roll side, it is possible to adjust the backup roll chocks 7*a* and 7*b*. Accordingly, similarly to the foregoing example, the position of the roll chocks 7*a* and 7*b* of the backup roll 3 may be adjusted so that the value of the torque becomes minimal (P33).

Further, FIG. 17A illustrates a case where vertical roll load measurement apparatuses 71*a* and 71*b* are installed in the roll assembly on the opposite side to the reference roll side. At this time, with regard to the roll assembly on the side on which the vertical roll load measurement apparatuses are installed (that is, in FIG. 17A, the upper roll assembly), a configuration may be adopted so that vertical roll loads in two different rotational states of the pair of the work rolls 1 and 2 are measured on the work side and the drive side, respectively, by the vertical roll load measurement apparatuses 71*a* and 71*b*, and the position of the work roll chocks 5*a* and 5*b* of the work roll 1 and the position of the intermediate roll chocks 43*a* and 43*b* of the intermediate roll 41 are controlled simultaneously and in the same direction while maintaining the relative positions between the roll chocks so that a vertical roll load difference falls within a predetermined allowable range. In a case where the vertical roll load measurement apparatuses are installed in the roll assembly on the reference roll side also, similarly to the foregoing configuration, the positions of the work roll chocks of the work roll and the intermediate roll chocks of the intermediate roll can be controlled simultaneously and in the same direction while maintaining the relative positions between the roll chocks.

Note that, in the case illustrated in FIG. 17A, since the vertical roll load measurement apparatuses are installed in the roll assembly that is on the opposite side to the reference roll side, as described above, the position of the backup roll chocks 8*a* and 8*b* of the lower backup roll 4 may be adjusted. At such time, with regard to the roll assembly on the side on which the vertical roll load measurement apparatuses are not installed, that is, the lower roll assembly in FIG. 17A, similarly to the upper side in FIG. 17A, it suffices to control the positions of the lower work roll chocks 6*a* and 6*b* of the lower work roll 2 and the lower intermediate roll chocks 44*a* and 44*b* of the lower intermediate roll 42 simultaneously and in the same direction while maintaining relative positions between the roll chocks in questions so that the value of the torque becomes minimal (P34).

Note that, in the first adjustment, a bending force is applied between the intermediate rolls 41 and 42 and the backup rolls 3 and 4 using bending apparatuses of the intermediate rolls 41 and 42. At such time, the bending apparatuses of the work rolls 1 and 2 apply a bending force of a degree such that the intermediate rolls 41 and 42 and the work rolls 1 and 2 do not slip.

Figure 17B:
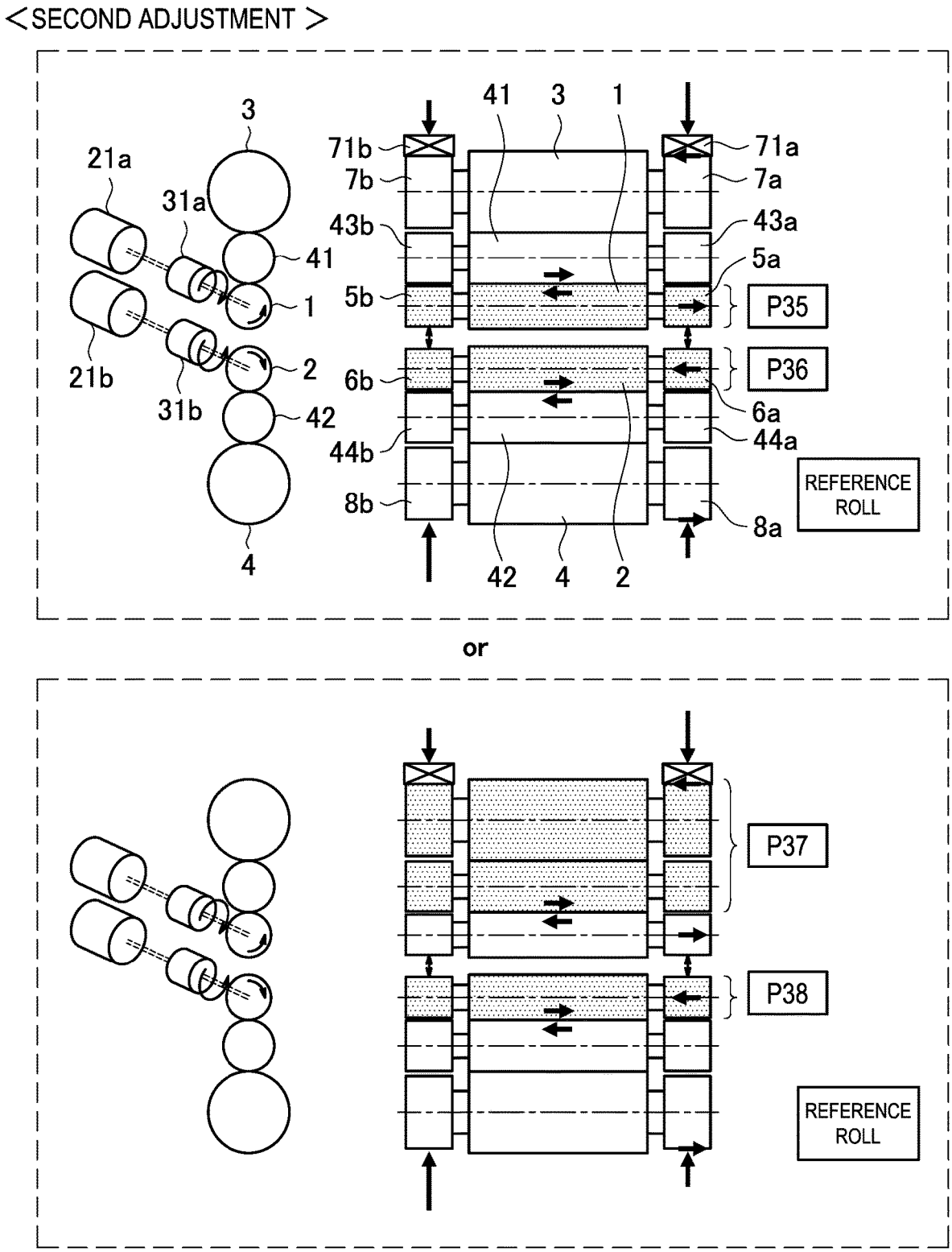
FIG. 17B is an explanatory drawing illustrating procedures for roll position adjustment in a case where the method for setting a rolling mill illustrated in FIG. 4A

Next, in the second adjustment, for example, as illustrated on the upper side in FIG. 17B, in each of the upper roll assembly and the lower roll assembly, the positions of the work roll chocks 5*a*, 5*b*, 6*a* and 6*b* of the work rolls 1 and 2 may be adjusted so that the value of the torque becomes minimal (P35, P36).

Alternatively, as illustrated on the lower side in FIG. 17B, in the roll assembly on the opposite side to the reference roll, that is, the upper roll assembly, the positions of the upper backup roll chocks 7*a* and 7*b* of the backup roll 3 and the upper intermediate roll chocks 43*a* and 43*b* of the upper intermediate roll 41 are adjusted by being moved simultaneously and in the same direction while maintaining the relative positions between the roll chocks so that the value of the torque becomes minimal (P37). Thus, the position of the upper work roll chocks 5*a* and 5*b* may be adjusted to adjust the position of the upper work roll 1 and the upper intermediate roll 41. At such time, with respect to the roll assembly on the reference roll side, that is, the lower roll assembly, similarly to the upper side in FIG. 17B, a configuration may be adopted so as to adjust the position of the lower work roll chocks 6*a* and 6*b* of the lower work roll 2 so that the value of the torque becomes minimal (P38).

Further, in the second adjustment, in the roll assembly on the side on which the vertical roll load measurement apparatuses are installed, the position of the roll chocks of the work roll may be adjusted so that the vertical roll load difference falls within a predetermined allowable range. For example, in FIG. 17B, the vertical roll load measurement apparatuses 71*a* and 71*b* are provided in the upper roll assembly. Therefore, with regard to the upper roll assembly, the position of the upper work roll chocks 5*a* and 5*b* may be adjusted to adjust the position of the upper work roll 1 and the upper intermediate roll 41 so that a vertical roll load difference obtained based on measurement values of the vertical roll load measurement apparatuses 71*a* and 71*b* falls within a predetermined allowable range. Alternatively, in a case where the roll assembly on the side on which the vertical roll load measurement apparatuses are not installed is the roll assembly on the opposite side to the reference roll, it is possible to adjust the backup roll chocks. In this case, the positions of the upper backup roll chocks 7*a* and 7*b* of the backup roll 3 and the upper intermediate roll chocks 43*a* and 43*b* of the upper intermediate roll 41 are adjusted by being moved simultaneously and in the same direction while maintaining the relative positions between the roll chocks. Thus, the position of the upper work roll chocks 5*a* and 5*b* may be adjusted to adjust the position of the upper work roll 1 and the upper intermediate roll 41.

On the other hand, with regard to the roll assembly on the side on which the vertical roll load measurement apparatuses are not installed, that is, the lower roll assembly in FIG. 17B, similarly to the foregoing description, the position of the lower work roll chocks 6*a* and 6*b* of the lower work roll 2 may be adjusted so that the value of the torque becomes minimal. Further, in a case where the roll assembly on the side on which the vertical roll load measurement apparatuses are not installed is the roll assembly on the opposite side to the reference roll, it is possible to adjust the backup roll chocks. In this case, the position of the upper work roll chocks 5*a* and 5*b* may be adjusted to adjust the position of the upper work roll 1 and the upper intermediate roll 41 by controlling the positions of the upper backup roll chocks 7*a* and 7*b* of the backup roll 3 and the upper intermediate roll chocks 43*a* and 43*b* of the upper intermediate roll 41 simultaneously and in the same direction while maintaining the relative positions between the roll chocks.

In the second adjustment, bending apparatuses of the work rolls 1 and 2 are used to apply loads between the work rolls 1 and 2 and the intermediate rolls 41 and 42. At such time, the bending apparatuses of the intermediate rolls 41 and 42 are set to zero or in a balanced state. Note that, in a case where the intermediate rolls 41 and 42 have a decrease bending apparatus, the decrease bending apparatuses may be caused to act in a direction (negative direction) such that the loads between the intermediate rolls 41 and 42 and the backup rolls 3 and 4 are removed.

Figure 17C:
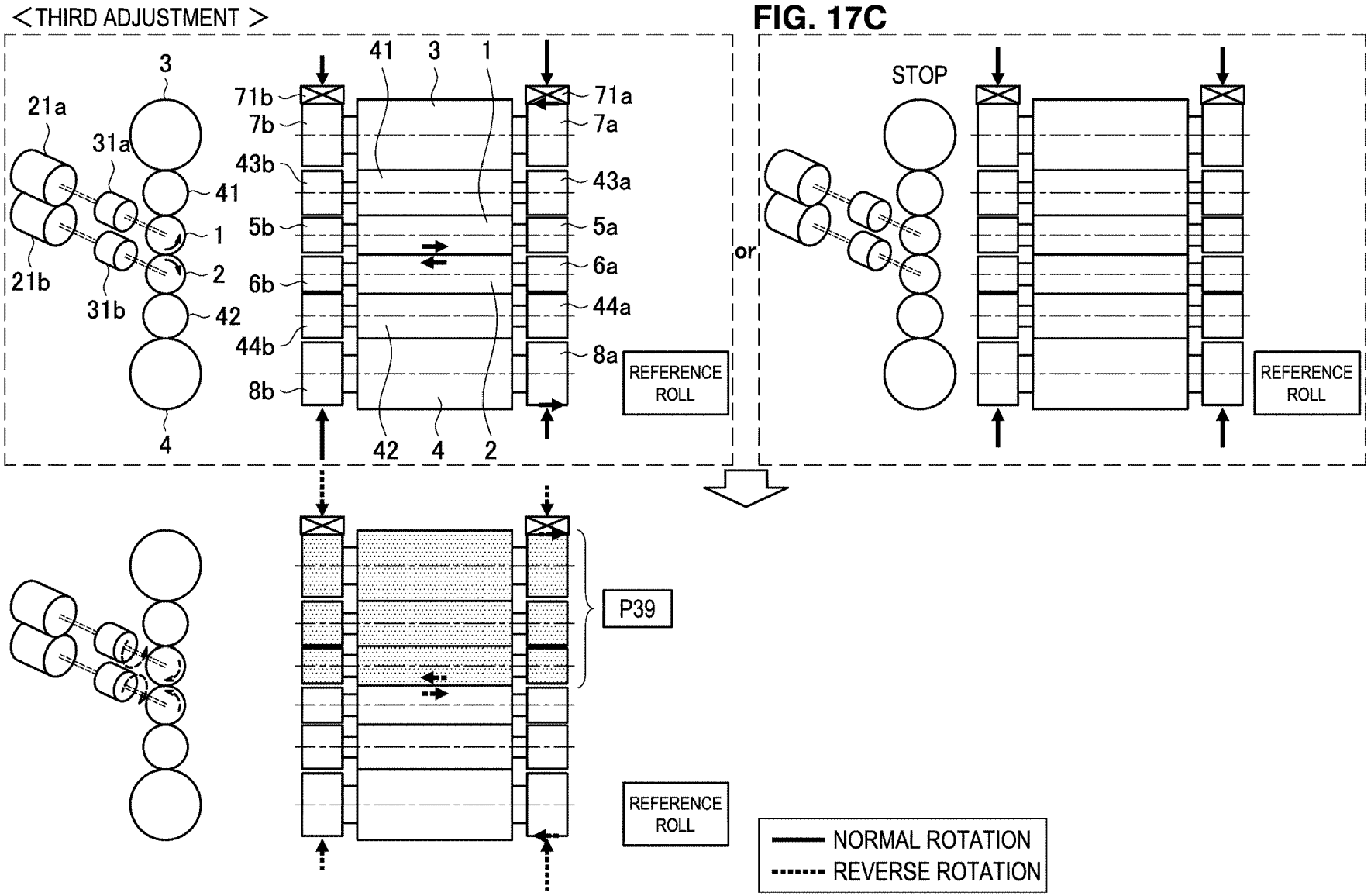
FIG. 17C is an explanatory drawing illustrating procedures for roll position adjustment in a case where the method for setting a rolling mill illustrated in FIG. 4A

Next, when the first process is completed, as illustrated in FIG. 17C, the work rolls 1 and 2 are set in a kiss roll state and a second process is performed. At such time, vertical roll loads in two different rotational states of the pair of work rolls 1 and 2 are measured on the work side and the drive side, respectively, by the vertical roll load measurement apparatuses 71*a* and 71*b*. The rolling direction position of the roll chocks (that is, the lower backup roll chocks 8*a* and 8*b*) of the reference roll is then fixed as a reference position, and the roll chock driving apparatus is driven to adjust the positions of the roll chocks of the respective rolls of the roll assembly (that is, the upper roll assembly) on the opposite side to the reference roll so that the vertical roll load difference falls within a predetermined allowable range. At such time, the roll chocks of the respective rolls constituting the upper roll assembly are controlled simultaneously and in the same direction while maintaining the relative positions between these roll chocks (P39 in FIG. 17C).

The second process corresponds to the second process shown in FIG. 1B, and may be performed similarly to the second adjustment of the four-high rolling mill illustrated in FIG. 4B. That is, for example, as illustrated in FIG. 17C, as two different rotational states, the pair of work rolls 1 and 2 may be set in a normal rotation state and a reverse rotation state, or may be set in a stopped state and a rotational state (normal rotation or reverse rotation).

(2) Case of Vertical Simultaneous Driving

Figure 18A:
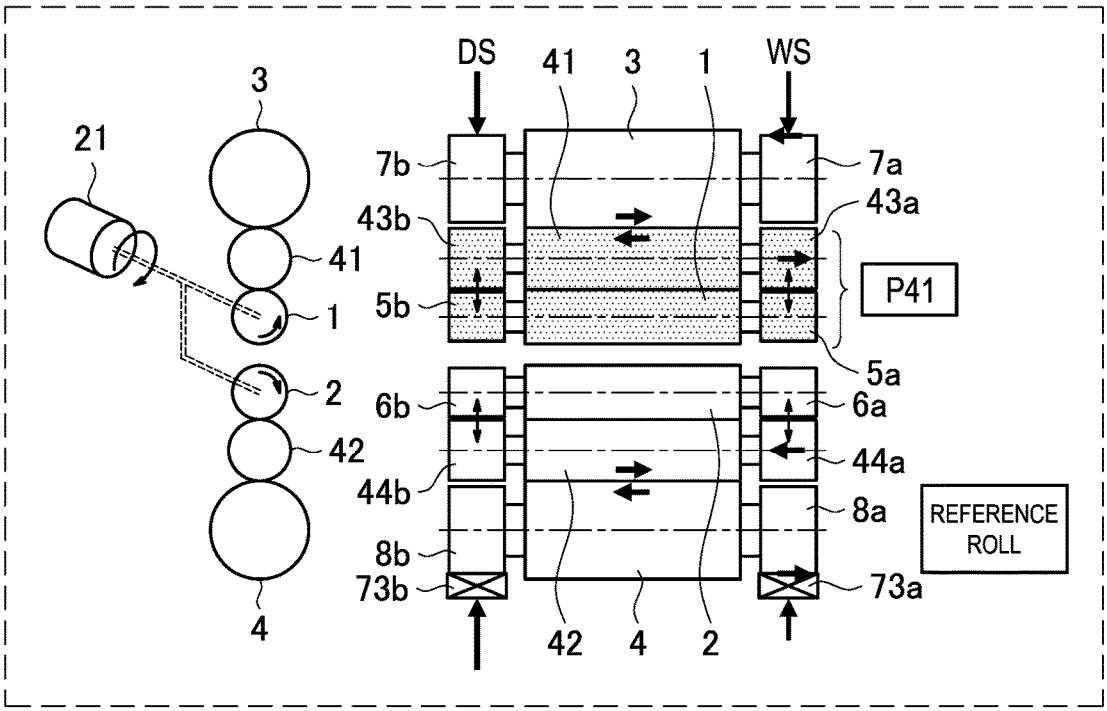
FIG. 18A is an explanatory drawing illustrating procedures for roll position adjustment in a case where the method for setting a rolling mill illustrated in FIG. 7A to FIG. 7C is applied to a six-high rolling mill, that illustrates adjustment of an upper roll assembly in a first adjustment.
Figure 18A:
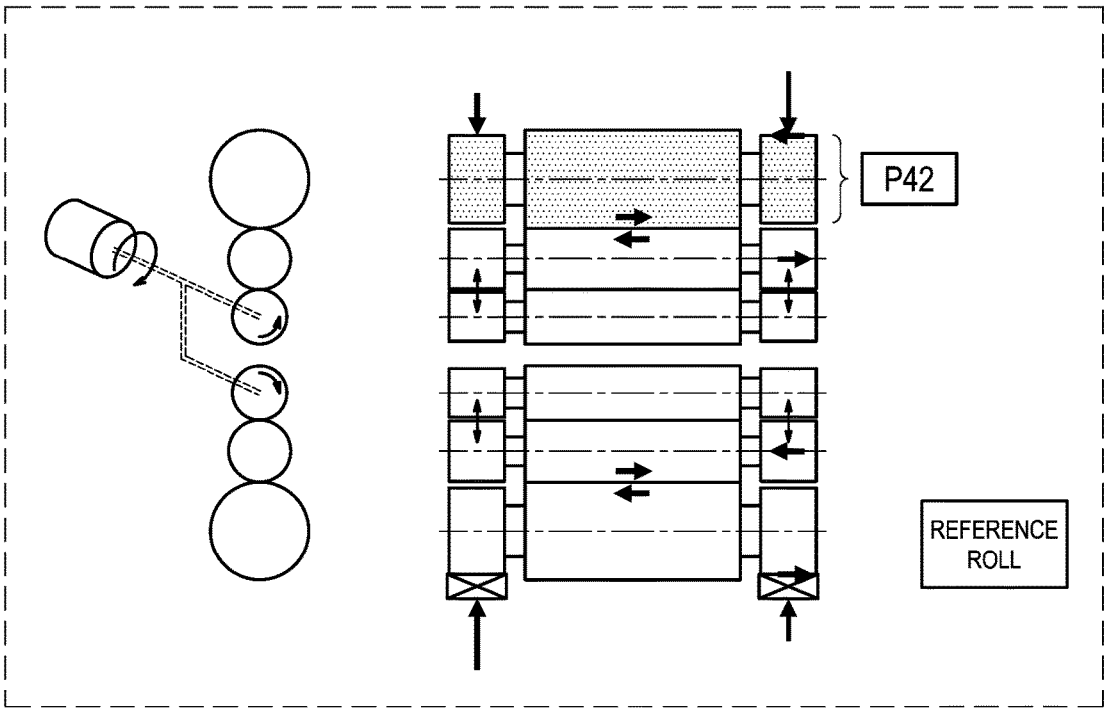

Further, in a six-high rolling mill, for example, as illustrated in FIG. 18A, in some cases the upper work roll 1 and the lower work roll 2 are driven by one driving electric motor 21 through a pinion stand or the like, similarly to the four-high rolling mill illustrated in FIG. 5. Apart from the driving electric motor 21, the configuration of the rolling mill illustrated in FIG. 18A differs from the six-high rolling mill illustrated in FIG. 17A in that a spindle torque measurement apparatus is not provided in the rolling mill illustrated in FIG. 18A, and that lower vertical roll load measurement apparatuses 73*a* and 73*b* are installed on the lower side of the rolling mill instead of the upper vertical roll load measurement apparatuses 71*a* and 71*b*. The remaining configuration is the same as the configuration of the six-high rolling mill illustrated in FIG. 17A. The driving electric motor 21 of the rolling mill illustrated in FIG. 18A simultaneously rotates the upper work roll 1 and the lower work roll 2.

In the six-high rolling mill illustrated in FIG. 18A also, setting of the rolling mill that is performed before reduction position zero point adjustment or before the start of rolling may be performed in a similar manner to the case of the four-high rolling mill illustrated in FIG. 7A to FIG. 7C. That is, the roll gap between the work rolls 1 and 2 is set in an open state, and firstly a first process is performed. The first process corresponds to the first process shown in FIG. 1B. The first process includes: a first adjustment of, for the upper roll assembly and the lower roll assembly, respectively, adjusting the positions of the intermediate roll chocks 43*a*, 43*b*, 44*a* and 44*b* of the intermediate rolls 41 and 42 and the backup roll chocks 7*a*, 7*b*, 8*a* and 8*b* of the backup rolls 3 and 4; and after the first adjustment is completed, a second adjustment of, for the upper roll assembly and the lower roll assembly, respectively, adjusting the positions of the intermediate roll chocks 43*a*, 43*b*, 44*a* and 44*b* of the intermediate rolls 41 and 42 and the work roll chocks 5*a*, 5*b*, 6*a* and 6*b* of the work rolls 1 and 2.

Note that, the order of performing the first adjustment and the second adjustment in the upper roll assembly and lower roll assembly is not particularly limited. For example, the first adjustment and the second adjustment may be performed in that order for the upper roll assembly and the lower roll assembly, respectively, or the first adjustment of the upper roll assembly and the lower roll assembly may be performed, and thereafter the second adjustment of the upper roll assembly and the lower roll assembly may be performed.

For example, in the first adjustment, as illustrated on the upper side in FIG. 18A, firstly, with respect to the upper roll assembly that is the roll assembly on the side on which the vertical roll load measurement apparatus is not installed, the positions of the upper work roll chocks 5*a* and 5*b* of the upper work roll 1 and the upper intermediate roll chocks 43*a* and 43*b* of the upper intermediate roll 41 are controlled simultaneously and in the same direction while maintaining the relative positions between the roll chocks so that the value of the torque becomes minimal (P41). In this way, the position of the upper intermediate roll 41 with respect to the upper backup roll 3 is adjusted by adjusting the positions of the upper work roll chocks 5*a* and 5*b* and the upper intermediate roll chocks 43*a* and 43*b*.

Alternatively, with regard to the upper roll assembly, as illustrated on the lower side in FIG. 18A, since adjustment of the backup roll chocks is possible in a case where the upper roll assembly is not the roll assembly on the reference roll side, the position of the backup roll chocks 7*a* and 7*b* of the upper backup roll 3 may be adjusted so that the value of the torque becomes minimal (P42).

Figure 18B:
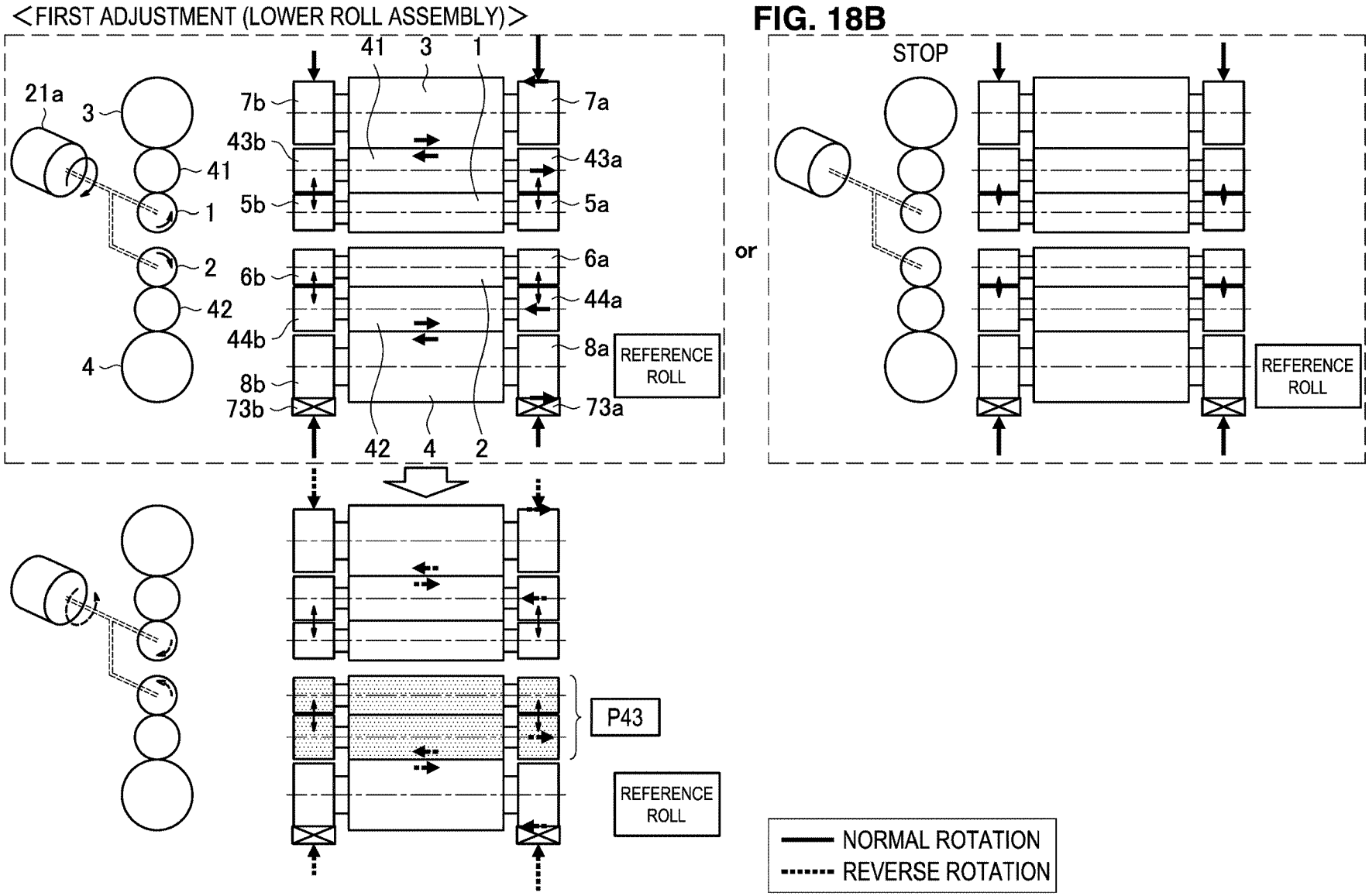
FIG. 18B is an explanatory drawing illustrating procedures for roll position adjustment in a case where the method for setting a rolling mill illustrated in FIG. 7A to FIG. 7C is applied to a six-high rolling mill, that illustrates adjustment of a lower roll assembly in the first adjustment.

On the other hand, with regard to the lower roll assembly that is the roll assembly on the side on which the vertical roll load measurement apparatuses are installed, as illustrated in FIG. 18B, vertical roll loads in two different rotational states of the pair of work rolls 1 and 2 are measured on the work side and the drive side, respectively, by the lower vertical roll load measurement apparatuses 73*a* and 73*b*. The positions of the lower work roll chocks 6*a* and 6*b* of the lower work roll 2 and the lower intermediate roll chocks 44*a* and 44*b* of the lower intermediate roll 42 are then adjusted so that the vertical roll load difference falls within a predetermined allowable range. At such time, the lower work roll chocks 6*a* and 6*b* and the lower intermediate roll chocks 44*a* and 44*b* are controlled simultaneously and in the same direction while maintaining the relative positions between these roll chocks (P43). As the two different rotational states of the pair of work rolls 1 and 2, the pair of work rolls 1 and 2 may be set in a normal rotation state and a reverse rotation state, or may be set in a stopped state and a rotational state (normal rotation or reverse rotation). Note that, if the lower roll assembly is the roll assembly on the opposite side to the reference roll, adjustment of the backup roll chocks is possible. In such a case, the position of the lower backup roll chocks 8*a* and 8*b* of the lower backup roll 4 may be adjusted so that the vertical roll load difference falls within a predetermined allowable range.

Note that, in the first adjustment, a bending force is applied between the intermediate rolls 41 and 42 and the backup rolls 3 and 4 using bending apparatuses of the intermediate rolls 41 and 42. At such time, the bending apparatuses of the work rolls 1 and 2 apply a bending force of a degree such that the intermediate rolls 41 and 42 and the work rolls 1 and 2 do not slip.

Figure 18C:
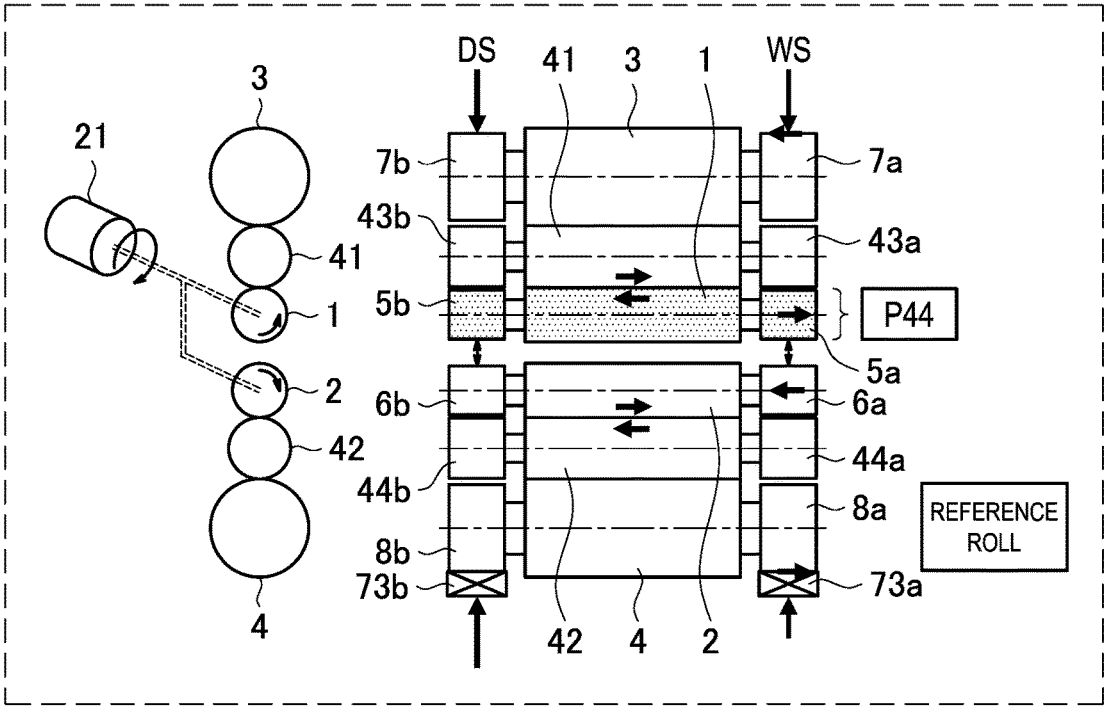
FIG. 18C is an explanatory drawing illustrating procedures for roll position adjustment in a case where the method for setting a rolling mill illustrated in FIG. 7A to FIG. 7C is applied to a six-high rolling mill, that illustrates adjustment of an upper roll assembly in a second adjustment.
Figure 18C:
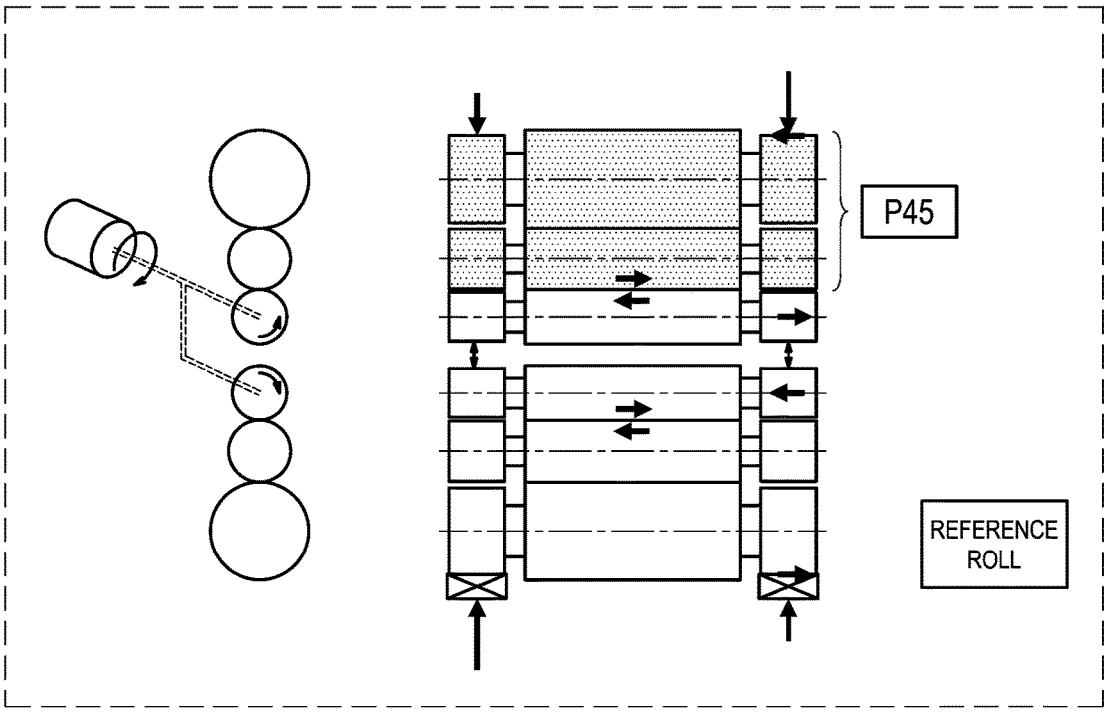

Next, in the second adjustment, firstly, with regard to the upper roll assembly that is the roll assembly on the side on which the vertical roll load measurement apparatuses are not installed, for example, as illustrated on the upper side in FIG. 18C, the position of the upper work roll chocks 5*a* and 5*b* of the upper work roll 1 may be adjusted so that the value of the torque becomes minimal (P44). Alternatively, as illustrated on the lower side in FIG. 18C, the positions of the upper intermediate roll chocks 43*a* and 43*b* of the upper intermediate roll 41 and the upper backup roll chocks 7*a* and 7*b* of the upper backup roll 3 may be adjusted so that the value of the torque becomes minimal. In this case, the upper intermediate roll chocks 43*a* and 43*b* and the upper backup roll chocks 7*a* and 7*b* are controlled simultaneously and in the same direction while maintaining the relative positions between these roll chocks (P45).

Figure 18D:
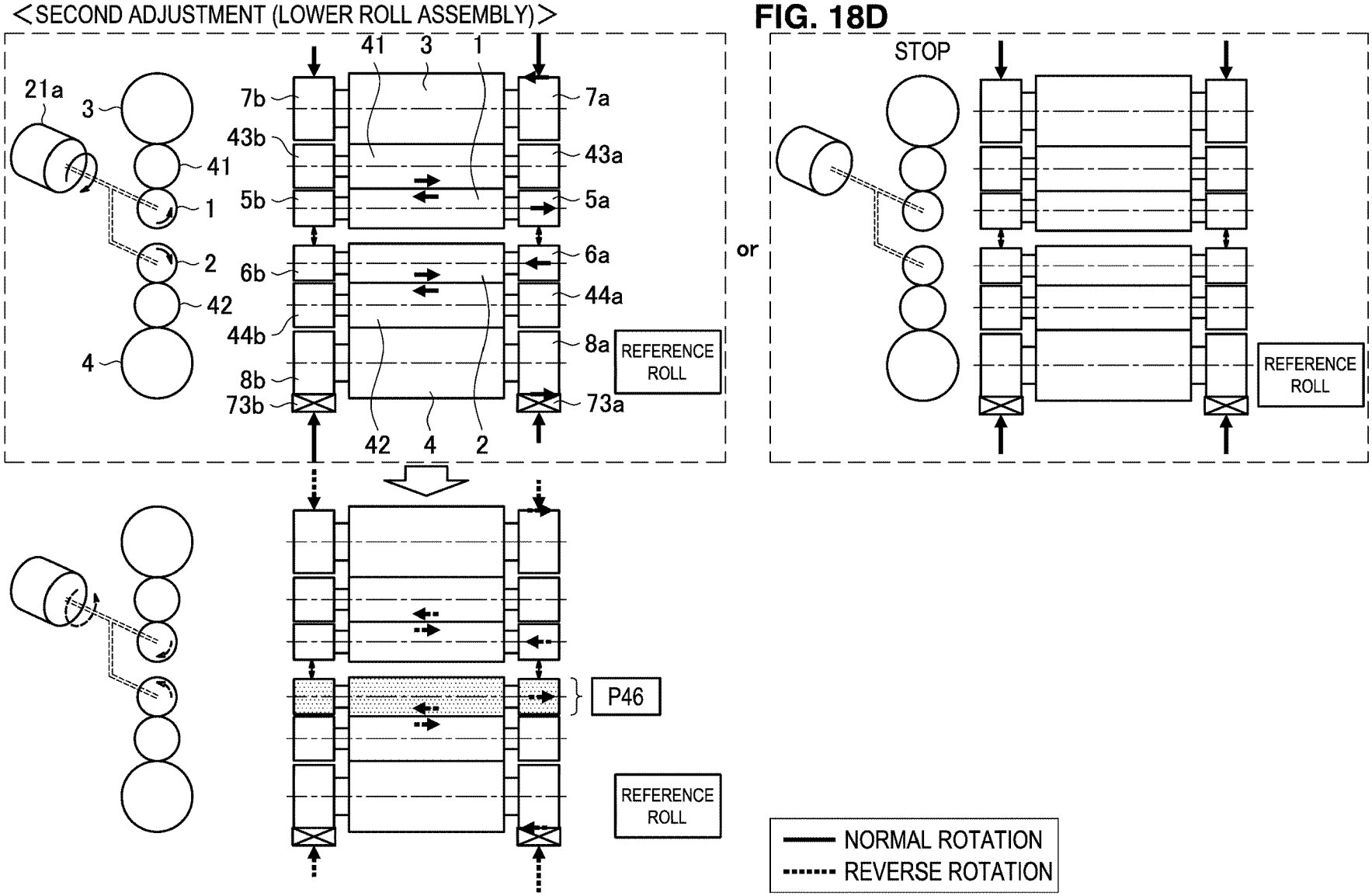
FIG. 18D is an explanatory drawing illustrating procedures for roll position adjustment in a case where the method for setting a rolling mill illustrated in FIG. 7A to FIG. 7C is applied to a six-high rolling mill, that illustrates adjustment of a lower roll assembly in a second adjustment.

On the other hand, with regard to the lower roll assembly that is the roll assembly on the side on which the vertical roll load measurement apparatuses are installed, as illustrated in FIG. 18D, vertical roll loads in two different rotational states of the pair of work rolls 1 and 2 are measured on the work side and the drive side, respectively, by the lower vertical roll load measurement apparatuses 73*a* and 73*b*. The position of the lower work roll chocks 6*a* and 6*b* of the lower work roll 2 is then adjusted so that the vertical roll load difference falls within a predetermined allowable range (P46). As the two different rotational states of the pair of work rolls 1 and 2, the pair of work rolls 1 and 2 may be set in a normal rotation state and a reverse rotation state, or may be set in a stopped state and a rotational state (normal rotation or reverse rotation). Note that, if the lower roll assembly is the roll assembly on the opposite side to the reference roll, the positions of the lower backup roll chocks 8*a* and 8*b* of the lower backup roll 4 and the lower intermediate roll chocks 44*a* and 44*b* of the lower intermediate roll 42 may be adjusted by being controlled simultaneously and in the same direction while maintaining the relative positions between the roll chocks in question so that the vertical roll load difference falls within a predetermined allowable range.

In the second adjustment, bending apparatuses of the work rolls 1 and 2 are used to apply loads between the work rolls 1 and 2 and the intermediate rolls 41 and 42. At such time, the bending apparatuses of the intermediate rolls 41 and 42 are set to zero or in a balanced state. Note that, in a case where the intermediate rolls 41 and 42 have a decrease bending apparatus, the decrease bending apparatuses may be caused to act in a direction (negative direction) such that the loads between the intermediate rolls 41 and 42 and the backup rolls 3 and 4 are removed.

Figure 18E:
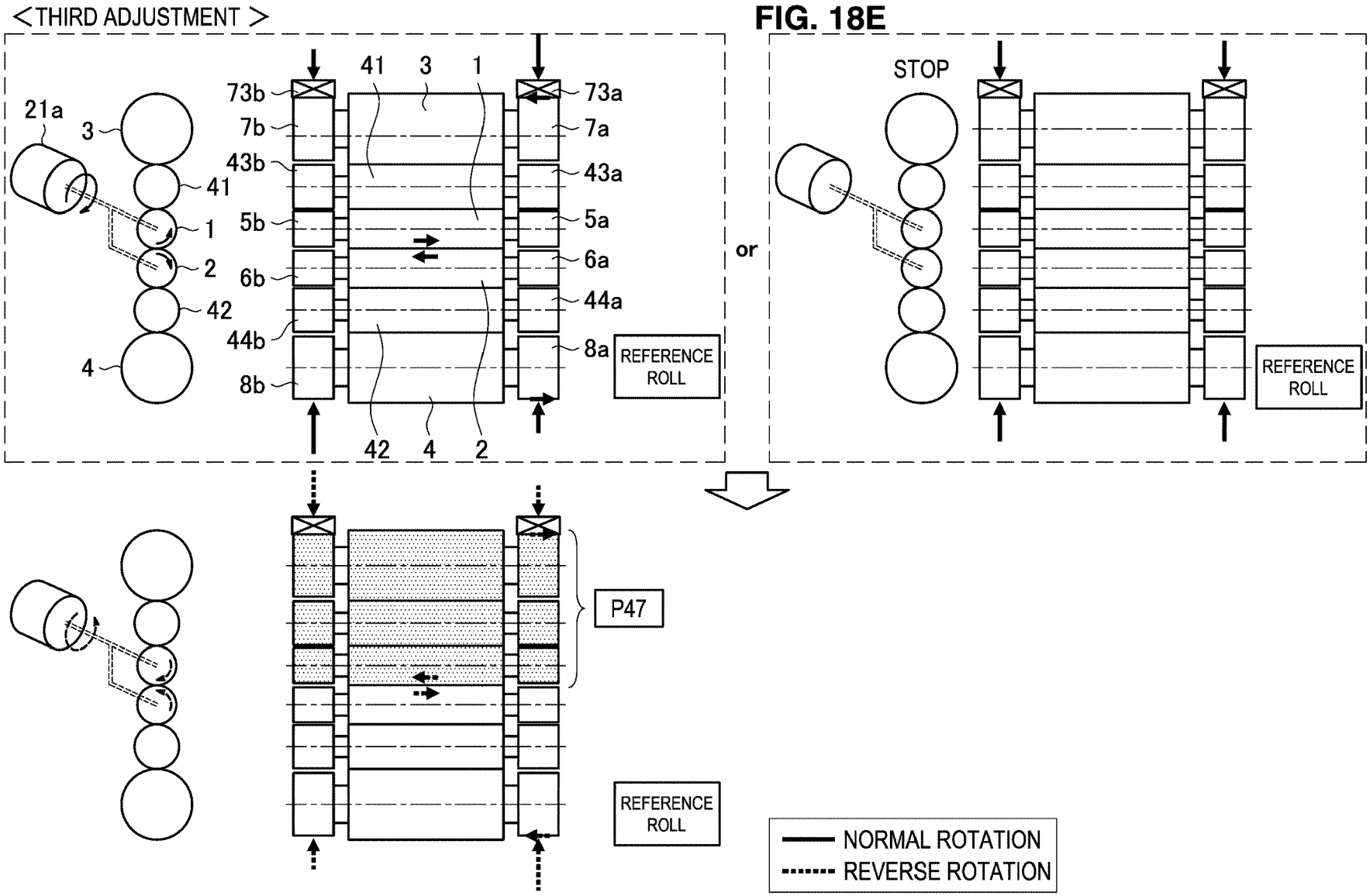
FIG. 18E is an explanatory drawing illustrating procedures for roll position adjustment in a case where the method for setting a rolling mill illustrated in FIG. 7A to FIG. 7C is applied to a six-high rolling mill, that illustrates a third adjustment.

Next, when the first process is completed, as illustrated in FIG. 18E, the work rolls 1 and 2 are set in a kiss roll state and a second process is performed. At such time, vertical roll loads in two different rotational states of the pair of work rolls 1 and 2 are measured on the work side and the drive side, respectively, by the lower vertical roll load measurement apparatuses 73*a* and 73*b*. The rolling direction position of the roll chocks of the reference roll (that is, the lower backup roll chocks 8*a* and 8*b*) is then fixed as a reference position, and the roll chock driving apparatus is driven to adjust the positions of the roll chocks of the respective rolls of the roll assembly (that is, the upper roll assembly) on the opposite side to the reference roll so that the vertical roll load difference falls within a predetermined allowable range (P47). At such time, the roll chocks of the respective rolls constituting the upper roll assembly are controlled simultaneously and in the same direction while maintaining the relative positions between these roll chocks. The second process corresponds to the second process illustrated in FIG. 1B, and may be performed in a similar manner to the third adjustment of the four-high rolling mill illustrated in FIG. 7C.

Thus, the present invention is also applicable to a six-high rolling mill, and not just a four-high rolling mill. Furthermore, the present invention is similarly applicable to rolling mills other than a four-high rolling mill and a six-high rolling mill, and for example the present invention can also be applied to an eight-high rolling mill or a five-high rolling mill.

REFERENCE SIGNS LIST

1 Upper work roll
2 Lower work roll
3 Upper backup roll
4 Lower backup roll
5*a* Upper work roll chock (work side)
5*b* Upper work roll chock (drive side)
6*a* Lower work roll chock (work side)
6*b* Lower work roll chock (drive side)
7*a* Upper backup roll chock (work side)
7*b* Upper backup roll chock (drive side)
8*a* Lower backup roll chock (work side)
8*b* Lower backup roll chock (drive side)
9 Upper work roll chock pressing apparatus
10 Lower work roll chock pressing apparatus
11 Upper work roll chock driving apparatus
12 Lower work roll chock driving apparatus
13 Upper backup roll chock pressing apparatus
14 Upper backup roll chock driving apparatus
15 Roll chock rolling direction force control unit
16 Roll chock position control unit
21 Driving electric motor
21*a* Upper driving electric motor
21*b* Lower driving electric motor
22 Driving electric motor control unit
23 Inter-roll cross control unit
30 Housing
31*a* Upper spindle torque measurement apparatus
31*b* Lower spindle torque measurement apparatus
40 Lower backup roll chock pressing apparatus
41 Upper intermediate roll
42 Lower intermediate roll
43 Upper intermediate roll chock
43*a* Upper intermediate roll chock (work side)
43*b* Upper intermediate roll chock (drive side)
44 Lower intermediate roll chock
44*a* Lower intermediate roll chock (work side)
44*b* Lower intermediate roll chock (drive side)
50 Pressing-down device
61*a* Entrance-side upper increase bending apparatus

61*b* Exit-side upper increase bending apparatus
62*a* Entrance-side lower increase bending apparatus
62*b* Exit-side lower increase bending apparatus
63 Roll bending control unit
71 Upper vertical roll load measurement apparatus
73 Lower vertical roll load measurement apparatus

The invention claimed is:

1. A method for setting a rolling mill, the rolling mill being a rolling mill of four-high or more that includes a plurality of rolls including at least a pair of work rolls and a pair of backup rolls supporting the work rolls, with a plurality of rolls provided on an upper side in a vertical direction with respect to a workpiece taken as an upper roll assembly, a plurality of rolls provided on a lower side in the vertical direction with respect to the workpiece taken as a lower roll assembly, and any one roll among respective rolls arranged in the vertical direction adopted as a reference roll, wherein the rolling mill comprises:

torque measurement load cells which measure a torque acting on the work rolls that is generated by driving of a motor that drives the work rolls, respectively;

vertical roll load measurement load cells which are provided on a work side and a drive side on at least a lower side or an upper side of the rolling mill and which measure a vertical roll load in the vertical direction, respectively;

a first hydraulic cylinder which, with respect to at least roll chocks of the rolls other than the reference roll, is provided on either one of an entrance side and an exit side in a rolling direction, and which presses the roll chocks in a rolling direction of a workpiece; and a second hydraulic cylinder which, with respect to at least roll chocks of the rolls other than the reference roll, is provided so as to face the first hydraulic cylinder in the rolling direction, and which moves the roll chocks in a rolling direction of a workpiece;

the method for setting a rolling mill being executed before reduction position zero point adjustment or before starting rolling, and including:

a first process of:

setting a roll gap between the work rolls in an open state, and with respect to each of the upper roll assembly and the lower roll assembly, in a roll assembly on a side on which the vertical roll load measurement load cells are installed, measuring a torque acting on the work roll by means of the torque measurement load cells, or measuring a vertical roll load in two different rotational states of the pair of work rolls on the work side and the drive side, respectively, by means of the vertical roll load measurement load cells, in a roll assembly on a side on which the vertical roll load measurement load cells are not installed, measuring a torque acting on the work roll by means of the torque measurement load cells, and fixing a rolling direction position of roll chocks of the reference roll as a reference position, and moving roll chocks of the rolls other than the reference roll by means of the second hydraulic cylinder based on the torque or a vertical roll load difference that is a difference between a vertical roll load on the work side and a vertical roll load on the drive side, to thereby adjust positions of the roll chocks; and a second process of:

after performing the first process, setting the work rolls in a kiss roll state, measuring a vertical roll load in two different rotational states of the pair of work rolls on the work side and the drive side, respectively, by means of the vertical roll load measurement load cells, and fixing a rolling direction position of roll chocks of the reference roll as a reference position, and moving the roll chocks of each roll of a roll assembly on an opposite side to the reference roll by means of the second hydraulic cylinder simultaneously and in a same direction while maintaining relative positions between the roll chocks so that the vertical roll load difference is within a predetermined allowable range, to thereby adjust positions of the roll chocks.

2. The method for setting a rolling mill according to claim 1, wherein a roll located at a lowermost part or an uppermost part in the vertical direction among the plurality of rolls is adopted as the reference roll.

3. The method for setting a rolling mill according to claim 2, wherein:

in the rolling mill of four-high, when the work rolls are independently driven by different motors, respectively:

in the first process, positions of roll chocks of the upper roll assembly and positions of roll chocks of the lower roll assembly are simultaneously adjusted or are each independently adjusted;

in a roll assembly on a side on which the vertical roll load measurement load cells are installed, positions of the roll chocks of the rolls other than the reference roll are adjusted so that the vertical roll load difference is within a predetermined allowable range or so that a value of the torque is minimal; and in a roll assembly on a side on which the vertical roll load measurement load cells are not installed, positions of the roll chocks of the rolls other than the reference roll are adjusted so that a value of the torque is minimal.

4. The method for setting a rolling mill according to claim 2, wherein:

in the rolling mill of four-high, when the pair of work rolls are simultaneously driven by one motor:

in the first process, positions of roll chocks of the upper roll assembly and positions of roll chocks of the lower roll assembly are each independently adjusted;

in a roll assembly on a side on which the vertical roll load measurement load cells are installed, positions of the roll chocks of the rolls other than the reference roll are adjusted so that the vertical roll load difference is within a predetermined allowable range or so that a value of the torque is minimal; and in a roll assembly on a side on which the vertical roll load measurement load cells are not installed, positions of the roll chocks of the rolls other than the reference roll are adjusted so that a value of the torque is minimal.

5. The method for setting a rolling mill according to claim 2, wherein:

when the rolling mill is a six-high rolling mill that includes an intermediate roll between the work roll and the backup roll in the upper roll assembly and the lower roll assembly, respectively, and the work rolls are independently driven by different motors, respectively, in the first process:

with respect to each of the upper roll assembly and the lower roll assembly, there are performed:

a first adjustment that adjusts positions of the roll chocks of the intermediate roll and the roll chocks of the backup roll, and a second adjustment that, after the first adjustment is performed, adjusts positions of the roll chocks of the intermediate roll and the roll chocks of the work roll;

wherein, in the first adjustment:

with respect to a roll assembly on a side on which the vertical roll load measurement load cells are installed, positions of roll chocks of the work roll and roll chocks of the intermediate roll are adjusted simultaneously and in a same direction while maintaining relative positions between the roll chocks so that a value of the torque becomes minimal or so that the vertical roll load difference is within a predetermined allowable range, or a position of roll chocks of the backup roll that is not the reference roll is adjusted, and with respect to a roll assembly on a side on which the vertical roll load measurement load cells are not installed, positions of roll chocks of the work roll and roll chocks of the intermediate roll are adjusted simultaneously and in a same direction while maintaining relative positions between the roll chocks so that a value of the torque becomes minimal, or a position of roll chocks of the backup roll that is not the reference roll is adjusted;

and in the second adjustment:

with respect to a roll assembly on a side on which the vertical roll load measurement load cells are installed, a position of roll chocks of the work roll is adjusted so that a value of the torque becomes minimal or so that the vertical roll load difference is within a predetermined allowable range, or positions of roll chocks of the backup roll that is not the reference roll and roll chocks of the intermediate roll are adjusted simultaneously and in a same direction while maintaining relative positions between the roll chocks, and with respect to a roll assembly on a side on which the vertical roll load measurement load cells are not installed, a position of roll chocks of the work roll is adjusted so that a value of the torque becomes minimal, or positions of roll chocks of the backup roll that is not the reference roll and roll chocks of the intermediate roll are adjusted simultaneously and in a same direction while maintaining relative positions between the roll chocks.

6. The method for setting a rolling mill according to claim 2, wherein:

when the rolling mill is a six-high rolling mill that includes an intermediate roll between the work roll and the backup roll in the upper roll assembly and the lower roll assembly, respectively, and the pair of work rolls are simultaneously driven by one motor, in the first process:

separately for each of the upper roll assembly and the lower roll assembly, there are performed:

a first adjustment that adjusts positions of roll chocks of the intermediate roll and roll chocks of the backup roll, and a second adjustment that, after the first adjustment is performed, adjusts positions of roll chocks of the intermediate roll and roll chocks of the work roll;

wherein in the first adjustment:

with respect to a roll assembly on a side on which the vertical roll load measurement load cells are installed, positions of roll chocks of the work roll and roll chocks of the intermediate roll are adjusted simultaneously and in a same direction while maintaining relative positions between the roll chocks so that a value of the torque becomes minimal or so that the vertical roll load difference is within a predetermined allowable range, or a position of roll chocks of the backup roll that is not the reference roll is adjusted, and with respect to a roll assembly on a side on which the vertical roll load measurement load cells are not installed, positions of roll chocks of the work roll and roll chocks of the intermediate roll are adjusted simultaneously and in a same direction while maintaining relative positions between the roll chocks so that a value of the torque becomes minimal, or a position of roll chocks of the backup roll that is not the reference roll is adjusted;

and in the second adjustment:

with respect to a roll assembly on a side on which the vertical roll load measurement load cells are installed, a position of roll chocks of the work roll is adjusted so that a value of the torque becomes minimal or so that the vertical roll load difference is within a predetermined allowable range, or positions of roll chocks of the backup roll that is not the reference roll and roll chocks of the intermediate roll are adjusted simultaneously and in a same direction while maintaining relative positions between the roll chocks, and with respect to a roll assembly on a side on which the vertical roll load measurement load cells are not installed, a position of roll chocks of the work roll is adjusted so that a value of the torque becomes minimal, or positions of roll chocks of the backup roll that is not the reference roll and roll chocks of the intermediate roll are adjusted simultaneously and in a same direction while maintaining relative positions between the roll chocks.

7. A rolling mill that is a rolling mill of four-high or more that includes a plurality of rolls including at least a pair of work rolls and a pair of backup rolls supporting the work rolls, in which any one roll among respective rolls that are arranged in a vertical direction is adopted as a reference roll, comprising:

torque measurement load cells which measure a torque acting on the work rolls that is generated by driving of a motor that drives the work rolls, respectively;

vertical roll load measurement load cells which are provided on a work side and a drive side on at least a lower side or an upper side of the rolling mill and which measure a vertical roll load in the vertical direction, respectively;

a first hydraulic cylinder which, with respect to at least roll chocks of the rolls other than the reference roll, is provided on either one of an entrance side and an exit side in a rolling direction, and which presses the roll chocks in a rolling direction of a workpiece;

a second hydraulic cylinder which, with respect to at least roll chocks of the rolls other than the reference roll, is provided so as to face the first hydraulic cylinder in a rolling direction, and which moves the roll chocks in a rolling direction of a workpiece; and a roll chock position control unit that fixes a rolling direction position of roll chocks of the reference roll as a reference position, and controls the second hydraulic cylinder based on a value of the torque being minimal or a vertical roll load difference that is a difference between the vertical roll load on the work side and the vertical roll load on the drive side being within a predetermined allowable range to adjust positions in a rolling direction of the roll chocks of the rolls other than the reference roll, wherein the roll chock position control unit is configured to adjust positions in a rolling direction of the roll chocks of the rolls other than the reference roll by setting a roll gap between the work rolls in an open state, and with respect to each of the upper roll assembly and lower roll assembly, measuring a torque acting on the work rolls with the torque measurement load cells, measuring a vertical roll load in two different rotational states of the pair of work rolls on the work side and the drive side, respectively, with the vertical roll load measurement load cells, moving roll chocks of the rolls other than the reference roll by means of the second hydraulic cylinder based upon the measured torque or a vertical roll load difference that is a difference between a vertical roll load measured on the work side and a vertical roll load measured on the drive side, setting the work rolls in a kiss roll state, measuring a vertical roll load in two different rotational states of the pair or work rolls on the work side and drive side, respectively, with the vertical roll load measurement load cells, and moving the roll chocks of each roll of a roll assembly on an opposite side to the reference roll by means of the second hydraulic cylinder simultaneously and in the same direction while maintaining relative positions between the roll chocks.

8. The rolling mill according to claim 7, wherein an upper work roll and a lower work roll are independently driven vertically by different motors, respectively.

9. The rolling mill according to claim 7, wherein an upper work roll and a lower work roll are simultaneously driven vertically by one motor.

* * * * *